US008837992B2

(12) United States Patent
Otome et al.

(10) Patent No.: US 8,837,992 B2
(45) Date of Patent: Sep. 16, 2014

(54) POWDER FEEDING DEVICE HAVING NEGATIVE PRESSURE GENERATION CONTROL AND POWDER DISCHARGE CONTROL AND IMAGE FORMING APPARATUS

(75) Inventors: Yukio Otome, Kanagawa (JP); Masashi Nakayama, Kanagawa (JP); Hiroyuki Mabuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 477 days.

(21) Appl. No.: 13/137,598

(22) Filed: Aug. 29, 2011

(65) Prior Publication Data

US 2012/0063814 A1 Mar. 15, 2012

(30) Foreign Application Priority Data

Sep. 10, 2010 (JP) ..... 2010-203674
Sep. 10, 2010 (JP) ..... 2010-203682
Sep. 10, 2010 (JP) ..... 2010-203705
Sep. 10, 2010 (JP) ..... 2010-203719

(51) Int. Cl.
*G03G 15/08* (2006.01)

(52) U.S. Cl.
USPC ..... 399/258; 399/260

(58) Field of Classification Search
CPC ..... G03G 15/0839; G03G 15/0832; G03G 15/0834; G03G 15/0879; G03G 15/0877; G03G 2215/068; Y10S 222/01; B65D 86/06
USPC ..... 399/258, 255, 252, 253, 254, 259, 260, 399/262, 263
See application file for complete search history.

(56) References Cited

U.S. PATENT DOCUMENTS 4,613,226 A * 9/1986 Kimura et al. ..... 399/142
6,487,384 B2 11/2002 Okada et al.
6,603,942 B2 8/2003 Asuwa et al.
6,684,036 B2 1/2004 Kubota et al.
6,694,119 B2 2/2004 Rokutanda et al.
6,738,586 B2 5/2004 Kubota et al.
6,853,829 B2 2/2005 Hoshi et al.
6,871,036 B2 3/2005 Asuwa et al.
6,879,800 B2 4/2005 Mabuchi et al.
6,993,275 B2 1/2006 Mitsuya et al.
(Continued)

FOREIGN PATENT DOCUMENTS

JP 2009-175703 A 8/2009

OTHER PUBLICATIONS

Machine English Translation of JP2009-175703 published on Aug. 6, 2009.*

*Primary Examiner* — Billy Lactaoen
(74) *Attorney, Agent, or Firm* — Harness, Dickey & Pierce, P.L.C.

(57) ABSTRACT

A powder feeding device includes a powder container, a feeding tank in communication with the powder container, a negative pressure room in communication with the feeding tank via a suction port communicating tube; an air suction device in communication with the negative pressure room via a negative pressure room communication tube; a suction port opening and closing unit that opens and closes the suction port communicating tube; a negative pressure room opening and closing unit that opens and closes of the negative pressure room communication tube; an output port opening and closing unit that opens and closes an output port of the feeding tank; and a controller that performs negative pressure generation control, powder supply control, and powder discharge control. Further, the controller simultaneously starts the negative pressure generation control and the powder discharge control.

12 Claims, 20 Drawing Sheets

(56) References Cited

U.S. PATENT DOCUMENTS

| | | | |
|---|---|---|---|
| 7,167,667 | B2 | 1/2007 | Mabuchi |
| 7,421,222 | B2 | 9/2008 | Kubo et al. |
| 7,502,579 | B2 | 3/2009 | Mabuchi et al. |
| 7,539,453 | B2 | 5/2009 | Otome et al. |
| 7,574,164 | B2 | 8/2009 | Okada et al. |
| 7,643,779 | B2 | 1/2010 | Mabuchi et al. |
| 7,773,896 | B2 | 8/2010 | Yagawara et al. |
| 7,865,112 | B2 | 1/2011 | Saito et al. |
| 7,873,312 | B2 | 1/2011 | Umeda et al. |
| 7,970,307 | B2 | 6/2011 | Mabuchi et al. |
| 2002/0127026 | A1 | 9/2002 | Kubota et al. |
| 2002/0127027 | A1 | 9/2002 | Kubota et al. |
| 2003/0068175 | A1 | 4/2003 | Asuwa et al. |
| 2005/0123312 | A1 | 6/2005 | Mabuchi |
| 2005/0162136 | A1 | 7/2005 | Kubo et al. |
| 2007/0172262 | A1 | 7/2007 | Okada et al. |
| 2007/0196138 | A1 | 8/2007 | Mabuchi et al. |
| 2008/0199213 | A1 | 8/2008 | Saito et al. |
| 2008/0226321 | A1 | 9/2008 | Kuwabara et al. |
| 2009/0010667 | A1 | 1/2009 | Mabuchi et al. |
| 2009/0169266 | A1 | 7/2009 | Uehara |

* cited by examiner

ANOTHER EXAMPLE OF NEGATIVE PRESSURE GENERATION CONTROL

ANOTHER EXAMPLE OF TONER SUPPLY CONTROL

ANOTHER EXAMPLE OF NEGATIVE PRESSURE GENERATION CONTROL AND ANOTHER EXAMPLE OF TONER SUPPLY CONTROL

ANOTHER EXAMPLE OF NEGATIVE PRESSURE GENERATION CONTROL

ANOTHER EXAMPLE OF TONER SUPPLY CONTROL

ANOTHER EXAMPLE OF NEGATIVE PRESSURE GENERATION CONTROL AND ANOTHER EXAMPLE OF TONER SUPPLY CONTROL

POWDER FEEDING DEVICE HAVING NEGATIVE PRESSURE GENERATION CONTROL AND POWDER DISCHARGE CONTROL AND IMAGE FORMING APPARATUS

CROSS-REFERENCE TO RELATED APPLICATIONS

The present application claims priority under 35 U.S.C §119 based on Japanese Patent Application Nos. 2010-203674, 2010-203682, 2010-203705, and 2010-203719 filed on Sep. 10, 2010, the entire contents of which are hereby incorporated herein by reference.

BACKGROUND OF THE INVENTION

1. Field of the Invention

The present invention generally relates to a powder feeding device that feeds powder such as toner to a developing device used in an image forming apparatus such as a copier, a facsimile machine, a printer and the like, and an image forming apparatus including the powder feeding device.

2. Description of the Related Art

There have been known various powder feeding devices feeding toner (powder) from a toner container as a powder container to a developing device. The powder feeding devices have been used in various image forming apparatuses including a copier, a facsimile machine, a printer and the like. Further, there have been proposed various powder feeding devices in which heat stress on toner is reduced to prevent the aggregation of toner powder and prevent fixing the toner to the inner surface of a feeding path when the toner includes thermoreversible resin or the like.

For example, Japanese Patent Application Publication No. 2009-175703 (hereinafter referred to as "Patent Document 1") discloses a powder feeding device that feeds toner (powder) under a condition that heat stress on the toner is low as illustrated in FIG. 16. In the following description, since some terms and reference numerals used in Patent Document 1 are same or equivalent to those used in examples of the present invention described below, only different terms and reference numerals used in Patent Document 1 are described in parentheses.

As illustrated in FIG. 16, a powder feeding device 35 (developer feeding device 35A) of an image forming apparatus disclosed in Patent Document 1 includes a toner container 40 as a powder container containing toner (powder) 36. Further, the powder feeding device 35 includes a feeding tank 41 including an input port 49, an output port 50, and a suction port 51. The input port 49 is formed so that toner 36 supplied from the toner container 40 is input into the feeding tank 41 through the input port 49. The output port 50 is provided, so that the toner 36 is discharged from the feeding tank 41 to a container tank 17 of a developing device 13. The suction port 51 is provided, so that gas in the feeding tank 41 is discharged (suctioned) through the suction port 51. In the feeding tank 41, a feeding screw 42 is provided so that toner 36 supplied from the toner container 40 is fed to the output port 50 when the feeding screw 42 rotates. Further, a filter 55 is provided at the suction port 51. Further, a suction port communicating tube 45 (communication plumbing 45*a*) is provided to be connected to the suction port 51. Further, a negative pressure room (negative pressure tank) 82 is provided to be in communication with the feeding tank 41 via the suction-port communicating tube 45. Further, a suction-port opening and closing device (negative pressure room opening and closing device) 93 is provided as a suction-port opening and closing unit to open and close the inside of the suction-port communicating tube 45. Further, a negative pressure room communicating tube 100 (communication plumbing 45*b*) is provided to be connected to a through hole 88 which is a negative pressure room suction port formed on the negative pressure room 82. Further, the negative pressure room 82 includes a first negative pressure room 83 which is the upper part of the negative pressure room 82 and a second negative pressure room 84 which is the lower part of the negative pressure room 82. The first negative pressure room 83 is communication with the second negative pressure room 84 via an auxiliary filter 92. Further, the suction-port communicating tube 45 is in communication with the second negative pressure room 84 which is the lower part of the negative pressure room 82. Further, the first negative pressure room 83 which is the upper part of the negative pressure room 82 is in communication with a suction pump 43 via the through hole 88 and the negative pressure room communicating tube 100 (communication plumbing 45*b*), the through hole 88 being a negative pressure room suction port formed on the first negative pressure room 83. The suction pump 43 is provided as an air suction device communicating with the negative pressure room 82. Further, a suction pump 43 as a gas suctioning device is provided to be in communication with the negative pressure room 82 via the negative pressure room communicating tube 100. Further, a discharge tube 46 is provided to be connected to the output port 50. Further, there are provided a negative pressure room opening and closing device (suction pump opening and closing device) 96 and an output port opening and closing device (opening and closing device) 47. The negative pressure room opening and closing device 96 opens and closes the inside of the negative pressure room communicating tube 100 as a negative pressure room opening and closing unit. The output port opening and closing device 47 opens and closes the inside of the discharge tube 46 as an output port opening and closing unit. The other end of the discharge tube 46 is connected to a supply hole 37 of the container tank 17 of the developing device 13. Further, a mixing screw 18 to mix and feed the developer (toner) is provided in the container tank 17. Further, a pressure sensor 90 to detect the pressure in the negative pressure room 82 is provided. Further, a controller 48 to control the devices is provided. The controller 48 repeatedly performs a series of operations described below upon receiving a signal instructing supply of toner 36 to the developing device 13.

In the powder feeding device 35, toner 36 is supplied from the toner container 40 to the container tank 17 of the developing device 13 while maintaining heat stress on toner to be low by operating each component in the powder feeding device 35 as follows. The controller 48 causes a piston driving device 60 to move a piston 59 of the suction pump 43 to the position closest to a bottom part 61 of a cylinder main body 58. Then, the controller 48 causes an open and close driving source 71 of the output port opening and closing device 47 to close the inside of the discharge tube 46, causes a suction-port opening and closing device 95 of the suction-port opening and closing device 93 to close the inside of the suction-port communicating tube 45, and causes an open and close driving source 98 of the negative pressure room opening and closing device 96 to open the inside of the negative pressure room communicating tube 100. Under this state, the controller 48 controls to move the piston 59 so that the piston 59 is separated from the bottom part 61 of a cylinder main body 58. As a result, gas in the negative pressure room 82 is suctioned by the suction pump 43 and the pressure in the negative pressure room 82 is lowered. As a result, a negative pressure is generated in the negative pressure room 82, and namely, a negative pressure is generated in a first negative pressure room 83 and a second negative pressure room 84. Then, when the pressure in the negative pressure room 82 detected by the pressure sensor 90 becomes a predetermined value, the controller 48 stops the suctioning operation of the suction pump 43 and causes the open and close driving source 98 of the negative pressure room opening and closing device 96 to close the inside of the negative pressure room communicating tube 100. Then, the controller 48 controls to rotate the feeding screw 42 in the feeding tank 41 around the axle of the feeding screw 42 and causes the open and close driving source 95 of the suction-port opening and closing device 93 to open the inside of the suction-port communicating tube 45. As a result, gas in the feeding tank 41 is suctioned into the negative pressure room 82 due to the negative pressure in the negative pressure room 82. By suctioning gas in the feeding tank 41 into the negative pressure room 82 and reducing the pressure in the feeding tank 41, toner 36 along with gas in the toner container 40 are suctioned into the feeding tank 41.

Further, when air in the feeding tank 41 is suctioned by the negative pressure in the negative pressure room 82, the toner 36 having been suctioned (introduced) into the feeding tank 41 is also suctioned toward the negative pressure room 82. However, the filter 55 prevents the toner 36 from being passing through the filter 55. As a result, the leakage of the toner 36 beyond the suction port 51 is prevented. Further, the toner 36 having passed through the filter 55 is prevented from passing through the auxiliary filter 92, so the toner 36 remains in the first negative pressure room 83 and does not enter into the suction pump 43.

Then, after a predetermined time period has passed, the controller 48 causes the open and close driving source 95 of the suction-port opening and closing device 93 to close the inside of the suction-port communicating tube 45. As a result, the feed of toner from the toner container 40 to the feeding tank 41 is stopped, and toner in the feeding tank 41 is fed toward the output port 50 by the rotation of the feeding screw 42. After that, the controller 48 causes the open and close driving source 71 of the output port opening and closing device 47 to open the inside of the discharge tube 46. As a result, toner 36 in the feeding tank 41 is discharged to an outside of the feeding tank 41 via the output port 50, so that toner 36 is supplied into the container tank 17 of the developing device 13. As described above, the controller 18 of the powder feeding device 35 performs a series of control operations of generating a negative pressure in the negative pressure room 82, suctioning toner 36 into the feeding tank 41, and discharging toner 36 through the output port 50.

As described above, in the powder feeding device 35 of related art illustrated in FIG. 16, gas in the feeding tank 41 is suctioned so as to suction toner 36 from the toner container 40 into the feeding tank 41. Namely, in order to suction toner 36 into the feeding tank 41, a negative pressure is generated in the feeding tank 41. Further, in order to generate the negative pressure in the feeding tank 41, the suction pump 43 is provided outside the feeding tank 41. Because of this structure, it is possible to prevent the heat transfer from the suction pump 43 to toner 36. Further, since the negative pressure is used to suction toner 36 into the feeding tank 41, it becomes possible to suction toner 36 into the feeding tank 41 without grinding toner 36. As a result, it becomes possible to minimize the heat stress on toner 36 and feeding toner 36. Further, it becomes possible to generate a negative pressure in the negative pressure room 82 by suctioning gas in the negative pressure room 82 using the suction pump 43 and suction gas in the feeding tank 41 by using the negative pressure in the negative pressure room 82. Because of this structure, when compared with a case where, for example, gas in the feeding tank 41 is directly suctioned by a mechanical gas suctioning device such as the suction pump, a suction time period may be reduced and a feeding time of toner as powder may also be reduced.

Further, when compared with a case where a mechanical air suction device such as the suction pump is used to directly suction the air in the feeding tank 41, it may become possible to increase a feeding amount of toner 36 per unit time. Therefore, it may become possible to apply to an image forming apparatus having faster printing speed and having a larger toner consumption amount per unit time as well.

Further, due to the filter 55 provided at the suction port 51 and the auxiliary filter 92 provided between the first negative pressure room 83 and the second negative pressure room 84, the toner 36 is prevented from entering into the suction pump 43. By doing this, it may become possible to eliminate the direct contact between the toner 36 and the suction pump 43. Therefore, it may become possible to apply grease or the like to the suction pump 43. As a result, it may become possible to prevent a failure and a trouble of the suction pump 43 caused by the adhesion of the toner 36 to the suction pump 43 and lower the driving torque of the suction pump 43 and enhance the service lifetime of the suction pump 43.

SUMMARY OF THE INVENTION

According to an aspect of the present invention, a powder feeding device includes a powder container containing powder; a feeding tank including an input port through which the powder is supplied from the powder container, an output port through which the powder is discharged to outside, and a suction port through which air in the feeding tank is suctioned; a negative pressure room configured to be in communication with the feeding tank via a suction port communicating tube connected to the suction port; an air suction device in communication with the negative pressure room via a negative pressure room communication tube connected to an negative pressure room suction port formed on the negative pressure room; a suction port opening and closing unit that opens and closes an inside of the suction port communicating tube; a negative pressure room opening and closing unit that opens and closes an inside of the negative pressure room communication tube; an output port opening and closing unit that opens and closes the output port; and a controller that performs a negative pressure generation control, a powder supply control, and a powder discharge control. Further, in the negative pressure generation control, after causing the suction port opening and closing unit to close the inside of the inside of the suction port communicating tube and causing the negative pressure room opening and closing unit to open the inside of the negative pressure room communication tube, the controller is configured to drive the air suction device so as to suction air in the negative pressure room, and after that, when a pressure in the negative pressure room is equal to a predetermined negative pressure state, the controller is configured to stop the air suction device and cause the negative pressure room opening and closing unit to close the inside of the negative pressure room communication tube. Further, in the powder supply control, after causing the output port opening and closing unit to close the output port and causing the suction port opening and closing unit to open the inside of the suction port communicating tube, the controller is configured to cause the suction port opening and closing unit to open the inside of the suction port communicating tube so as to supply the powder from the powder container to the feeding tank, and after that, when determining that a predetermined amount of powder is supplied to the feeding tank, the controller is configured to cause the suction port opening and closing unit to close the inside of the suction port communicating tube. Further, in the powder discharge control, the controller is configured to cause the output port opening and closing unit to open the output port so as to discharge the powder from the output port, the powder having been supplied into the feeding tank. Further, the controller is configured to simultaneously start the negative pressure generation control and the powder discharge control.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
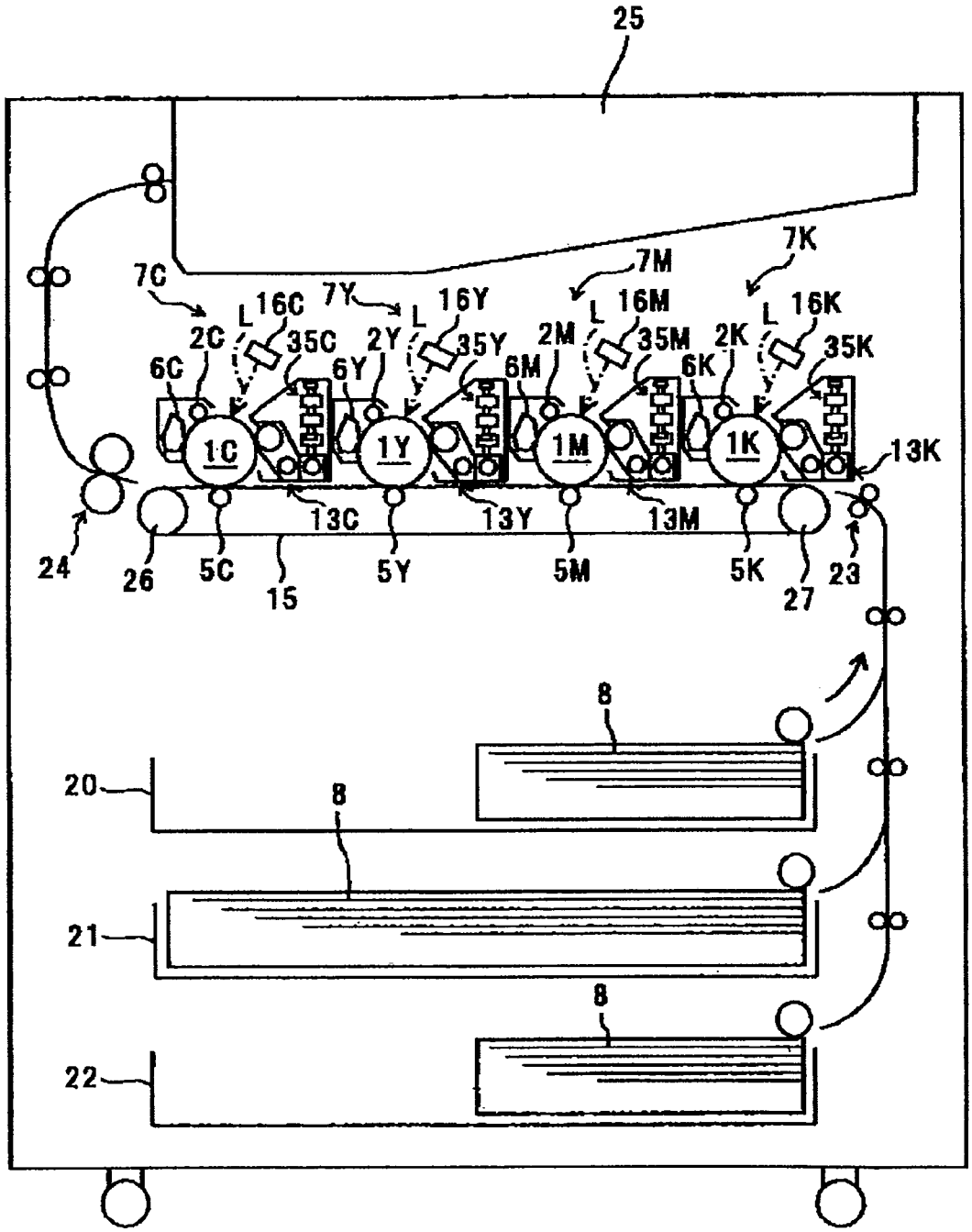
FIG. 1 is a drawing illustrating an image forming apparatus according to an embodiment of the present invention.

Recently, there has been an increasing demand for increasing a printing speed of the image forming apparatus. In order to increase the printing speed of the image forming apparatus, it becomes necessary to increase toner consumption amount per unit time. Namely, it becomes necessary to increase a toner supply amount supplied to the developing device per unit time. As a method of increasing the toner supply amount supplied to the developing device per unit time, there is one method for reducing a time period necessary to feed toner in a series of operations of the powder feeding device. Further, there is another method for increasing the toner supply amount supplied in a single toner feeding operation in the series of operations of the powder feeding device.

However, in the powder feeding device in Patent Document 1, there are three operations which are a negative pressure generating operation to generate the negative pressure in the negative pressure room 82, a toner feeding operation to supply toner 36 into the feeding tank 41 and feed the toner 36 to the output port 50, and a toner discharge operation to discharge toner 36. Further, those operations are controlled as a series of operations of the powder feeding device. Namely, those operations are performed one by one. Therefore, each of the operations requires a predetermined time period, and it may be difficult to further reduce the time period of each of the operations so as to reduce the entire time period required to perform the series of the operations. On the other hand, it may also be difficult to increase the toner supply amount supplied in a single toner feeding operation in the series of operations of the powder feeding device without increasing the manufacturing cost of the powder feeding device. This is because in order to increase the toner supply amount suctioned from the toner container into the feeding tank within a single toner feeding operation, it may be necessary to increase the negative pressure value in the negative pressure room or increase the space capacity of the negative pressure room. Further, to that end, it is further necessary to use the gas suctioning device capable of providing a larger air flow rate so as to obtain a higher degree of vacuum. As a result, the manufacturing cost of the gas suctioning device may be increased. Due to the above reasons, it may be difficult to employ the powder feeding device according to Patent Document 1 in an image forming apparatus that requires a faster printing speed.

On the other hand, with an increasing demand for longer service lifetime of an image forming apparatus, as a method of providing the longer service lifetime of the powder feeding device included in an image forming apparatus, a filter is used to extend the service lifetime of the suction pump and a filter is cleaned to extend the service lifetime of the filter. In the powder feeding device, Patent Document 1 proposes that the filter is cleaned by using air flow from the suction pump 43 to the suction port 51 generated by the pressure difference between the negative pressure in the container tank 17 and the atmospheric pressure by opening the inside of the suction pump 43 to the air. Patent Document 1 further proposes that air flow is generated from the suction pump 43 to the suction port 51 by using a piston-type suction pump 43 and the filter is cleaned by using the air flow.

However, in the powder feeding device of Patent Document 1, the cross-sectional area and the cross-sectional shape vary among the suction pump 43, the negative pressure room communicating tube 100, the first negative pressure room 83 of the negative pressure room 82, the auxiliary filter 92, the second negative pressure room 84, and the suction-port communicating tube 45. Therefore, air pressure loss may be caused and the air flow rate may be reduced at the filter 55 fixed to the suction port 51. As a result, a capability of cleaning the filter 55 may be lowered and the service lifetime of the filter 55 may be short.

Further, as the powder feeding device of Patent Document 1, when a type of the suction pump 43 is a piston type, since air flow direction alternately changes, enough air flow to clean the filter 55 may be provided. However, on the other hand, in the piston-type pump, the piston moves back and forth by sliding along the inner surface of the container of the pump. Because of this feature, the service lifetime of the pump is generally short.

Further, when the suction pump 43 of Patent Document 1 is replaced by a diaphragm type or vane type pump, the service lifetime of the pump may be extended. However, the air flow direction is fixed to one direction. Therefore, it may not be possible to generate an air flow in the direction from the suction pump 43 to the suction port 51. Therefore, it may not be possible to supply enough air flow rate to clean the filter 55 from the suction pump 43. As a result, the service lifetime of the filter may be short.

Further, with an increasing demand for longer service lifetime of an image forming apparatus, as a method of providing the longer service lifetime of the powder feeding device in the image forming apparatus, one method is to extend the service lifetime of the suction pump so as to extend the service lifetime of the powder feeding device.

However, in the powder feeding device 35 of Patent Document 1, while the negative pressure room 82 has a negative pressure, the suction pump 43 is started from the stopping state of the suction pump 43 to suction air in the negative pressure room 82. Because of this feature, a higher torque (starting torque) may be necessary to start the suction pump 43. To that end, the suction pump may have to have a higher starting torque. As a result, the manufacturing cost of the pump may be increased or size of the pump may be increased and the manufacturing cost of the powder feeding device 35 including the larger pump may be increased. Further, in order to avoid a problem caused by the lower starting torque of the suction pump 43, it may be possible to continuously operate the suction pump 43. However, in this case, the operating time of the suction pump 43 is increased and as a result, the service lifetime of the suction pump 43 may become shorter.

The present invention is made in light of the above circumstance, and may provide a powder feeding device to be used in an image forming apparatus having a faster printing speed and being manufactured at a low cost, and an image forming apparatus including the powder feeding deice.

Figure 2:
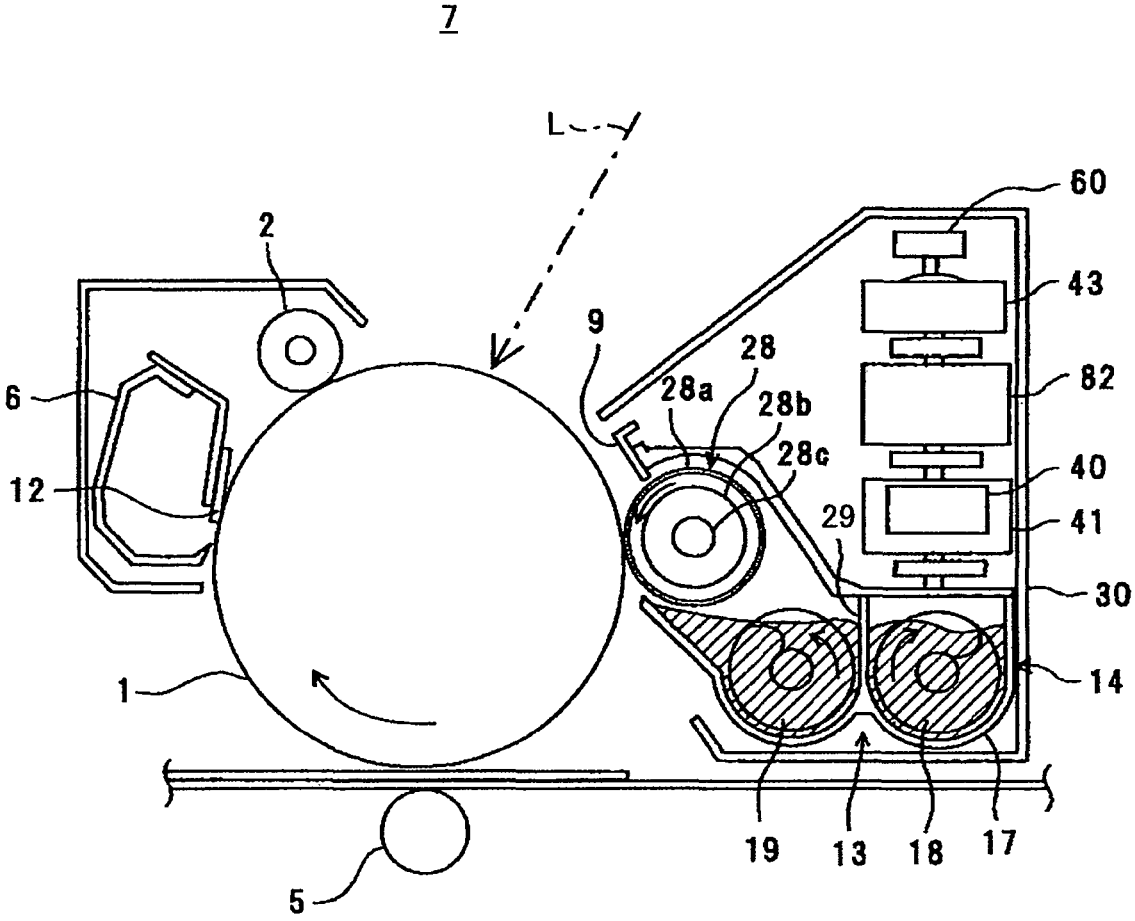
FIG. 2 is a schematic drawing illustrating an image forming part of the image forming apparatus according to the embodiment of the present invention.
Figure 3:
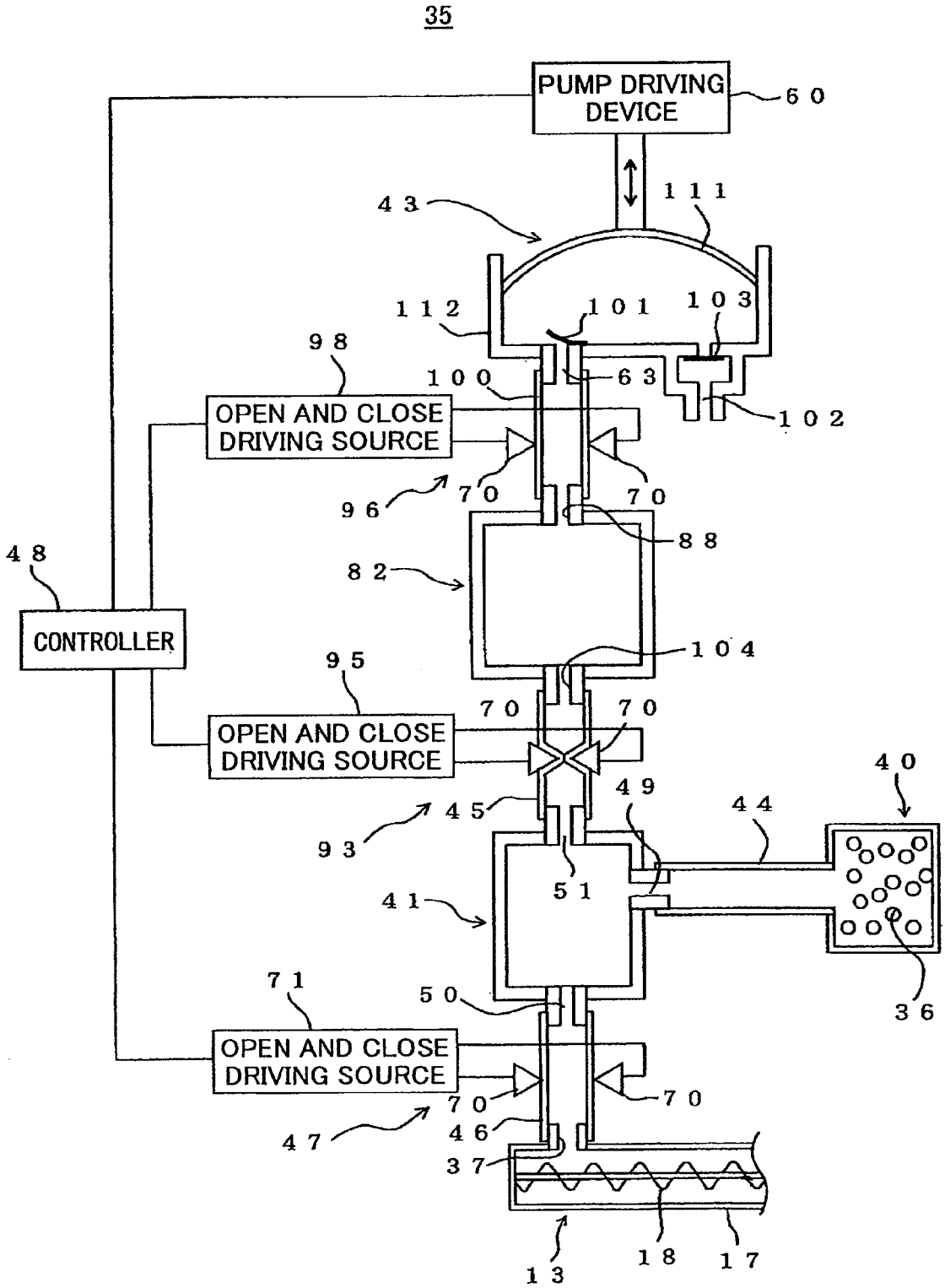
FIG. 3 is a drawing illustrating a configuration of a powder feeding device according to a first example of the present invention.
Figure 4:
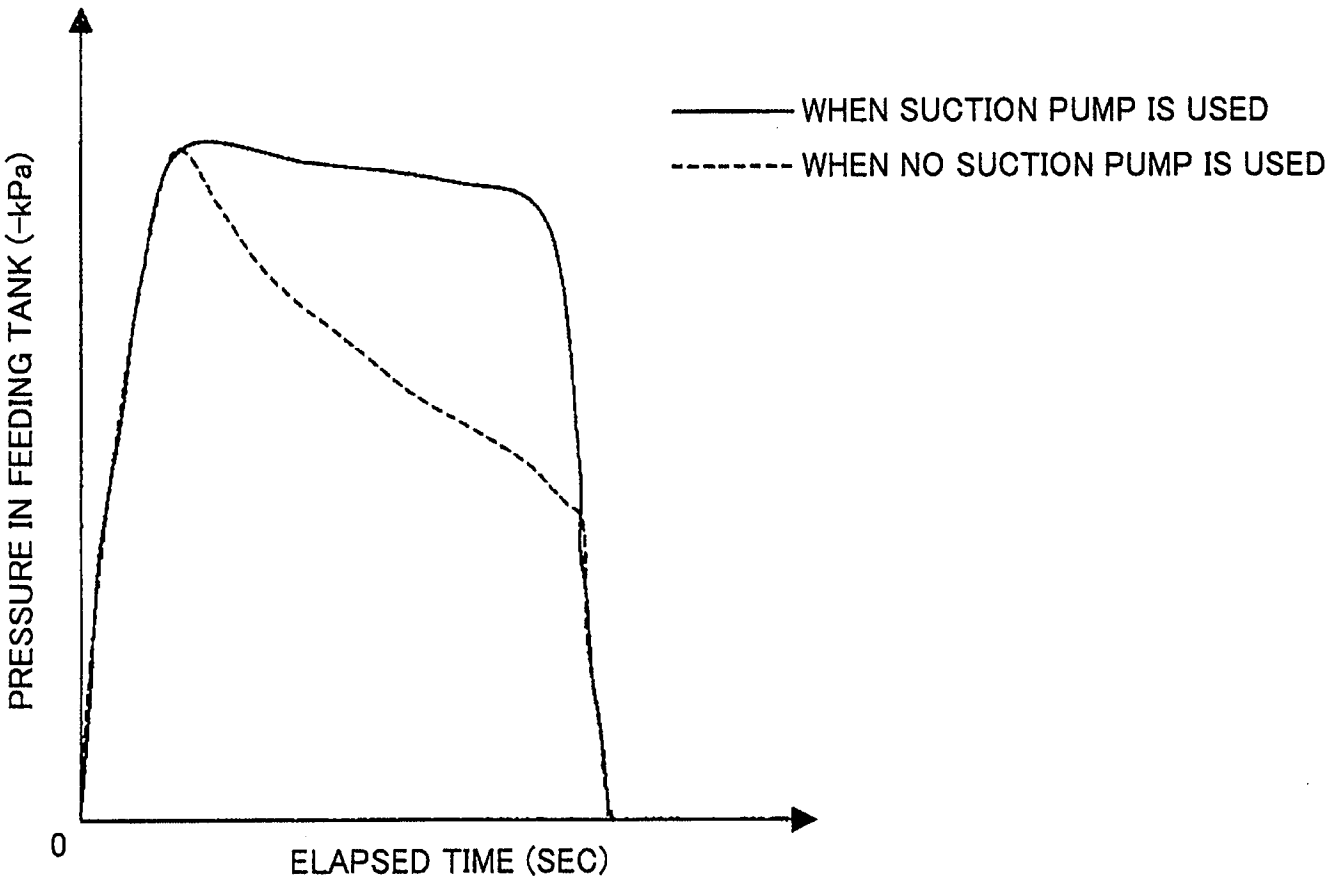
FIG. 4 is a graph illustrating changes over time of negative pressure values in a negative pressure room in different examples.
Figure 5A:
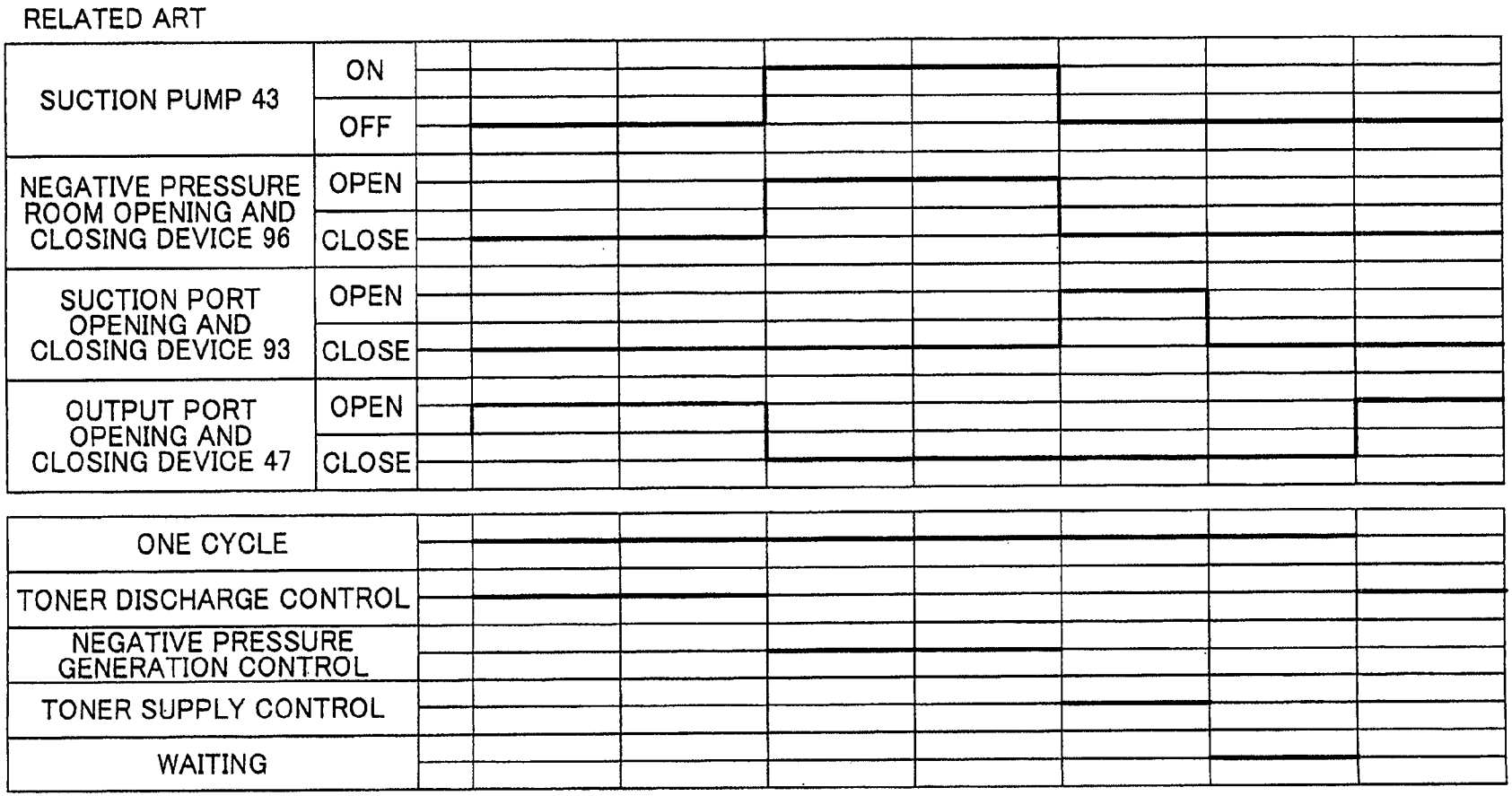
FIG.5A RELATED ART
FIG. 5A is a timing chart under conventional operation control.
Figure 5B:
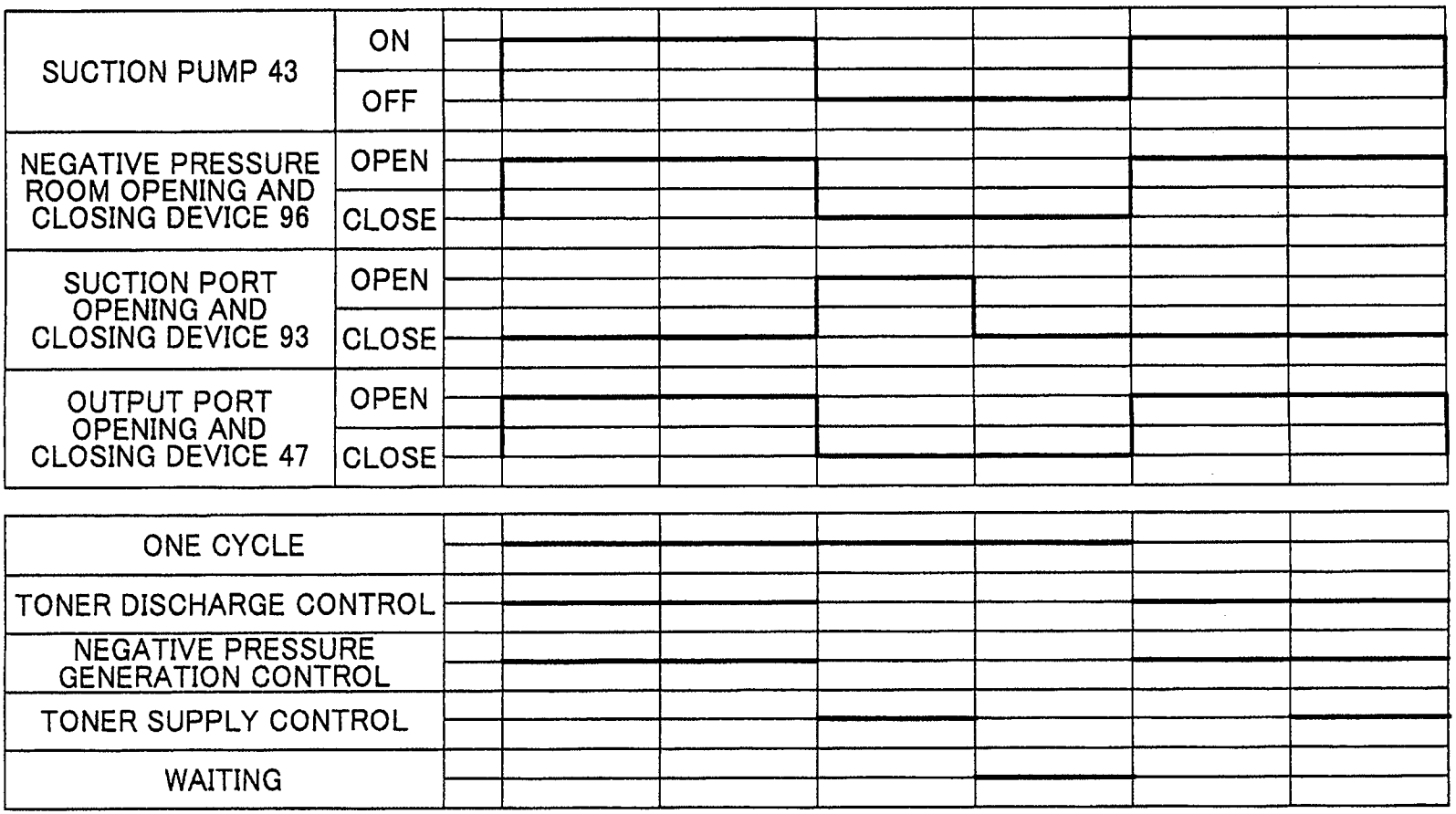
FIG. 5B is a timing chart when toner supply control and negative pressure generation control start at the same time.
Figure 6A:
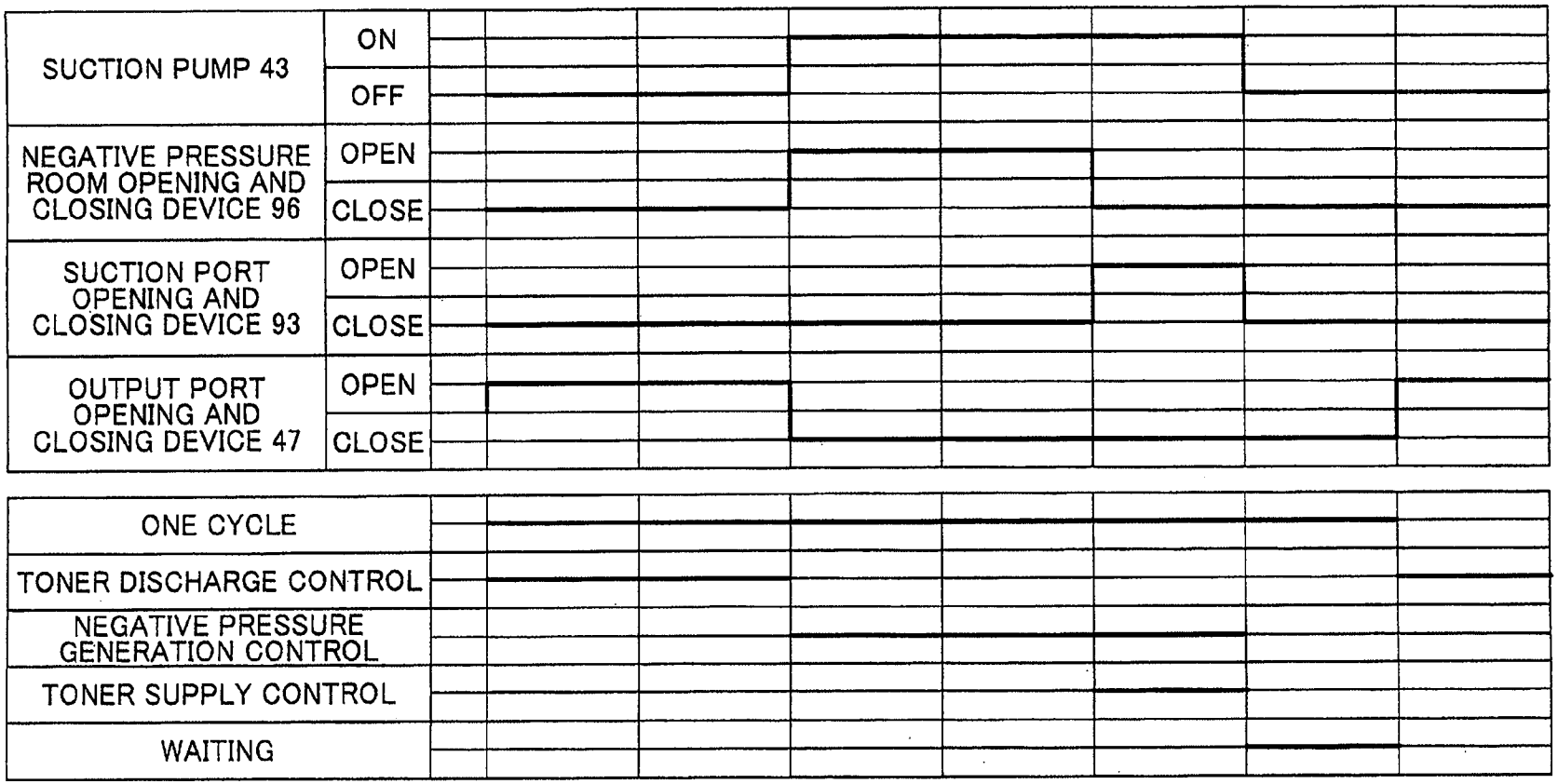
FIG. 6A is a timing chart when the toner supply control is performed when a suction force of a suction pump is also used to increase a negative pressure in the negative pressure room.
Figure 6B:
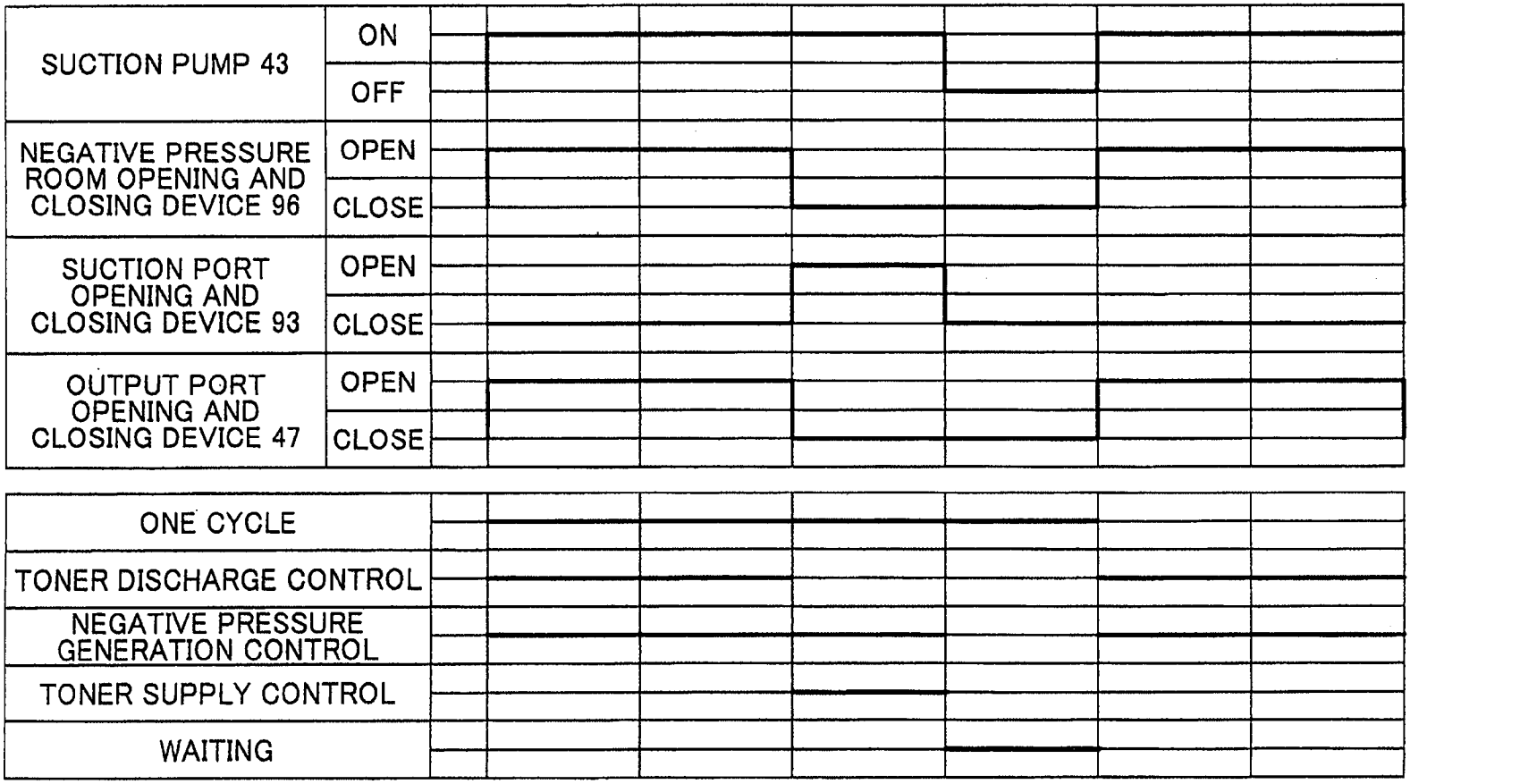
FIG. 6B is a timing chart when the toner supply control and the negative pressure generation control start at the same time and the suction force of the suction pump is also used to increase the negative pressure in the negative pressure room.
Figure 7:
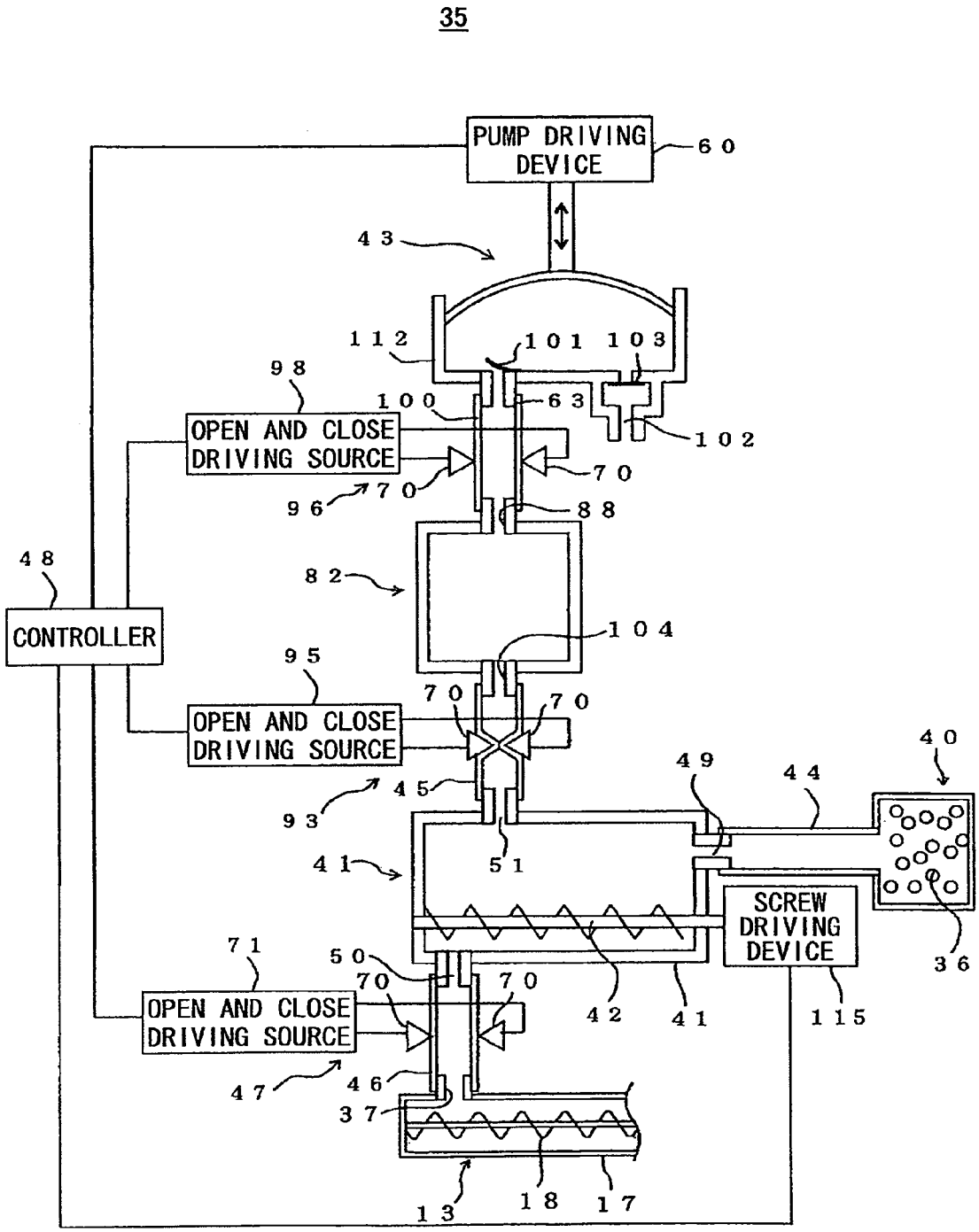
FIG. 7 is a drawing illustrating a configuration of a powder feeding device according to a second example of the present invention.
Figure 8:
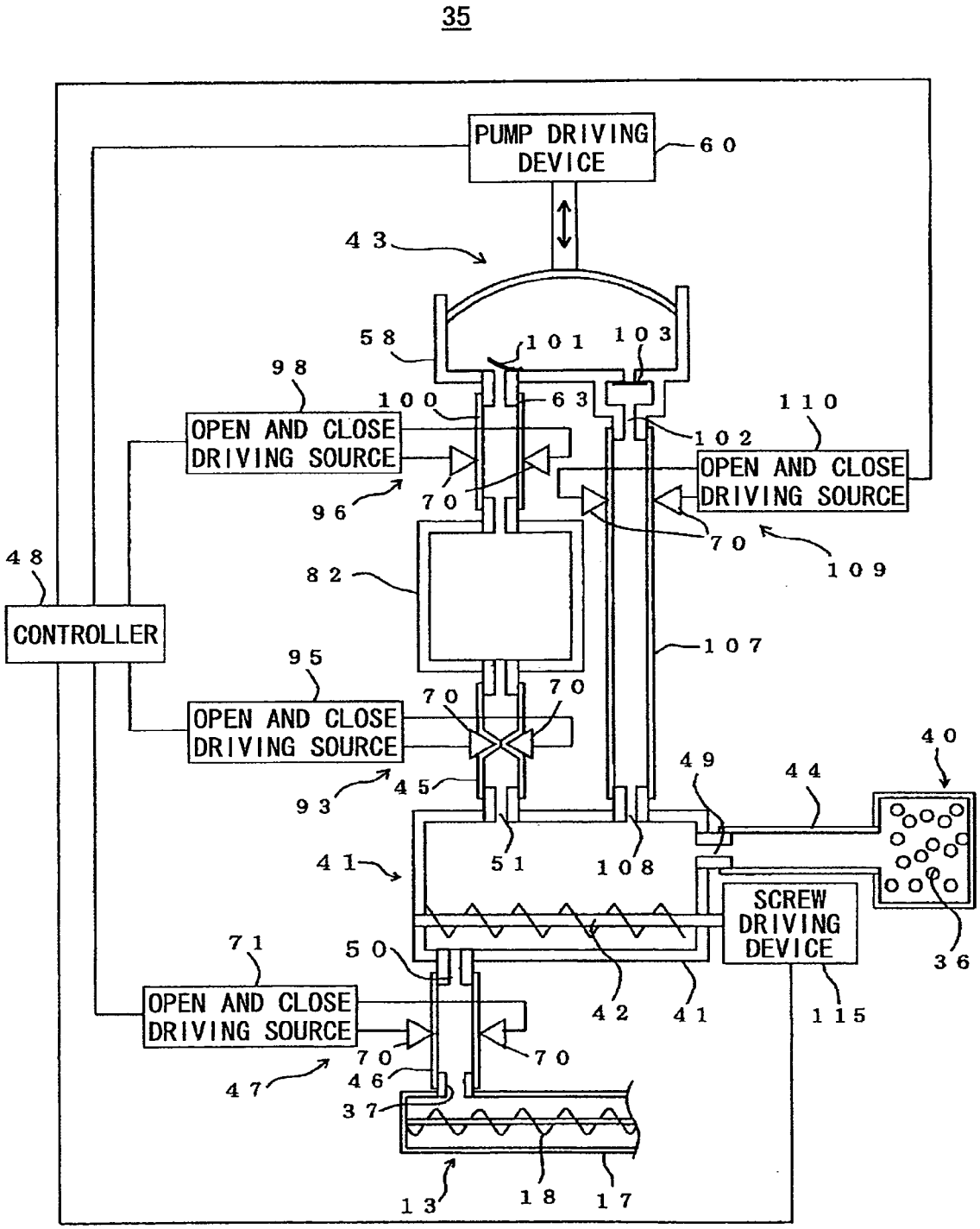
FIG. 8 is a drawing illustrating a configuration of a powder feeding device according to a third example of the present invention.
Figure 9:
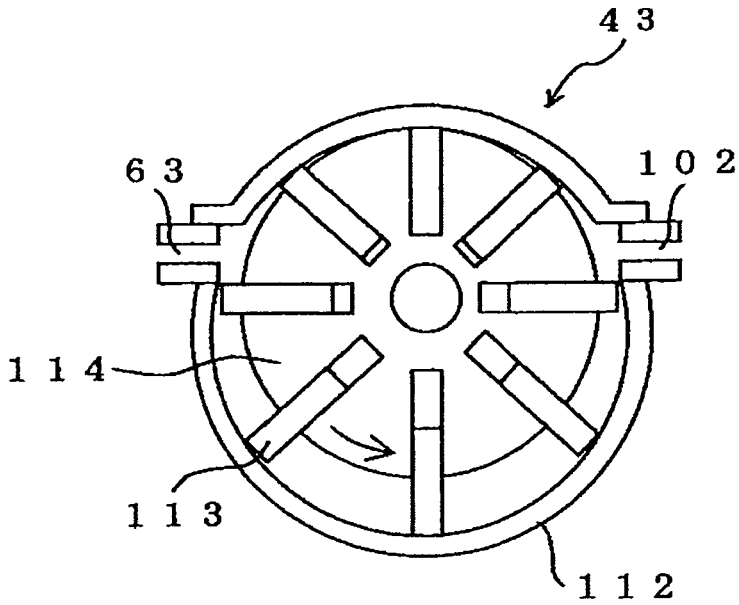
FIG. 9 is a drawing illustrating a configuration of a suction pump according to an example of the present invention.

In the following, an example of a tandem-type color mage forming apparatus (hereinafter simplified as an "image forming apparatus") including plural photosensitive bodies arranged in the lateral direction as an image forming apparatus including a powder feeding device according to an embodiment of the present invention is described with reference to various examples. FIG. 1 is a drawing illustrating an image forming apparatus according to an embodiment of the present invention. FIG. 2 is a schematic drawing illustrating an image forming part of the image forming apparatus according to the embodiment of the present invention. FIG. 3 is a drawing illustrating a configuration of a powder feeding device according to a first example of the present invention. FIG. 4 is a graph illustrating changes over time of negative pressure values in a negative pressure room in different examples. FIG. 5A is a timing chart under conventional operation control. FIG. 5B is a timing chart when toner supply control and negative pressure generation control start at the same time. FIG. 6A is a timing chart when the toner supply control is performed when a suction force of a suction pump is also used to increase a negative pressure in the negative pressure room. FIG. 6B is a timing chart when the toner supply control and the negative pressure generation control start at the same time when the suction force of the suction pump is also used to increase the negative pressure in the negative pressure room. FIG. 7 is a drawing illustrating a configuration of a powder feeding device according to a second example of the present invention. FIG. 8 is a drawing illustrating a configuration of a powder feeding device according to a third example of the present invention. FIG. 9 is a drawing illustrating a configuration of a suction pump according to a seventh example of the present invention.

As illustrated in FIG. 1, the image forming apparatus includes a feeding belt 15 feeding a transfer sheet 8 in a center part of the image forming apparatus. On the feeding belt 15, there are process cartridges 7K, 7M, 7Y, and 7C arranged in this order from the upstream side in the sheet feeding direction. The process cartridges 7K, 7M, 7Y, and 7C are four image forming parts (tandem image forming parts) forming black (K), magenta (M), yellow (Y), and cyan (C) colors, respectively, and faces the feeding belt 15. However, the arranging order of the colors (i.e. order of the process cartridges) is not limited to the arranging order described above. For example, the process cartridges 7K may be displaced at the downstream end, so that a color image is formed in the order of M, Y, C, and K.

The feeding belt 15 is an endless belt stretched between supporting rollers 26 and 27 which are a driving roller and a driven roller, respectively. The feeding belt 15 rotates and feeds in the counterclockwise direction by the rotation of the supporting rollers 26 and 27. Under the feeding belt 15, there are provided sheet feeding trays 20, 21, and 22 containing transfer sheets 8.

As image carriers, the process cartridges 7K, 7M, 7Y, and 7C include respective photosensitive bodies 1K, 1M, 1Y, and 1C, having a drum shape. Around the photosensitive bodies 1K, 1M, 1Y, and 1C, respective charging devices 2, developing devices 13, cleaning devices 6, powder feeding devices 35 are provided. Above the process cartridges 7K, 7M, 7Y, and 7C, respective exposing devices 16 are provided.

Further, four transfer devices 5K, 5M, 5Y, and 5C are provided on the side opposite to the process cartridges 7K, 7M, 7Y, and 7C, respectively, relative to the feeding belt 15. The transfer devices 5K, 5M, 5Y, and 5C receives respective transfer bias voltages from power sources (not shown) so that the transfer devices 5K, 5M, 5Y, and 5C transfer respective toner images formed on the photosensitive bodies 1K, 1M, 1Y, and 1C onto the transfer sheet 8 fed on the feeding belt 15. Further, on the left-hand side of the feeding belt 15, a fixing device 24 to fix the toner image transferred onto the transfer sheet 8 is provided.

In this image forming apparatus, in order to form an image, a transfer sheet 8 on the top of the transfer sheets 8 stacked in the sheet feeding tray 20 or the like is fed and temporarily stopped by a resist roller 23. Then, the transfer sheet 8 is fed at a timing synchronized with the timing of forming an image in the process cartridges 7K, 7M, 7Y, and 7C, and is attracted to the feeding belt 15 by means of electrostatic attraction. The transfer sheet 8 held on the feeding belt 15 is fed to the first process cartridge 7K, so that black toner image formed on the photosensitive body 1K is transferred onto the transfer sheet 8 by the transfer device 5K. Then, the transfer sheet 8 held on the feeding belt 15 is further fed to the second process cartridge 7M, so that magenta toner image formed on the photosensitive body 1M is further transferred onto the transfer sheet 8 so as to superimpose the magenta toner image onto the black toner image by the transfer device 5M. Next, the transfer sheet 8 held on the feeding belt 15 is further fed to the third process cartridge 7Y, so that yellow toner image formed on the photosensitive body 1Y is further transferred onto the transfer sheet 8 so as to superimpose the yellow toner image onto the black and magenta toner images by the transfer device 5Y. In the same manner, in the fourth process cartridge 7C, a cyan toner image is transferred and superimposed, so that four color superimposed toner image which is a full-color superimposed image is formed. After passing through the process cartridge 7C, the transfer sheet 8 on which the four color super imposed image is separated from the feeding belt 15 and fed into the fixing device 24. In the fixing device 24, while the transfer sheet 8 is fed between a pair of fixing rollers, the full-color superimposed image is fixed onto the transfer sheet 8. Then, the transfer sheet 8 is discharged to a discharge tray 25.

Next, the process cartridges 7K, 7M, 7Y, and 7C are described. However, those process cartridges 7K, 7M, 7Y, and 7C are the same as each other except that the colors of the toner are different from each other. Therefore, in the following, the "process cartridge 7" without a suffix is used as the representation of the process cartridges 7K, 7M, 7Y, and 7C. In the same manner, for example, the photosensitive body 1 without a suffix is collectively used as the representation of the photosensitive bodies 1K, 1M, 1Y, and 1C.

FIG. 2 schematically illustrates a configuration of the process cartridge 7. As illustrated in FIG. 2, the process cartridge 7 includes the photosensitive body 1. Around the photosensitive body 1, the process cartridge 7 further includes the charging device 2, the developing device 13, the cleaning device 6, the powder feeding device 35 and the like. The process cartridge 7 in this embodiment is detachably provided in the main body of the image forming apparatus.

The photosensitive body 1 is not far different from the photosensitive body generally used in the image forming apparatus employing the electrophotographic method. Namely, after the surface of the photosensitive body 1 is uniformly charged by the charging device 2, the surface of the photosensitive body 1 is exposed by writing exposure light from the exposing devices 16. As a result, an electrostatic latent image is formed on the surface of the photosensitive body 1. Further, in FIG. 2, a case is described where the charging device 2 is a rotational body that rotates at the same rotational speed as that of the photosensitive body 1. However, a corona-discharge-type charging device 2 may alternatively used.

The developing device 13 generally includes a developing container 14, mixing screws 18, 19 that mix and feed developer 30 in the developing container 14, a developing roller 28, and a developer layer thickness control member 9 that controls (adjusts) an amount (thickness) of developer 30 carried on the developing roller 28.

The developing container 14 includes a part where an opening is formed. A part of the developing roller 28 is exposed through the opening, so that the part of the developing roller 28 closely faces the photosensitive body 1 and a development area A is formed where toner 36 is supplied to the electrostatic latent image formed on the surface of the photosensitive body 1 to develop the electrostatic latent image. Further, the mixing screw 19 closer to the developing roller 28 and the mixing screw 18 farther from the developing roller 28 are separated across a separation wall 29 formed in the developing container 14. A developer container is divided by the separation wall 29. An opening are formed on each part close to both ends of each feeding member of the separation wall 29. The mixed and fed developer 30 is fed from the downstream side in the developer feeding direction of the mixing screw 19 closer to the developing roller 28 to the upstream side in the developer feeding direction of the mixing screw 18 farther from the developing roller 28. Further, the mixed and fed developer 30 is fed from the downstream side in the developer feeding direction of the mixing screw 18 farther from the developing roller 28 to the upstream side in the developer feeding direction of the mixing screw 19 closer to the developing roller 28. Further, a supply hole 37 (not shown in FIG. 2) is formed on the upstream side in the developer feeding direction of the developer container where the mixing screw 18 farther from the developing roller 28 is formed. Through the supply hole 37, toner 36 supplied from the powder feeding device described in detail below is fed into the developer container 14.

The developing roller 28 includes a developing sleeve 28*a* and a magnet roller 28*b*. The magnet roller 28*b* is provided inside the developing sleeve 28*a*. The magnet roller 28*b* includes plural magnets MG arranged in the circumferential direction of the magnet roller 28*b*. Further, the developing sleeve 28*a* has a tube shape and surrounds the magnet roller 28*b*, so that the developing sleeve 28*a* integrally rotates with the rotary shaft 28*c*. Further, the developing sleeve 28*a* is made of a nonmagnetic metal such as aluminum. The magnet roller 28*b* is fixed to a non-movable member such as the developing container 14 so that the plural magnets MG are arranged in respective predetermined directions and the developing sleeve 28*a* rotates around the plural magnets MG. By doing this, the developer 30 attracted by the magnet MG is fed by the rotation of the developing sleeve 28*a*. Further, by the developer layer thickness control member 9 provided on the upstream side of the opening of the developing container 14 in the feeding direction of the developer 30, an amount of the developer 30 to be fed is controlled. By doing this, the developer 30 carried on the surface of the developing roller 28 is fed to the development area A. Further, a development bias voltage is applied from a power source (not shown) to the developing sleeve 28*a*, so that a development potential is formed which is a voltage difference between the electrostatic latent image on the photosensitive body 1 and the developing roller 28. Due to the development potential, the toner 36 of the developer 30 on the developing roller 28 is transferred onto the electrostatic latent image on the photosensitive body 1, so that the electrostatic latent image is developed and the corresponding toner image is formed.

In the developing device 13 having the structure described above, the mixing screw 19 closer to the developing roller 28 supplies the developer 30 to be mixed and fed to the developing roller 28. Further, the mixing screw 19 collects the developer 30 that has not been used in the development of the electrostatic latent image. The collected developer 30 is mixed and fed by being circulated through each of the developer container where the mixing screw 19 closer to the developing roller 28 is provided and the developer container where the mixing screw 18 farther from the developing roller 28 is provided. The developer 30 that has once passed through the development area A where the photosensitive body 1 faces the developing roller 28 is appropriately mixed with the toner 36 while being mixed and fed, the toner having been supplied at a position on the upstream side in the developer feeding direction in the developer container which is farther from the developing roller 28. The developer 30 including the supplied toner 36 is further mixed and fed in the developer containers by the mixing screws 18, 19. By doing this, it becomes possible to supply the developer to the development area A, the developer including the toner 36 having a necessary charge amount. Therefore, it is possible to provide an image having a stable image density.

After that, the toner image formed on the photosensitive body 1 is fed to a transfer area B where the photosensitive body 1 faces the transfer device 5, so that transfer device 5 transfers the toner image onto the transfer sheet 8 fed by the feeding belt 15. Further, FIG. 2 illustrates an example where the transfer device 5 is a rotational body. However, the transfer device 5 is not limited to a rotational body. For example, a corona-discharge-type transfer device may alternatively be used. After the toner image is transferred, the photosensitive body 1 is cleaned by the cleaning device 6. Specifically, the toner that has not been transferred onto the transfer sheet 8 and that remains on the surface of the photosensitive body 1 is removed (wiped off) by the cleaning device 6. After that, the photosensitive body 1 becomes ready for the next image forming process.

Further, the present invention may also be applied to, for example, an image forming apparatus employing the intermediate transfer belt method in which a toner image on the photosensitive body 1 is transferred onto an intermediate transfer body (e.g. an intermediate transfer belt) first, and then a multi-color toner image is collectively transferred onto the transfer sheet. In this case, the transfer area B is where the toner on the photosensitive body 1 is transferred onto the intermediate transfer body (e.g., an intermediate transfer belt).

In the following, various examples of the powder feeding device 35 according to an embodiment of the present invention are described with reference to the respective accompanying drawings.

EXAMPLE 1

An example 1 of the powder feeding device 35 in an image forming apparatus according to an embodiment of the present invention is described with reference to FIG. 3. As illustrated in FIG. 3, the powder feeding device 35 of this example 1 includes a toner container 40 as a powder container, a feeding tank 41, a suction pump 43 as a gas suctioning device, a negative pressure room 82, a plumbing 44, a suction-port communicating tube 45, a negative pressure room communicating tube 100, a discharge tube 46, an output port opening and closing device 47, a suction-port opening and closing device 93, a negative pressure room opening and closing device 96, and a controller 48. The controller 48 collectively controls the operations of the powder feeding device 35.

First, an exemplary configuration of the powder feeding device 35 according to this embodiment of the present invention is described. Herein, elements (devices) except for the controller 48 of the powder feeding device 35 are arranged from the upper to lower ends in the vertical direction and sequentially connected as described below. The suction pump 43 is in communication with the negative pressure room 82 via the negative pressure room communicating tube 100. The negative pressure room 82 is in communication with the feeding tank 41 via the suction-port communicating tube 45. A side surface of the feeding tank 41 is in communication with the toner container 40 via the plumbing 44. Further, the feeding tank 41 is in communication with a container tank 17 of the developing device 13 via the discharge tube 46. In the following, the configurations of the elements (devices) are described in the order of the arrangement.

The suction pump 43 is a diaphragm pump (diaphragm type pump) and includes a pump container 112, a diaphragm 111, and a pump driving device 60. The pump container 112 includes a bottom part where a pump suction port 63 and a pump discharge port 102 are formed. Further, a suction side valve 101 and a discharge side valve 103 are provided so as to open and close the pump suction port 63 and the pump discharge port 102, respectively. More specifically, the suction side valve 101 is provided on the pump suction port 63 in a manner that one end side of the suction side valve 101 is fixed to the pump container 112 and the suction side valve 101 covers the upper part of the pump suction port 63 of the pump container 112. By having this structure, only when air (gas) (hereinafter may be only referred to as "air") flows into the pump container 112, the other end side of the suction side valve 101 is deformed upward to open the suction side valve 101 (i.e., the pump suction port 63). On the other hand, the discharge side valve 103 is provided inside a widening part that is inside the pump discharge port 102 and that is formed under the bottom part of the pump container 112. Further, the discharge side valve 103 is provided on the pump discharge port 102 in a manner that one end side of the discharge side valve 103 is fixed to the pump container 112 and the discharge side valve 103 covers an upper hole of the pump discharge port 102 of the pump container 112 from underneath. Further, only when air flows from the pump container 112, the other end side of the discharge side valve 103 is deformed downward to open the discharge side valve 103 (i.e., pump discharge port 102). Under the control of the controller 48, the suction pump 43 is driven to suction air through the pump suction port 63 and discharge air through the pump discharge port 102 by causing the diaphragm 111 to perform a back-and-forth movement by the pump driving device 60. Herein, it is assumed that the maximum flow rate and the maximum vacuum degree of the suction pump 43 is 1 to 8 liters/min and −20 to −80 kPa, respectively. Further, the diaphragm pump is generally used in various applications and includes a limited number of parts only as described above. Therefore, the purchasing cost is low and manufacturing cost would also be low.

The negative pressure room communicating tube 100 is made of an elastic member such as rubber and is formed in a tube shape. One end of the negative pressure room communicating tube 100 is fixed to the wall around the pump suction port 63 formed on the bottom part of the suction pump 43. The other end of the negative pressure room communicating tube 100 is fixed to the wall around a through hole 88 formed on the upper part of the negative pressure room 82. By fixing in this way, the negative pressure room communicating tube 100 provides communication between the suction pump 43 and the negative pressure room 82. The negative pressure room communicating tube 100 is equipped with the negative pressure room opening and closing device 96 which opens and closes the inside of the negative pressure room communicating tube 100 as a negative pressure room opening and closing unit.

The negative pressure room opening and closing device 96 includes a pair of clamping members 70 provided in a manner that the clamping members 70 can approach and separate from each other, and an open and close driving source 98 as an opening and closing unit. The pair of clamping members 70 are disposed (provided) in a manner that the middle of the negative pressure room communicating tube 100 is sandwiched by the pair of clamping members 70. The negative pressure room opening and closing device 96 (open and close driving source 98) causes the pair of clamping members 70 to approach and separate from each other. When the pair of clamping members 70 approach each other, the pair of clamping members 70 squeeze (clampingly engage) the negative pressure room communicating tube 100 between the pair of clamping members 70 so as to close the inside (block the air flow) of the negative pressure room communicating tube 100. On the other hand, when the pair of clamping members 70 are separated from each other, the pair of clamping members 70 opens the inside of the negative pressure room communicating tube 100 (to provide the communication between the suction pump 43 and the negative pressure room 82). By doing this, the open and close driving source 98 opens and closes the inside of the negative pressure room communicating tube 100 (to block and provide communication between the suction pump 43 and the negative pressure room 82). Further, the suction-port opening and closing device 93 and the output port opening and closing device 47 have the same configuration as that of the above-described negative pressure room opening and closing device 96. Therefore, the open and close driving source 95 of the suction-port opening and closing device 93 opens and closes the inside of the suction-port communicating tube 45. The open and close driving source 71 of the output port opening and closing device 47 opens and closes the inside of the discharge tube 46. Further, the controller 48 controls the opening and closing operations of those opening and closing units (i.e., the negative pressure room opening and closing device 96, the suction-port opening and closing device 93, and the output port opening and closing device 47).

The negative pressure room 82 has the upper part where the through hole 88 is formed. Through the through hole 88 and the negative pressure room communicating tube 100, the negative pressure room 82 is in communication with the suction pump 43. On the other hand, the negative pressure room 82 has the bottom part where a through hole 104 is formed. Through the through hole 104 and the suction-port communicating tube 45, the negative pressure room 82 is in communication with the feeding tank 41. The capacity of the negative pressure room 82 is 20 to 300 cc. When the suction pump 43 is driven and then the negative pressure room communicating tube 100 and the suction-port communicating tube 45 are closed by the respective opening and closing units, a negative pressure is generated in the negative pressure room 82. The negative pressure room 82 is provided so as to hold the generated negative pressure in the negative pressure room 82 until the negative pressure room communicating tube 100 or the suction-port communicating tube 45 is open.

The suction-port communicating tube 45 is made of an elastic member such as rubber and is formed in a tube shape. One end of the suction-port communicating tube 45 is fixed to the wall around the through hole 104 formed on the bottom part of the negative pressure room 82. The other end of the suction-port communicating tube 45 is fixed to the wall around the suction port 51 formed on the upper part of the feeding tank 41. By fixing in this way, the suction-port communicating tube 45 provides communication between the negative pressure room 82 and the feeding tank 41. The suction-port communicating tube 45 is equipped with the suction-port opening and closing device 93 which opens and closes the inside of the suction-port communicating tube 45 as a suction-port opening and closing unit. As described above, the suction-port opening and closing device 93 has the same configuration as that of the negative pressure room opening and closing device 96. The controller 48 controls the opening and closing operations of the suction-port opening and closing device 93.

The feeding tank 41 has the upper part where the suction port 51 is formed. Through the suction port 51 and the suction-port communicating tube 45, the feeding tank 41 is in communication with the negative pressure room 82. Further, the feeding tank 41 has a side part where the input port 49 is formed. Through the input port 49 and the plumbing 44, the feeding tank 41 is in communication with the toner container 40. Further, the feeding tank 41 has the bottom part where the output port 50 is formed. Through the output port 50 and the discharge tube 46, the feeding tank 41 is in communication with the container tank 17 of the developing device 13. A negative pressure in the feeding tank 41 is generated based on a pressure difference between the inside of the feeding tank 41 and the inside of the negative pressure room 82. By using the negative pressure generated in the feeding tank 41, the toner 36 contained in the toner container 40 is suctioned into the feeding tank 41. Then, the feeding tank 41 supplies the toner 36 to the container tank 17 of the developing device 13 through the output port 50 of the feeding tank 41.

The plumbing 44 is made of an elastic member such as rubber and is formed in a tube shape, so as to provide (form) a feed path through which toner 36 flows. One end of the plumbing 44 is fixed to the wall around the input port 49 formed on the side part of the feeding tank 41. The other end of the plumbing 44 is integrally formed with the toner container 40.

The toner container 40 has an internal space which is sealed from the outside air. The internal space of the toner container 40 (hereinafter simplified as toner container 40) contains toner 36. The toner container 40 is in communication with the feeding tank 41 via the plumbing 44 and the input port 49. The toner 36 in the toner container 40 is supplied to the feeding tank 41 by being suctioned along with air in the toner container 40 by using a pressure difference between the negative pressure in the negative pressure room 82 and the pressure in the feeding tank 41. Then, the toner 36 suctioned into the feeding tank 41 is discharged to the container tank 17 of the developing device 13 through the output port 50 of the feeding tank 41.

The discharge tube 46 is made of an elastic member such as rubber and is formed in a tube shape. One end of the discharge tube 46 is fixed to the wall around the output port 50 formed on the bottom part of the feeding tank 41. The other end of the discharge tube 46 is fixed to the wall around the supply hole 37 formed on the upper part of the container tank 17 of the developing device 13. By fixing in this way, the discharge tube 46 provides communication between the feeding tank 41 and the container tank 17 of the developing device 13. The discharge tube 46 is equipped with the output port opening and closing device 47 which opens and closes the inside of the discharge tube 46 as an output port opening and closing unit. As described above, the output port opening and closing device 47 has the same configuration as that of the negative pressure room opening and closing device 96. The controller 48 controls the opening and closing operations of the output port opening and closing device 47.

Herein, there are two container tanks that are in the developing device 13 and that mix and feed the developer. The container tank 17 of the developing device 13 is one of the two container tanks and has the upper part where the supply hole 37 is formed. The supply hole 37 is provided so that the toner is supplied from the feeding tank 41 to the container tank 17 of the developing device 13 through the supply hole 37 and the discharge tube 46. In the container tank 17 of the developing device 13, the mixing screw 18 is provided.

The controller 48 is a computer including a RAM (Random Access Memory), a ROM (Read Only Memory), a CPU (Central Processing Unit) and the like. The controller 48 is electrically connected to the pump driving device 60 of the suction pump 43, the open and close driving source 98 of the negative pressure room opening and closing device 96, the open and close driving source 95 of the suction-port opening and closing device 93, and the open and close driving source 71 of the output port opening and closing device 47. Further, the controller 48 communicates with a controller (not shown) of the image forming apparatus including the powder feeding device according to an embodiment of the present invention, so that a control signal and the like can be mutually transmitted between the controller 48 and the controller of the image forming apparatus. For example, based on a toner supply signal that is transmitted from the controller of the image forming apparatus and that instructs the supply of the toner 36 to the developing device 13 and based on the detection results by the sensors, the controller 48 controls the operations of the powder feeding device 35 by collectively controlling the elements (devices) of the powder feeding device 35. Further, in this embodiment, a case is described where the controller 48 is included in the powder feeding device 35. However, the present invention is not limited to this configuration. For example, the controller 48 may be integrated (included) in the controller of the image forming apparatus including the powder feeding device 35. Further, the controller 48 may be disposed at any position as long as, for example, the controller 48 can be easily mounted and maintained and the environmental conditions including temperature condition are suitable (satisfied).

Next, the operations of the powder feeding device 35 according to this example of the present invention are described by referring to the controls performed by the controller 48. The control operations performed by the controller 48 includes three control operations, which are negative pressure generating control, toner supply control, and toner discharge control. The negative pressure generating control refers to a control of generating a negative pressure in the negative pressure room 82. The toner supply control refers to a control of supplying toner 36 from the toner container 40 to the feeding tank 41. The toner discharge control refers to a control of discharging the toner 36 from the feeding tank 41 to the container tank 17 of the developing device 13. In the powder feeding device 35, a series of those operations is repeatedly performed. Further, in actual operating control, when the control is to be changed from one to another, there may be a case where waiting (wait control) is performed between two controls. In the following descriptions, it is assumed that toner 36 has been already supplied into the feeding tank 41 and that the toner supply signal instructing the supply of the toner 36 to the developing device 13 is already issued (received by the controller 48). Namely, the following controls are based on the above assumptions.

Toner Discharge Control

In the toner discharge control, in order to discharge the toner 36 from the feeding tank 41 to the container tank 17 of the developing device 13 in the powder feeding device 35, the controller 48 performs the following control. The controller 48 causes the output port opening and closing device 47 to open the inside of the discharge tube 46 to discharge (supply) the toner 36 from the output port 50 of the feeding tank 41 to the container tank 17 of the developing device 13 through the opened discharge tube 46. When determining that the toner 36 supplied from the toner container 40 into the feeding tank 41 is fully discharged from the output port 50 or that a toner density in the developing device 13 reaches a predetermined value (density), the controller 48 causes the output port opening and closing device 47 to close the inside of the discharge tube 46 and changes (transitions) the control to the negative pressure generating control.

Further, in the above described example of the toner discharge control, the toner discharge control is not simultaneously performed with any other control. However, the present invention is not limited to this configuration. For example, the toner discharge control may alternatively performed as described below.

In another example of the toner discharge control, unlike the above described example of the toner discharge control, when the controller 48 starts toner discharge control, the controller 48 simultaneously starts the negative pressure generating control described in detail below. Specifically, to that end, the controller 48 causes the output port opening and closing device 47 to open the inside of the discharge tube 46, causes the suction-port opening and closing device 93 to close the inside of the suction-port communicating tube 45, and causes the negative pressure room opening and closing device 96 to open the inside of the negative pressure room communicating tube 100.

Under this state, the controller 48 drives the suction pump 43. As described above, by performing (starting) the toner discharge control and the negative pressure generating control at the same time, it may become possible to shorten a time period for performing a series of controls. Herein, the term "a time period for performing a series of controls" refers to a time period corresponding to a feeding of the toner 36 in the powder feeding device 35 based on a series of relevant operation control. By shortening the time period for performing a series of controls as described above, it may become possible to increase a supply amount of toner 36 to the developing device 13 per unit time without adding any additional parts and without increasing cost. Further, in this another example, when the toner discharge control or the negative pressure generating control is finished, the toner supply control is performed (started).

Negative Pressure Generating Control

In the negative pressure generating control, in order to generate a predetermined negative pressure state in the negative pressure room 82 in the powder feeding device 35, the controller 48 performs the following control. The controller 48 causes the suction-port opening and closing device 93 to close the inside of the suction-port communicating tube 45 and causes the negative pressure room opening and closing device 96 to open the inside of the negative pressure room communicating tube 100. Under this state, the controller 48 drives the suction pump 43. By driving the suction pump 43, air in the negative pressure room 82 is suctioned to generate a negative pressure in the negative pressure room 82. When the negative pressure state in the negative pressure room 82 becomes a predetermined negative pressure state, for example, when the pressure in the negative pressure room 82 becomes in a range from −20 kPa to −60 kPa, the controller 48 stops driving the suction pump 43 and causes the negative pressure room opening and closing device 96 to close the inside of the negative pressure room communicating tube 100. Then, the toner supply control is performed (started).

However, the above described negative pressure generating control may not be necessarily performed in a case where the toner supply control to be performed after the negative pressure generating control corresponds to an another example of the toner supply control described below. This is because in the another example of toner supply control, by the toner discharge control, while the inside of the discharge tube 46 is closed by the output port opening and closing device 47, both the inside of the suction-port communicating tube 45 and the inside of the negative pressure room communicating tube 100 are open and the suction pump 43 is driven. Therefore, while the inside of the discharge tube 46 is closed by the toner discharge control, it is preferable to go into the toner supply control (of the another example) by continuously driving the suction pump 43 without closing the inside of the suction-port communicating tube 45 when the negative pressure in the negative pressure room 82 becomes a predetermined negative pressure state. Further, whether the negative pressure state in the negative pressure room 82 becomes a predetermined negative pressure state may be determined by measuring the pressure in the negative pressure room 82 or by previously obtaining a time period necessary for becoming the predetermined negative pressure state and determining whether the obtained time period has been elapsed.

As described above, a negative pressure in the negative pressure room 82 is generated while the inside of the suction-port communicating tube 45 is closed. Therefore, air only in the negative pressure room 82 is suctioned without suctioning the toner 36. As a result, it may become possible to increase the negative pressure in the negative pressure room 82 in a shorter time period.

In the above example of the negative pressure generating control, the negative pressure generating control is not performed along with any other control. However, the present invention is not limited to this configuration where the negative pressure generating control is not performed along with any other control. Namely, for example, as the another example of the toner discharge control, the negative pressure generating control and the toner discharge control may be started at the same time.

In another example of the negative pressure generating control, unlike the above described example of the negative pressure generating control, when the controller 48 starts the negative pressure generating control, the controller 48 simultaneously starts the toner discharge control. In other words, when the controller 48 starts the toner discharge control to discharge the toner 36 from the output port 50 of the feeding tank 41 to the container tank 17 of the developing device 13, the toner 36 having been supplied from the toner container 40 into the feeding tank 41, the controller 48 simultaneously starts the negative pressure generating control. Specifically, to that end, the controller 48 causes the output port opening and closing device 47 to close the inside of the discharge tube 46, causes the suction-port opening and closing device 93 to open the inside of the suction-port communicating tube 45, and causes the negative pressure room opening and closing device 96 to open the inside of the negative pressure room communicating tube 100.

Further, when the pressure in the negative pressure room 82 becomes a predetermined negative pressure state for example in a range from −20 kPa to −60 kPa, the controller 48 stops driving the suction pump 43 and causes the negative pressure room opening and closing device 96 to close the inside of the negative pressure room communicating tube 100. Further, in the toner discharge control, when the toner 36 supplied from the toner container 40 into the feeding tank 41 is fully discharged from the output port 50 or when a toner density in the developing device 13 reaches a predetermined value, the controller 48 causes the output port opening and closing device 47 to close the inside of the discharge tube 46. In this another example when both of the toner discharge control and the negative pressure generating control are finished, the controller 48 starts the toner supply control.

As described above, by simultaneously starting the toner discharge control and the negative pressure generating control, not only the operations and effects of the negative pressure generating control described above but also the operations and effects of the another example of the toner discharge control described above may be obtained.

Further, in the in the negative pressure generating control described above or the another example of the negative pressure generating control described above, the inside of the suction-port communicating tube 45 and the inside of the communicating tube 100 are basically closed until the inside of the discharge tube 46 is closed by the output port opening and closing device 47 by the toner discharge control. By holding the state where the inside of the suction-port communicating tube 45 and the inside of the communicating tube 100 are closed, it becomes possible to prevent the air flow to and from the negative pressure room 82 and hold the negative pressure state until the controller 48 starts the toner supply control described below.

However, after the pressure in the negative pressure room 82 becomes the predetermined negative pressure state, it is not always necessary to hold the state where the inside of the suction-port communicating tube 45 and the inside of the communicating tube 100 are closed after the until the inside of the discharge tube 46 is closed by the output port opening and closing device 47. Namely, it does not matter whichever comes first, the timing when the inside of the discharge tube 46 is closed by the output port opening and closing device 47 in the toner discharge control or the timing when the inside of the communicating tube 100 is closed by the negative pressure room opening and closing device 96 in the negative pressure generating control. For example, a case may be assumed where even when the toner 36 has been sufficiently discharged through the output port 50, the negative pressure state in the negative pressure room 82 does not become the predetermined negative pressure state.

Toner Supply Control

In the toner supply control, in order to supply the toner 36 from the toner container 40 into the feeding tank 41, the controller 48 performs the following control. While causing the output port opening and closing device 47 to close the inside of the discharge tube 46, the controller 48 causes the suction-port opening and closing device 93 to open the inside of the suction-port communicating tube 45. Then, when determining that a predetermined amount of toner 36 is supplied into the feeding tank 41, the controller 48 causes the suction-port opening and closing device 93 to close the inside of the suction-port communicating tube 45. In this case, whether the predetermined amount of toner 36 is supplied into the feeding tank 41 may be determined by detecting the toner amount, or by a predetermined time period having elapsed, the predetermined time period having been determined by an experiment or the like. Otherwise, whether the predetermined amount of toner 36 is supplied into the feeding tank 41 may be determined by measuring the pressure in the negative pressure room 82 after the inside of the suction-port communicating tube 45 is open and then determining whether the pressure difference between the measured pressure and the pressure having been measured before the inside of the suction-port communicating tube 45 is open is greater than the pressure difference previously obtained by conducting experiments or the like.

As described above, by generating the negative pressure in the feeding tank 41 by using the pressure difference between the pressure in the feeding tank 41 and the negative pressure in the negative pressure room 82, it may become possible to suction the toner 36 along with air in the toner container 40 into the feeding tank 41. By suctioning the toner 36 along with air from the toner container 40 into the feeding tank 41 by generating the negative pressure in the feeding tank 41, it becomes possible to feed the toner 36. In other words, in order to suction the toner 36 into the feeding tank 41, the controller 48 performs control to generate the negative pressure. Further, the suction pump 43 to generate the negative pressure in the feeding tank 41 is disposed outside the feeding tank 41. Because of this structure, it may become possible to prevent the heat transfer from the suction pump 43 to the feeding tank 41. Further, the toner 36 is suctioned into the feeding tank 41 by means of the negative pressure. Because of this feature, it may become possible to suction the toner 36 into the feeding tank 41 without grinding toner 36. As a result, it becomes possible to minimize (reduce) the heat stress on toner 36 and feeding toner 36.

Further, while the inside of the discharge tube 46 is closed by the output port opening and closing device 47, the inside of the suction-port communicating tube 45 is open, so as to generate the negative pressure in the feeding tank 41 by using the negative pressure in the negative pressure room 82. Therefore, it may become possible to increase the negative pressure in the feeding tank 41 in a shorter time period. Accordingly, it may become possible to suction more toner 36 into the feeding tank 41 in a short time period and to shorten a time period to suction the toner 36 into the feeding tank 41 and a time period to prepare the suction of the toner 36 into the feeding tank 41. As a result, it may become possible to increase a supply amount of the toner 36 into the developing device 13 per unit time. Actually, according to an experiment, it was possible to suction 1 to 12 g of toner 36 within a single toner supply control.

Further, in the example of the above toner supply control, a state is maintained where the inside of the communicating tube 100 is closed by the negative pressure room opening and closing device 96. However, in the toner supply control, the present invention is not limited to the case where while the inside of the communicating tube 100 is closed, so that the toner 36 in the toner container 40 is supplied (suctioned) into the feeding tank 41. For example, the following control may alternatively be performed.

In another example of the toner supply control, while causing the output port opening and closing device 47 to close the discharge tube 46 (i.e., the output port 50), the controller 48 causes the suction-port opening and closing device 93 to open the inside of the suction-port communicating tube 45. At the same time, the controller 48 further causes the negative pressure room opening and closing device 96 to open the inside of the negative pressure room communicating tube 100, and drives the suction pump 43. After that, when determining a predetermined amount of toner 36 is supplied (suctioned) into the feeding tank 41, the controller 48 stops the driving of the suction pump 43. Further, when stopping the driving of the suction pump 43, the controller 48 causes the suction-port opening and closing device 93 to close the inside of the suction-port communicating tube 45 and the negative pressure room opening and closing device 96 to close the inside of the negative pressure room communicating tube 100. Whether the predetermined amount of toner 36 is supplied (suctioned) into the feeding tank 41 may be determined in the same manner (method) as described above. Therefore, the repeated description herein is omitted.

By performing the toner supply control as described above, in order to generate the negative pressure in the feeding tank 41, it may become possible to use an air suction force generated by the suction pump 43 in addition to the pressure difference between the pressure in the feeding tank 41 and the negative pressure in the negative pressure room 82. By additionally using the air suction force generated by the suction pump 43, when compared with the toner supply control described above, it may become possible to reduce the lowering of the suctioning amount due to the lowering of the negative pressure in the feeding tank 41, and suction more toner 36. Actually, according to an experiment, it was possible to suction 1 to 18 g of toner 36 within a single toner supply control.

Next, FIG. 4 schematically illustrates a result of a comparison which is made between a case where the suction pump 43 is not driven in the toner supply control described first (dotted line) to suction toner and a case where the suction pump 43 is driven in the another example of the toner supply control (solid time) to suction toner. In those two cases, the pressure value in the feeding tank 41 is monitored for a certain period of time. As schematically illustrated in FIG. 4, when compared with the case where the suction pump 43 is not driven, when the suction pump 43 is driven, it is possible to reduce the reduction of the negative pressure value in the feeding tank 41. As a result, according to an experiment, the suctioning amount of the toner 36 into the feeding tank 41 was increased by 5 to 50%.

As described above, by further increasing the supply amount of toner 36 suctioned from the toner container 40 into the feeding tank 41 by additionally using the air suction force generated by the suction pump 43, it may become possible to increase the supply amount of toner 36 into the developing device 13 per unit time without adding new parts and without increasing the cost of the device.

Further, as described in the description of the negative pressure generating control, the controller 48 may start the toner supply control when determining that the negative pressure state in the negative pressure room 82 becomes the predetermined negative pressure state in the negative pressure generating control while the inside of the discharge tube 46 is closed in the toner discharge control. By performing the control in this way, the negative pressure generating control may be started in a state where the inside of the negative pressure room communicating tube 100 is open and the suction pump 43 is being driven. Therefore, in this case, what it necessary when the negative pressure generating control is started is only to open the inside of the suction-port communicating tube 45 by the suction-port opening and closing device 93. Therefore, at least, it may become possible to reduce a time period necessary to start up an air suction when the driving of the suction pump 43 is started. As a result, it may become possible to suction more toner 36 from the toner container 40 into the feeding tank 41. Further, in the negative pressure generating control, it may become possible to reduce a time period necessary to close the inside of the negative pressure room communicating tube 100 by the negative pressure room opening and closing device 96.

Waiting (Wait Control)

Further, after a predetermined amount of toner 36 is supplied (suctioned) into the feeding tank 41 and the toner supply control is finished, for example, it may become necessary to supply toner 36 into the developing device 13. In such a case, it becomes necessary to wait to start the toner discharge control (to transit to the toner discharge control). During the waiting (in the wait control), the controller 48 stops the driving of the suction pump 43, and closes the inside of the suction-port communicating tube 45, the inside of the negative pressure room communicating tube 100, and the inside of the discharge tube 46.

However, in the powder feeding device 35 according to this embodiment of the present invention, it is not always necessary to wait until the toner discharge control is started (the control is transitioned to the toner discharge control). For example, there may be a case where a toner density in the developing device 13 may not become a predetermined density by performing a single cycle of the discharge of the toner 36. In such a case, after the toner supply control is finished, the toner discharge control may be started (the control is transitioned to the toner discharge control) without waiting (without performing the wait control), so that a series of controls are repeated to continuously supply toner 36 to the developing device 13.

Next, with reference to figures, the operations of the control of the related art and the operations of the controls performed by the controller 48 in typical three cases described in the example 1 of the present invention are described. More specifically, those operations are described in detail with reference to the corresponding timing charts illustrating the timings when the opening and closing units open and close and when the pump is driven (ON) and is not driven (OFF). FIG. 5A is a timing chart illustrating a case where conventional control is performed. FIG. 5B is a timing chart illustrating a case where both the toner discharge control and the negative pressure generating control are started at the same time (in the another example of the negative pressure generating control). FIG. 6A is a timing chart illustrating a case where the air suction force generated by the suction pump 43 is additionally used to generate the negative pressure in the feeding tank 41 in the toner supply control (in the another example of the toner supply control). FIG. 6B is a timing chart illustrating a case where both the toner discharge control and the negative pressure generating control are started at the same time and the air suction force generated by the suction pump 43 is additionally used to generate the negative pressure in the feeding tank 41 in the toner supply control (in the another example of the negative pressure generating control combined with the another example of the toner supply control).

In those timing charts, for simplification and explanatory purposes, it is assumed that the conventional toner discharge control and the conventional toner supply control are described in two steps and other controls and waiting are described in one step. Further, it is assumed that the opening and closing units close the corresponding tubes and the suction pump 43 is not started (i.e. OFF) until the toner supply signal instructing the supply of the toner 36 to the developing device 13 is issued (transmitted) to the controller 48.

As illustrated in the timing chart of FIG. 5A, in the conventional control, when the toner supply signal instructing the supply of the toner 36 to the developing device 13 is received, the controller 48 starts the toner discharge control and causes the output port opening and closing device 47 to open the discharge tube 46 (i.e., the output port 50). After two steps, the controller 48 causes the output port opening and closing device 47 to close the discharge tube 46 (i.e., the output port 50) and then starts the negative pressure generating control. In the negative pressure generating control, the controller 48 causes the negative pressure room opening and closing device 96 to open the inside of the negative pressure room communicating tube 100 and drives (turns ON) the suction pump 43. Then, after one step, the controller 48 causes the negative pressure room opening and closing device 96 to close the inside of the negative pressure room communicating tube 100 and stops (turns OFF) the driving of the suction pump 43. Then, the controller 48 starts the toner supply control (transitions to the toner supply control). In the toner supply control, the controller 48 causes the suction-port opening and closing device 93 to open the inside of the suction-port communicating tube 45. Then, after one step, the controller 48 causes the suction-port opening and closing device 93 to close the inside of the suction-port communicating tube 45 and starts waiting (transitions to waiting).

On the other hand, as illustrated in the timing chart of FIG. 5B, in the case where the toner discharge control and the negative pressure generating control are stated at the same time (in the another example of the negative pressure generating control), when the toner supply signal instructing the supply of the toner 36 to the developing device 13 is received, the controller 48 starts the toner discharge control and the negative pressure generating control at the same time. To that end, the controller 48 causes the output port opening and closing device 47 to open the discharge tube 46 (i.e., the output port 50), causes the negative pressure room opening and closing device 96 to open the inside of the negative pressure room communicating tube 100, and drives (turns ON) the suction pump 43. Then, after one step, the controller 48 causes the negative pressure room opening and closing device 96 to close the inside of the negative pressure room communicating tube 100 and stops (turns OFF) the driving of the suction pump 43. After one step, the controller 48 causes the output port opening and closing device 47 to close the discharge tube 46 (i.e., the output port 50), and starts the toner supply control (transitions to the toner supply control). In the toner supply control, the controller 48 causes the suction-port opening and closing device 93 to open the inside of the suction-port communicating tube 45. Then, after one step, the controller 48 causes the suction-port opening and closing device 93 to close the inside of the suction-port communicating tube 45 and starts waiting (transitions to waiting).

As illustrated in the time chart of FIG. 6A, in the case where the air suction force generated by the suction pump 43 is additionally used to generate the negative pressure in the feeding tank 41 in the toner supply control (in the another example of the toner supply control), when the toner supply signal instructing the supply of the toner 36 to the developing device 13 is received, the controller 48 starts the toner discharge control and causes the output port opening and closing device 47 to open the discharge tube 46 (i.e., the output port 50). After two steps, the controller 48 causes the output port opening and closing device 47 to close the discharge tube 46 (i.e., the output port 50), and then starts the negative pressure generating control (transitions to the negative pressure generating control). In the negative pressure generating control, the controller 48 causes the negative pressure room opening and closing device 96 to open the inside of the negative pressure room communicating tube 100 and drives (turns ON) the suction pump 43. Then, after one step, the controller 48 starts the toner supply control (transitions to the toner supply control). In the toner supply control, the controller 48 causes the suction-port opening and closing device 93 to close the inside of the suction-port communicating tube 45, stops (turns OFF) the driving of the suction pump 43, and starts waiting (transitions to waiting).

As illustrated in the time chart of FIG. 6B, in the case where both the toner discharge control and the negative pressure generating control are started at the same time and the air suction force generated by the suction pump 43 is additionally used to generate the negative pressure in the feeding tank 41 in the toner supply control (in the another example of the negative pressure generating control combined with the another example of the toner supply control), when the toner supply signal instructing the supply of the toner 36 to the developing device 13 is received, the controller 48 starts the toner discharge control and the negative pressure generating control at the same time. To that end, the controller 48 causes the output port opening and closing device 47 to open the discharge tube 46 (i.e., the output port 50), causes the negative pressure room opening and closing device 96 to open the inside of the negative pressure room communicating tube 100, and drives (turns ON) the suction pump 43. Then, after one step, the controller 48 causes the negative pressure room opening and closing device 96 to close the inside of the negative pressure room communicating tube 100 and stops (turns OFF) the driving of the suction pump 43. After one step, the controller 48 causes the output port opening and closing device 47 to close the discharge tube 46 (i.e., the output port 50) and starts the toner supply control (transitions to the toner supply control). In the toner supply control, the controller 48 causes the negative pressure room opening and closing device 96 to open the inside of the negative pressure room communicating tube 100, causes the suction-port opening and closing device 93 to open the inside of the suction-port communicating tube 45, and drives (turns ON) the suction pump 43. After one step, the controller 48 causes the negative pressure room opening and closing device 96 to close the inside of the negative pressure room communicating tube 100, causes the suction-port opening and closing device 93 to close the inside of the suction-port communicating tube 45, stops (turns OFF) the driving of the suction pump 43, and starts waiting (transitions to waiting).

EXAMPLE 2

Next, a powder feeding device 35 according to another example (example 2 ) of the present invention in an image forming apparatus is described with reference to FIG. 7. In this example, as illustrated in FIG. 7, the powder feeding device 35 further includes a feeding screw 42 in addition to the elements of the powder feeding device 35 of the example 1 described above. The feeding screw 42 is disposed inside the feeding tank 41 as a rotational feeding unit. By rotating around the axle of the feeding screw 42, the feeding screw 42 is operated as a feeding member to feed the toner 36 in the feeding tank 41 from the input port 49 to the output port 50. Unless otherwise described, the elements of the powder feeding device 35 in example 2 are the same as those of the powder feeding device 35 in example 1 except for the rotational feeding unit. Therefore, the descriptions of the elements (configuration), the operations, and the effects of the powder feeding device 35 in example 2 same as those of the powder feeding device 35 in example 1 may be omitted.

First, configurations of the feeding tank 41 and the rotational feeding unit according to this example (example 2) are described. Similar to the feeding tank 41 of example 1, the feeding tank 41 of this example has the upper part where the suction port 51 is formed. Through the suction port 51 and the suction-port communicating tube 45, the feeding tank 41 is in communication with the negative pressure room 82. Further, the feeding tank 41 has the side part where the input port 49 is formed. Through the input port 49 and the plumbing 44, the feeding tank 41 is in communication with the toner container 40. Further, the feeding tank 41 has the bottom part where the output port 50 is formed. Through the output port 50 and the discharge tube. 46, the feeding tank 41 is in communication with the container tank 17 of the developing device 13. Further, as illustrated in FIG. 7, the rotational feeding unit includes the feeding screw 42 and a screw driving device 115. The feeding screw 42 is a feeding member disposed in the feeding tank 41. The screw driving device 115 is disposed outside of the feeding tank 41. The controller 48 controls (drives) the feeding screw 42 of the rotational feeding unit so as to rotate the feeding screw 42. By doing this, it becomes possible to feed the toner 36 in the feeding tank 41 from the input port 49 to the output port 50. In the following, the elements of the rotational feeding unit are described in more detail.

When compared with the feeding tank 41 of example 1, the size of the feeding tank 41 of example 2 is longer than the size of the feeding tank 41 of example 1 in the direction facing (toward) the internal wall surface where the input port 49 is formed, so that the feeding tank 41 is in communication with the toner container 40 (i.e., in the direction parallel to the feeding direction of the toner 36 in the feeding tank 41). Further, as illustrated in FIG. 7, the positions of the suction port 51 and the output port 50 in the horizontal direction of the feeding tank 41 of example 2 differ from those of the feeding tank 41 of example 1. Specifically, in the feeding tank 41 of example 1, the suction port 51 and the output port 50 are disposed substantially in the center of the feeding tank 41 in the horizontal direction. On the other hand, in the feeding tank 41 of example 2, the suction port 51 is disposed at a position separated from the end of the feeding tank 41 on the upstream side in the toner feeding direction (i.e., in the horizontal direction in FIG. 7) in the feeding tank 41 by approximately two-thirds of the length in the horizontal direction of the feeding tank 41 in FIG. 7. Further, the output port 50 is disposed closer (in the vicinity of) the end of the feeding tank 41 on the downstream side in the toner feeding-direction in the feeding tank 41. Further, the height of the surface where the suction port 51 is formed in the feeding tank 41 of example 2 is substantially same as that in the feeding tank 41 of example 1. Further, a gradual slope is formed on the bottom part of the internal surfaces of the feeding tank 41, so that the lower part of the outermost circumferential part of an extending spiral blade of the feeding screw 42 described in more detail below can slide in a range of approximately 45 degrees around the axle of the feeding screw 42 in the left and right direction relative to a line parallel to the axle of the feeding screw 42. The feeding screw 42 is disposed in the feeding tank 41 in a manner that the axle of the feeding screw 42 is disposed above the most lowest part of the internal wall surface of the feeding tank 41. Further, the output port 50 is disposed in the range where the outermost circumferential part of the extending spiral blade of the feeding screw 42 slides with the bottom part of the internal wall surface of the feeding tank 41. By forming the bottom part of the internal wall surface of the feeding tank 41, it may become possible to fully feed the toner 36 to the output port 50 by the rotation of the feeding screw 42, the toner 36 having been supplied from the toner container 40 to the feeding tank 41. However, the shape of the bottom part of the internal wall surface of the feeding tank 41 described above is an example only. Namely, the bottom part of the internal wall surface of the feeding tank 41 may have any shape as long as the toner 36 having been supplied from the toner container 40 to the feeding tank 41 can be fully fed to the output port 50.

The feeding screw 42 includes an axle having a rod shape and a blade protruding and spirally extending from the outer surface of the axle. One end of the axle of the feeding screw 42 is connected to the screw driving device 115 disposed outside of the feeding tank 41. Further, the feeding screw 42 feeds the toner 36 from the side of the input port 49 to the side of the output port 50 when the controller 48 drives the screw driving device 115 to rotate the screw driving device 115 around the axle, the toner having been supplied into the feeding tank 41 through the input port 49.

Next, the operations of the powder feeding device 35 of this example (example 2) are described by describing the control performed by the controller 48. The control performed by the controller 48 in this example differs from the control performed by the controller 48 in example 1 only in the operations relevant to the rotational feeding unit added in the feeding tank 41 in the toner discharge control.

Unless otherwise described, the operations of the powder feeding device 35 in example 2 are the same as those of the powder feeding device 35 in example 1 except for the operations relevant to the rotational feeding unit. Therefore, the descriptions of the operations of the powder feeding device 35 in example 2 same as those of the powder feeding device 35 in example 1 may be omitted. Further, similar to the operations (control) in example 1, the series of the operations (control) are repeatedly performed.

Toner Discharge Control

In the toner discharge control, in order to discharge the toner 36 from the feeding tank 41 to the container tank 17 of the developing device 13 in the powder feeding device 35, the controller 48 performs the following control. The controller 48 causes the output port opening and closing device 47 to open the inside of the discharge tube 46, and then rotationally drives the screw driving device 115 of the rotational feeding unit. By rotationally driving thee screw driving device 115 of the rotational feeding unit, the feeding screw 42 accordingly rotates, so that the feeding screw 42 feeds the toner 36 in the feeding tank 41 from the input port 49 to the output port 50. By means of the rotational feeding unit, it may become possible to fully discharge (supply) the toner 36 from the output port 50 into the container tank 17 of the developing device 13 via the output port 50 and the discharge tube 46, the toner 36 having been fed from the input port 49 to the output port 50. When the toner 36 in the feeding tank 41 supplied from the toner container 40 to the feeding tank 41 is fully discharged from the output port 50, the controller 48 causes the output port opening and closing device 47 to close the inside of the discharge tube 46.

Negative Pressure Generating Control

Further, as described in the another example of the negative pressure generating control of example 1, in the case where the controller 48 starts the toner discharge control and the negative pressure generating control at the same time, the operations (control) described above may also be applied. Specifically, while causing the output port opening and closing device 47 to open the inside of the discharge tube 46, the controller 48 causes the suction-port opening and closing device 93 to close the inside of the suction-port communicating tube 45 and causes the negative pressure room opening and closing device 96 to open the inside of the negative pressure room communicating tube 100. Under this state, the controller 48 drives the suction pump 43 and rotationally drives the screw driving device 115 of the rotational feeding unit. By rotationally driving the screw driving device 115, the feeding screw 42 is rotated. As a result, the toner 36 in the feeding tank 41 is fed from the input port 49 to the output port 50.

Further, when the negative pressure in the negative pressure room 82 becomes a predetermined negative pressure state, the controller 48 stops the driving of the suction pump 43 and causes the negative pressure room opening and closing device 96 to close the inside of the negative pressure room communicating tube 100. Further, in the toner discharge control, when determining that the toner 36 in the feeding tank 41 supplied from the toner container 40 to the feeding tank 41 is fully discharged from the output port 50, the controller 48 causes the output port opening and closing device 47 to close the inside of the discharge tube 46.

By performing the toner discharge control or the negative pressure generating control as described above, in addition to the operations and effects of the example 1, the following operations and effects may also be obtained. The feeding screw 42 is used to feed the toner 36 in the feeding tank 41 from the input port 49 to the output port 50. Therefore, a constant amount of toner 36 is always fed to the output port 50. Therefore, it may become possible to prevent jamming of toner 36 at the output port 50, stabilize the discharge speed of the toner 36, and reduce a time period necessary to fully discharge the toner 36 in the feeding tank 41. Therefore, it may become possible to increase a supply amount of toner 36 to the developing device 13 per unit time.

EXAMPLE 3

Next, a powder feeding device 35 according to still another example (example 3) of the present invention in an image forming apparatus is described with reference to FIG. 8. In this example, as illustrated in FIG. 8, the powder feeding device 35 further includes an air supply unit that supplies air into the feeding tank 41 in addition to the elements of the powder feeding device 35 of the example 1 or 2 described above. Unless otherwise described, the elements of the powder feeding device 35 in example 3 are the same as those of the powder feeding device 35 in example 1 or 2 except for the air supply unit. Therefore, the descriptions of the elements (configuration), the operations, and the effects of the powder feeding device 35 in example 3 same as those of the powder feeding device 35 in example 1 or 2 may be omitted. Further, in the following description, a case where the both the toner discharge control and the negative pressure generating control are started at the same time as performed in the example 2 is described, even though the case may be performed in both example 1 and example 2.

First, the air supply unit of this example that supplies air in the feeding tank 41 is described. The suction pump 43 in this example has the same configuration as that in example 1 or 2. Namely, the air supply unit that supplies air into the feeding tank 41 supplies air discharged from the pump discharge port 102 of the suction pump 43 to the feeding tank 41. The air supply unit includes the suction pump 43, a feeding tank air supply port 108, an air supply communicating tube 107 communicating between the pump discharge port 102 and the feeding tank air supply port 108, and an air supply opening and closing device 109. In the following, details of those elements except for the suction pump 43 are described.

The air supply communicating tube 107 is made of an elastic member such as rubber and is formed in a tube shape. One end of the air supply communicating tube 107 is fixed to the wall around the pump discharge port 102 formed on the bottom part of the suction pump 43. The other end of the air supply communicating tube 107 is fixed to the wall around the feeding tank air supply port 108 formed on the upper part of the negative pressure room 82 of the feeding tank 41. By fixing in this way, the air supply communicating tube 107 provides communication between the suction pump 43 and the feeding tank 41. The air supply communicating tube 107 is equipped with the air supply opening and closing device 109 which opens and closes the inside of the air supply communicating tube 107 as an air supply port opening and closing unit.

The air supply opening and closing device 109 is similar to the negative pressure room opening and closing device 96. An open and close driving source 110 is provided to open and close the inside of the air supply communicating tube 107. The open and close driving source 110 opens and closes the inside of the air supply communicating tube 107 under the control of the controller 48.

The feeding tank 41 in this example is the same as that in the example 2 except that the feeding tank air supply port 108 is formed on the upper side of the feeding tank 41 in this example. In the feeding tank 41 in this example, the feeding tank air supply port 108 is formed at a position separated from the upstream side of the feeding direction of the toner 36 in the direction extending from the upstream side to the down stream side of the feeding direction of the toner 36 by approximately one-third of the length of the length of the feeding tank 41 in the feeding direction of the toner 36. Air from the suction pump 43 flows into the feeding tank 41 through the pump discharge port 102, the air supply communicating tube 107, and the feeding tank air supply port 108.

Next, the operations of the powder feeding device 35 in this example are described by describing the control performed by the controller 48. In the descriptions, as described above, it is assumed that the toner discharge control and the negative pressure generating control are started at the same time. Further, the control performed by the controller 48 in this example differ from the control performed by the controller 48 in example 1 or 2 in the toner discharge control only. The other controls in this example is similar to the controls in example 1 or 2 except that it is assumed that the toner discharge control and the negative pressure generating control are started at the same time. Therefore, the descriptions of the controls, operations, and effects in this example similar to those in example 1 or 2 may be omitted. Further, similar to the controls in example 1 or 2, a series of the controls (operations) are repeatedly performed.

Toner Discharge Control and Negative Pressure Generating Control

In this example, as described above, it is assumed that the toner discharge control and the negative pressure generating control are started at the same time. Specifically, the controller 48 causes the output port opening and closing device 47 to open the inside of the discharge tube 46, causes the suction-port opening and closing device 93 to close the inside of the suction-port communicating tube 45, and causes the negative pressure room opening and closing device 96 to open the inside of the negative pressure room communicating tube 100. Under this state, the controller 48 drives the suction pump 43 to suction air inside the negative pressure room 82 through the pump suction port 63, and drives the screw driving device 115 to rotate the feeding screw 42 to feed the toner 36 from the input port 49 to the output port 50. Further, in addition to the suctioning of air in the negative pressure room 82 and the feeding of toner 36 from the input port 49 to the output port 50, the controller 48 causes the air supply opening and closing device 109 to open the air supply communicating tube 107 to supply air discharged from the pump discharge port 102 of the suction pump 43 into the feeding tank 41.

Then, when the negative pressure in the negative pressure room 82 becomes a predetermined negative pressure state, the controller 48 stops the driving of the suction pump 43, causes the negative pressure room opening and closing device 96 to close the inside of the negative pressure room communicating tube 100, and causes the air supply opening and closing device 109 to close the air supply communicating tube 107. Further, when determining that the toner 36 in the feeding tank 41 is fully discharged through the output port 50, the toner 36 having been fed from the toner container 40 to the feeding tank 41, the controller 48 causes the output port opening and closing device 47 to close the inside of the discharge tube 46.

By performing the toner discharge control and the negative pressure generating control in this way, in addition to the operations and effects obtained in example 1 or 2 when the toner discharge control and the negative pressure generating control are started at the same time, the following operations and effects may also be obtained. By supplying air into the feeding tank 41 by driving the suction pump 43, it may become possible to apply a pressure to the feeding tank 41 and increase the speed of discharging toner 36 in the feeding tank 41. As a result, it may become possible to increase a supply amount of toner 36 to the developing device 13 per unit time.

Further, in the descriptions of this example, it is assumed that the toner discharge control and the negative pressure generating control are started at the same time. However, in a case where the toner discharge control and the negative pressure generating control are not started at the same time, the present invention may also be applicable by, for example, having the following configuration. Namely, in addition to the elements (configuration) described above, an air open valve (not shown) may be provided between the negative pressure room opening and closing device 96 for the negative pressure room communicating tube 100 and the pump suction port 63.

Further, in addition to the toner discharge control, only when air is supplied to the feeding tank 41 in the toner discharge control, an additional control to open the air open valve to suction air is performed in the toner discharge control.

EXAMPLE 4

An example 4 of the powder feeding device 35 in an image forming apparatus according to an embodiment of the present invention is described with reference to FIG. 3. As illustrated in FIG. 3, the powder feeding device 35 of this example 4 includes a toner container 40 as a powder container, the feeding tank 41, the suction pump 43 as the gas suctioning device, the negative pressure room 82, the plumbing 44, the suction-port communicating tube 45, the negative pressure room communicating tube 100, the discharge tube 46, the output port opening and closing device 47, the suction-port opening and closing device 93, the negative pressure room opening and closing device 96, and the controller 48. The controller 48 collectively controls the operations of the powder feeding device 35.

First, an exemplary configuration of the powder feeding device 35 according to this embodiment of the present invention is described. Herein, elements (devices) except for the controller 48 of the powder feeding device 35 are arranged from the upper to lower ends in the vertical direction and sequentially connected as described below. The suction pump 43 is in communication with the negative pressure room 82 via the negative pressure room communicating tube 100. The negative pressure room 82 is in communication with the feeding tank 41 via the suction-port communicating tube 45. A side surface of the feeding tank 41 is in communication with the toner container 40 via the plumbing 44. Further, the feeding tank 41 is in communication with a container tank 17 of the developing device 13 via the discharge tube 46. In the following, the configurations of the elements (devices) are described in the order of the arrangement.

The suction pump 43 is the diaphragm pump (diaphragm type pump) and includes the pump container 112, the diaphragm 111, and the pump driving device 60. The pump container 112 includes the bottom part where the pump suction port 63 and the pump discharge port 102 are formed. Further, the suction side valve 101 and the discharge side valve 103 are provided so as to open and close the pump suction port 63 and the pump discharge port 102, respectively. More specifically, the suction side valve 101 is provided on the pump suction port 63 in a manner that one end side of the suction side valve 101 is fixed to the pump container 112 and the suction side valve 101 covers the upper part of the pump suction port 63 of the pump container 112. By having this structure, only when air (gas) (hereinafter may be only referred to as "air") flows into the pump container 112, the other end side of the suction side valve 101 is deformed upward to open the suction side valve 101 (i.e., the pump suction port 63). On the other hand, the discharge side valve 103 is provided inside the widening part that is inside the pump discharge port 102 and that is formed under the bottom part of the pump container 112. Further, the discharge side valve 103 is provided on the pump discharge port 102 in a manner that one end side of the discharge side valve 103 is fixed to the pump container 112 and the discharge side valve 103 covers an upper hole of the pump discharge port 102 of the pump container 112 from underneath. Further, only when air flows from the pump container 112, the other end side of the discharge side valve 103 is deformed downward to open the discharge side valve 103 (i.e., pump discharge port 102). Under the control of the controller 48, the suction pump 43 is driven to suction air through the pump suction port 63 and discharge air through the pump discharge port 102 by causing the diaphragm 111 to perform a back-and-forth movement by the pump driving device 60. Herein, it is assumed that the maximum flow rate and the maximum vacuum degree of the suction pump 43 is 1 to 8 liters/min and −20 to −80 kPa, respectively. Further, the diaphragm pump is generally used in various applications and includes a limited number of parts only as described above. Therefore, the purchasing cost is low and manufacturing cost would also be low.

The negative pressure room communicating tube 100 is made of an elastic member such as rubber and is formed in a tube shape. One end of the negative pressure room communicating tube 100 is fixed to the wall around the pump suction port 63 formed on the bottom part of the suction pump 43. The other end of the negative pressure room communicating tube 100 is fixed to the wall around the through hole 88 formed on the upper part of the negative pressure room 82. By fixing in this way, the negative pressure room communicating tube 100 provides communication between the suction pump 43 and the negative pressure room 82. The negative pressure room communicating tube 100 is equipped with the negative pressure room opening and closing device 96 which opens and closes the inside of the negative pressure room communicating tube 100 as the negative pressure room opening and closing unit.

The negative pressure room opening and closing device 96 includes the pair of clamping members 70 provided in a manner that the clamping members 70 can approach and separate from each other, and the open and close driving source 98 as the opening and closing unit. The pair of clamping members 70 are disposed (provided) in a manner that the middle of the negative pressure room communicating tube 100 is sandwiched by the pair of clamping members 70. The negative pressure room opening and closing device 96 (open and close driving source 98) causes the pair of clamping members 70 to approach and separate from each other. When the pair of clamping members 70 are approach each other, the pair of clamping members 70 squeeze (clampingly engage) the negative pressure room communicating tube 100 between the pair of clamping members 70 so as to close the inside (block the air flow) of the negative pressure room communicating tube 100. On the other hand; when the pair of clamping members 70 are separated from each other, the pair of clamping members 70 open the inside of the negative pressure room communicating tube 100 (to provide the communication between the suction pump 43 and the negative pressure room 82). By doing this, the open and close driving source 98 opens and closes the inside of the negative pressure room communicating tube 100 (to block and provide communication between the suction pump 43 and the negative pressure room 82). Further, the suction-port opening and closing device 93 and the output port opening and closing device 47 have the same configuration as that of the above-described negative pressure room opening and closing device 96. Therefore, the open and close driving source 95 of the suction-port opening and closing device 93 opens and closes the inside of the suction-port communicating tube 45. The open and close driving source 71 of the output port opening and closing device 47 opens and closes the inside of the discharge tube 46. Further, the controller 48 controls the opening and closing operations of those opening and closing units (i.e., the negative pressure room opening and closing device 96, the suction-port opening and closing device 93, and the output port opening and closing device 47).

The negative pressure room 82 has the upper part where the through hole 88 is formed. Through the through hole 88 and the negative pressure room communicating tube 100, the negative pressure room 82 is in communication with the suction pump 43. On the other hand, the negative pressure room 82 has the bottom part where the through hole 104 is formed. Through the through hole 104 and the suction-port communicating tube 45, the negative pressure room 82 is in communication with the feeding tank 41. The capacity of the negative pressure room 82 is 20 to 300 cc. When the suction pump 43 is driven and then the negative pressure room communicating tube 100 and the suction-port communicating tube 45 are closed by the respective opening and closing units, the negative pressure is generated in the negative pressure room 82. The negative pressure room 82 is provided so as to hold the generated negative pressure in the negative pressure room 82 until the negative pressure room communicating tube 100 or the suction-port communicating tube 45 is open.

The suction-port communicating tube 45 is made of an elastic member such as rubber and is formed in a tube shape. One end of the suction-port communicating tube 45 is fixed to the wall around the through hole 104 formed on the bottom part of the negative pressure room 82. The other end of the suction-port communicating tube 45 is fixed to the wall around the suction port 51 formed on the upper part of the feeding tank 41. By fixing in this way, the suction-port communicating tube 45 provides communication between the negative pressure room 82 and the feeding tank 41. The suction-port communicating tube 45 is equipped with the suction-port opening and closing device 93 which opens and closes the inside of the suction-port communicating tube 45 as a suction-port opening and closing unit. As described above, the suction-port opening and closing device 93 has the same configuration as that of the negative pressure room opening and closing device 96. The controller 48 controls the opening and closing operations of the suction-port opening and closing device 93.

The feeding tank 41 has the upper part where the suction port 51 is formed. Through the suction port 51 and the suction-port communicating tube 45, the feeding tank 41 is in communication with the negative pressure room 82. Further, the feeding tank 41 has a side part where the input port 49 is formed. Through the input port 49 and the plumbing 44, the feeding tank 41 is in communication with the toner container 40. Further, the feeding tank 41 has the bottom part where the output port 50 is formed. Through the output port 50 and the discharge tube 46, the feeding tank 41 is in communication with the container tank 17 of the developing device 13. A negative pressure in the feeding tank 41 is generated based on a pressure difference between the inside of the feeding tank 41 and the inside of the negative pressure room 82. By using the negative pressure generated in the feeding tank 41, the toner 36 contained in the toner container 40 is suctioned into the feeding tank 41. Then, the feeding tank 41 supplies the toner 36 to the container tank 17 of the developing device 13 through the output port 50 of the feeding tank 41.

The plumbing 44 is made of an elastic member such as rubber and is formed in a tube shape, so as to provide (form) a feed path through which toner 36 flows. One end of the plumbing 44 is fixed to the wall around the input port 49 formed on the side part of the feeding tank 41. The other end of the plumbing 44 is integrally formed with the toner container 40.

The toner container 40 has an internal space which is sealed from the outside air. The internal space of the toner container 40 (hereinafter simplified as toner container 40) contains toner 36. The toner container 40 is in communication with the feeding tank 41 via the plumbing 44 and the input port 49. The toner 36 in the toner container 40 is supplied to the feeding tank 41 by being suctioned along with air in the toner container 40 by using a pressure difference between the negative pressure in the negative pressure room 82 and the pressure in the feeding tank 41. Then, the toner 36 suctioned into the feeding tank 41 is discharged to the container tank 17 of the developing device 13 through the output port 50 of the feeding tank 41.

The discharge tube 46 is made of an elastic member such as rubber and is formed in a tube shape. One end of the discharge tube 46 is fixed to the wall around the output port 50 formed on the bottom part of the feeding tank 41. The other end of the discharge tube 46 is fixed to the wall around the supply hole 37 formed on the upper part of the container tank 17 of the developing device 13. By fixing in this way, the discharge tube 46 provides communication between the feeding tank 41 and the container tank 17 of the developing device 13. The discharge tube 46 is equipped with the output port opening and closing device 47 which opens and closes the inside of the discharge tube 46 as an output port opening and closing unit. As described above, the output port opening and closing device 47 has the same configuration as that of the negative pressure room opening and closing device 96. The controller 48 controls the opening and closing operations of the output port opening and closing device 47.

Herein, there are two container tanks that are in the developing device 13 and that mix and feed the developer. The container tank 17 of the developing device 13 is one of the two container tanks and has the upper part where the supply hole 37 is formed. The supply hole 37 is provided so that the toner is supplied from the feeding tank 41 to the container tank 17 of the developing device 13 through the supply hole 37 and the discharge tube 46. In the container tank 17 of the developing device 13, the mixing screw 18 is provided.

The controller 48 is a computer including a RAM (Random Access Memory), a ROM (Read Only Memory), a CPU (Central Processing Unit) and the like. The controller 48 is electrically connected to the pump driving device 60 of the suction pump 43, the open and close driving source 98 of the negative pressure room opening and closing device 96, the open and close driving source 95 of the suction-port opening and closing device 93, and the open and close driving source 71 of the output port opening and closing device 47. Further, the controller 48 communicates with a controller (not shown) of the image forming apparatus including the powder feeding device according to an embodiment of the present invention, so that a control signal and the like can be mutually transmitted between the controller 48 and the controller of the image forming apparatus. For example, based on a toner supply signal that is transmitted from the controller of the image forming apparatus and that instructs the supply of the toner 36 to the developing device 13 and based on the detection results by the sensors, the controller 48 controls the operations of the powder feeding device 35 by collectively controlling the elements (devices) of the powder feeding device 35. Further, in this embodiment, a case is described where the controller 48 is included in the powder feeding device 35. However, the present invention is not limited to this configuration. For example, the controller 48 may be integrated (included) in the controller of the image forming apparatus including the powder feeding device 35. Further, the controller 48 may be disposed at any position as long as, for example, the controller 48 can be easily mounted and maintained and the environmental conditions including temperature condition are suitable (satisfied).

Next, the operations of the powder feeding device 35 according to this example of the present invention are described by referring to the controls performed by the controller 48. The control operations performed by the controller 48 includes three control operations, which are negative pressure generating control, toner supply control, and toner discharge control. The negative pressure generating control refers to a control of generating a negative pressure in the negative pressure room 82. The toner supply control refers to a control of supplying toner 36 from the toner container 40 to the feeding tank 41. The toner discharge control refers to a control of discharging the toner 36 from the feeding tank 41 to the container tank 17 of the developing device 13. In the powder feeding device 35, a series of those operations is repeatedly performed. Further, in actual operating control, when the control is to be changed from one to another, there may be a case where waiting (wait control) is performed between two controls. In the following descriptions, it is assumed that toner 36 has been already supplied into the feeding tank 41 and that the toner supply signal instructing the supply of the toner 36 to the developing device 13 is already issued (received by the controller 48). Namely, the following controls are based on the above assumptions.

Toner Discharge Control

In the toner discharge control, in order to discharge the toner 36 from the feeding tank 41 to the container tank 17 of the developing device 13 in the powder feeding device 35, the controller 48 performs the following control. The controller 48 causes the output port opening and closing device 47 to open the inside of the discharge tube 46 to discharge (supply) the toner 36 from the output port 50 of the feeding tank 41 to the container tank 17 of the developing device 13 through the opened discharge tube 46. When determining that the toner 36 supplied from the toner container 40 into the feeding tank 41 is fully discharged from the output port 50 or that a toner density in the developing device 13 reaches a predetermined value (density), the controller 48 causes the output port opening and closing device 47 to close the inside of the discharge tube 46 and changes (transitions) the control to the negative pressure generating control.

Further, in the above described example of the toner discharge control, the toner discharge control is not simultaneously performed with any other control. However, the present invention is not limited to this configuration. For example, the toner discharge control may alternatively performed as described below.

In another example of the toner discharge control, unlike the above described example of the toner discharge control, when the controller 48 starts toner discharge control, the controller 48 simultaneously starts the negative pressure generating control described in detail below. Specifically, to that end, the controller 48 causes the output port opening and closing device 47 to open the inside of the discharge tube 46, causes the suction-port opening and closing device 93 to close the inside of the suction-port communicating tube 45, and causes the negative pressure room opening and closing device 96 to open the inside of the negative pressure room communicating tube 100.

Under this state, the controller 48 drives the suction pump 43. As described above, by performing (starting) the toner discharge control and the negative pressure generating control at the same time, it may become possible to shorten a time period for performing a series of controls. Herein, the term "a time period for performing a series of controls" refers to a time period corresponding to a feeding of the toner 36 in the powder feeding device 35 based on a series of relevant operation control. By shortening the time period for performing a series of controls as described above, it may become possible to increase a supply amount of toner 36 to the developing device 13 per unit time without adding any additional parts and without increasing cost. Further, in this another example, when the toner discharge control or the negative pressure generating control is finished, the toner supply control is performed (started).

Negative Pressure Generating Control

In the negative pressure generating control, in order to generate a predetermined negative pressure state in the negative pressure room 82 in the powder feeding device 35, the controller 48 performs the following control. The controller 48 causes the suction-port opening and closing device 93 to close the inside of the suction-port communicating tube 45 and causes the negative pressure room opening and closing device 96 to open the inside of the negative pressure room communicating tube 100. Under this state, the controller 48 drives the suction pump 43. By driving the suction pump 43, air in the negative pressure room 82 is suctioned to generate a negative pressure in the negative pressure room 82. When the negative pressure state in the negative pressure room 82 becomes a predetermined negative pressure state, for example, when the pressure in the negative pressure room 82 becomes in a range from −20 kPa to −60 kPa, the controller 48 stops driving the suction pump 43 and causes the negative pressure room opening and closing device 96 to close the inside of the negative pressure room communicating tube 100. Then, the toner supply control is performed (started).

However, the above described negative pressure generating control may not be necessarily performed in a case where the toner supply control to be performed after the negative pressure generating control corresponds to an another example of the toner supply control described below. This is because in the another example of toner supply control, by the toner discharge control, while the inside of the discharge tube 46 is closed by the output port opening and closing device 47, both the inside of the suction-port communicating tube 45 and the inside of the negative pressure room communicating tube 100 are open and the suction pump 43 is driven. Therefore, while the inside of the discharge tube 46 is closed by the toner discharge control, it is preferable to go into the toner supply control (of the another example) by continuously driving the suction pump 43 without closing the inside of the suction-port communicating tube 45 when the negative pressure in the negative pressure room 82 becomes a predetermined negative pressure state. Further, whether the negative pressure state in the negative pressure room 82 becomes a predetermined negative pressure state may be determined by measuring the pressure in the negative pressure room 82 or by previously obtaining a time period necessary for becoming the predetermined negative pressure state and determining whether the obtained time period has been elapsed.

As described above, a negative pressure in the negative pressure room 82 is generated while the inside of the suction-port communicating tube 45 is closed. Therefore, air only in the negative pressure room 82 is suctioned without suctioning the toner 36. As a result, it may become possible to increase the negative pressure in the negative pressure room 82 in a shorter time period.

In the above example of the negative pressure generating control, the negative pressure generating control is not performed along with any other control. However, the present invention is not limited to this configuration where the negative pressure generating control is not performed along with any other control. Namely, for example, as the another example of the toner discharge control, the negative pressure generating control and the toner discharge control may be started at the same time.

In another example of the negative pressure generating control, unlike the above described example of the negative pressure generating control, when the controller 48 starts the negative pressure generating control, the controller 48 simultaneously starts the toner discharge control. In other words, when the controller 48 starts the toner discharge control to discharge the toner 36 from the output port 50 of the feeding tank 41 to the container tank 17 of the developing device 13, the toner 36 having been supplied from the toner container 40 into the feeding tank 41, the controller 48 simultaneously starts the negative pressure generating control. Specifically, to that end, the controller 48 causes the output port opening and closing device 47 to close the inside of the discharge tube 46, causes the suction-port opening and closing device 93 to open the inside of the suction-port communicating tube 45, and causes the negative pressure room opening and closing device 96 to open the inside of the negative pressure room communicating tube 100.

Further, when the pressure in the negative pressure room 82 becomes a predetermined negative pressure state for example in a range from −20 kPa to −60 kPa, the controller 48 stops driving the suction pump 43 and causes the negative pressure room opening and closing device 96 to close the inside of the negative pressure room communicating tube 100. Further, in the toner discharge control, when the toner 36 supplied from the toner container 40 into the feeding tank 41 is fully discharged from the output port 50 or when a toner density in the developing device 13 reaches a predetermined value, the controller 48 causes the output port opening and closing device 47 to close the inside of the discharge tube 46. In this another example when both of the toner discharge control and the negative pressure generating control are finished, the controller 48 starts the toner supply control.

As described above, by simultaneously starting the toner discharge control and the negative pressure generating control, not only the operations and effects of the negative pressure generating control described above but also the operations and effects of the another example of the toner discharge control described above may be obtained.

Further, in the in the negative pressure generating control described above or the another example of the negative pressure generating control described above, the inside of the suction-port communicating tube 45 and the inside of the communicating tube 100 are basically closed until the inside of the discharge tube 46 is closed by the output port opening and closing device 47 by the toner discharge control. By holding the state where the inside of the suction-port communicating tube 45 and the inside of the communicating tube 100 are closed, it becomes possible to prevent the air flow to and from the negative pressure room 82 and hold the negative pressure state until the controller 48 starts the toner supply control described below.

However, after the pressure in the negative pressure room 82 becomes the predetermined negative pressure state, it is not always necessary to hold the state where the inside of the suction-port communicating tube 45 and the inside of the communicating tube 100 are closed after the until the inside of the discharge tube 46 is closed by the output port opening and closing device 47. Namely, it does not matter whichever comes first the timing when the inside of the discharge tube 46 is closed by the output port opening and closing device 47 in the toner discharge control or the timing when the inside of the communicating tube 100 is closed by the negative pressure room opening and closing device 96 in the negative pressure generating control. For example, a case may be assumed where even when the toner 36 has been sufficiently discharged through the output port 50, the negative pressure state in the negative pressure room 82 does not become the predetermined negative pressure state.

Toner Supply Control

In the toner supply control, in order to supply the toner 36 from the toner container 40 into the feeding tank 41, the controller 48 performs the following control. While causing the output port opening and closing device 47 to close the inside of the discharge tube 46, the controller 48 causes the suction-port opening and closing device 93 to open the inside of the suction-port communicating tube 45. Then, when determining that a predetermined amount of toner 36 is supplied into the feeding tank 41, the controller 48 causes the suction-port opening and closing device 93 to close the inside of the suction-port communicating tube 45. In this case, whether the predetermined amount of toner 36 is supplied into the feeding tank 41 may be determined by detecting the toner amount, or by a predetermined time period having elapsed, the predetermined time period having been determined by an experiment or the like. Otherwise, whether the predetermined amount of toner 36 is supplied into the feeding tank 41 may be determined by measuring the pressure in the negative pressure room 82 after the inside of the suction-port communicating tube 45 is open and then determining whether the pressure difference between the measured pressure and the pressure having been measured before the inside of the suction-port communicating tube 45 is open is greater than the pressure difference previously obtained by conducting experiments or the like.

As described above, by generating the negative pressure in the feeding tank 41 by using the pressure difference between the pressure in the feeding tank 41 and the negative pressure in the negative pressure room 82, it may become possible to suction the toner 36 along with air in the toner container 40 into the feeding tank 41. By suctioning the toner 36 along with air from the toner container 40 into the feeding tank 41 by generating the negative pressure in the feeding tank 41, it becomes possible to feed the toner 36. In other words, in order to suction the toner 36 into the feeding tank 41, the controller 48 performs control to generate the negative pressure. Further, the suction pump 43 to generate the negative pressure in the feeding tank 41 is disposed outside the feeding tank 41. Because of this structure, it may become possible to prevent the heat transfer from the suction pump 43 to the feeding tank 41. Further, the toner 36 is suctioned into the feeding tank 41 by means of the negative pressure. Because of this feature, it may become possible to suction the toner 36 into the feeding tank 41 without grinding toner 36. As a result, it becomes possible to minimize (reduce) the heat stress on toner 36 and feeding toner 36.

Further, while the inside of the discharge tube 46 is closed by the output port opening and closing device 47, the inside of the suction-port communicating tube 45 is open, so as to generate the negative pressure in the feeding tank 41 by using the negative pressure in the negative pressure room 82. Therefore, it may become possible to increase the negative pressure in the feeding tank 41 in a shorter time period. Accordingly, it may become possible to suction more toner 36 into the feeding tank 41 in a short time period and to shorten a time period to suction the toner 36 into the feeding tank 41 and a time period to prepare the suction of the toner 36 into the feeding tank 41. As a result, it may become possible to increase a supply amount of the toner 36 into the developing device 13 per unit time. Actually, according to an experiment, it was possible to suction 1 to 12 g of toner 36 within a single toner supply control.

Further, in the example of the above toner supply control, a state is maintained where the inside of the communicating tube 100 is closed by the negative pressure room opening and closing device 96. However, in the toner supply control, the present invention is not limited to the case where while the inside of the communicating tube 100 is closed, so that the toner 36 in the toner container 40 is supplied (suctioned) into the feeding tank 41. For example, the following control may alternatively be performed.

In another example of the toner supply control, while causing the output port opening and closing device 47 to close the discharge tube 46 (i.e., the output port 50), the controller 48 causes the suction-port opening and closing device 93 to open the inside of the suction-port communicating tube 45. At the same time, the controller 48 further causes the negative pressure room opening and closing device 96 to open the inside of the negative pressure room communicating tube 100, and drives the suction pump 43. After that, when determining a predetermined amount of toner 36 is supplied (suctioned) into the feeding tank 41, the controller 48 stops the driving of the suction pump 43. Further, when stopping the driving of the suction pump 43, the controller 48 causes the suction-port opening and closing device 93 to close the inside of the suction-port communicating tube 45 and the negative pressure room opening and closing device 96 to close the inside of the negative pressure room communicating tube 100. Whether the predetermined amount of toner 36 is supplied (suctioned) into the feeding tank 41 may be determined in the same manner (method) as described above. Therefore, the repeated description herein is omitted.

By performing the toner supply control as described above, in order to generate the negative pressure in the feeding tank 41, it may become possible to use an air suction force generated by the suction pump 43 in addition to the pressure difference between the pressure in the feeding tank 41 and the negative pressure in the negative pressure room 82. By additionally using the air suction force generated by the suction pump 43, when compared with the toner supply control described above, it may become possible to reduce the lowering of the suctioning amount due to the lowering of the negative pressure in the feeding tank 41, and suction more toner 36. Actually, according to an experiment, it was possible to suction 1 to 18 g of toner 36 within a single toner supply control.

Next, FIG. 4 schematically illustrates a result of a comparison which is made between a case where the suction pump 43 is not driven in the toner supply control described first (dotted line) to suction toner and a case where the suction pump 43 is driven in the another example of the toner supply control (solid time) to suction toner. In those two cases, the pressure value in the feeding tank 41 is monitored for a certain period of time. As schematically illustrated in FIG. 4, when compared with the case where the suction pump 43 is not driven, when the suction pump 43 is driven, it is possible to reduce the reduction of the negative pressure value in the feeding tank 41. As a result, according to an experiment, the suctioning amount of the toner 36 into the feeding tank 41 was increased by 5 to 50%.

As described above, by further increasing the supply amount of toner 36 suctioned from the toner container 40 into the feeding tank 41 by additionally using the air suction force generated by the suction pump 43, it may become possible to increase the supply amount of toner 36 into the developing device 13 per unit time without adding new parts and without increasing the cost of the device.

Further, as described in the description of the negative pressure generating control, the controller 48 may start the toner supply control when determining that the negative pressure state in the negative pressure room 82 becomes the predetermined negative pressure state in the negative pressure generating control while the inside of the discharge tube 46 is closed in the toner discharge control. By performing the control in this way, the negative pressure generating control may be started in a state where the inside of the negative pressure room communicating tube 100 is open and the suction pump 43 is being driven. Therefore, in this case, what it necessary when the negative pressure generating control is started is only to open the inside of the suction-port communicating tube 45 by the suction-port opening and closing device 93. Therefore, at least, it may become possible to reduce a time period necessary to start up an air suction when the driving of the suction pump 43 is started. As a result, it may become possible to suction more toner 36 from the toner container 40 into the feeding tank 41. Further, in the negative pressure generating control, it may become possible to reduce a time period necessary to close the inside of the negative pressure room communicating tube 100 by the negative pressure room opening and closing device 96.

Waiting (Wait Control)

Further, after a predetermined amount of toner 36 is supplied (suctioned) into the feeding tank 41 and the toner supply control is finished, for example, it may become necessary to supply toner 36 into the developing device 13. In such a case, it becomes necessary to wait to start the toner discharge control (to transit to the toner discharge control). During the waiting (in the wait control), the controller 48 stops the driving of the suction pump 43, and closes the inside of the suction-port communicating tube 45, the inside of the negative pressure room communicating tube 100, and the inside of the discharge tube 46.

However, in the powder feeding device 35 according to this embodiment of the present invention, it is not always necessary to wait until the toner discharge control is started (the control is transitioned to the toner discharge control). For example, there may be a case where a toner density in the developing device 13 may not become a predetermined density by performing a single cycle of the discharge of the toner 36. In such a case, after the toner supply control is finished, the toner discharge control may be started (the control is transitioned to the toner discharge control) without waiting (without performing the wait control), so that a series of controls are repeated to continuously supply toner 36 to the developing device 13.

Figure 10A:
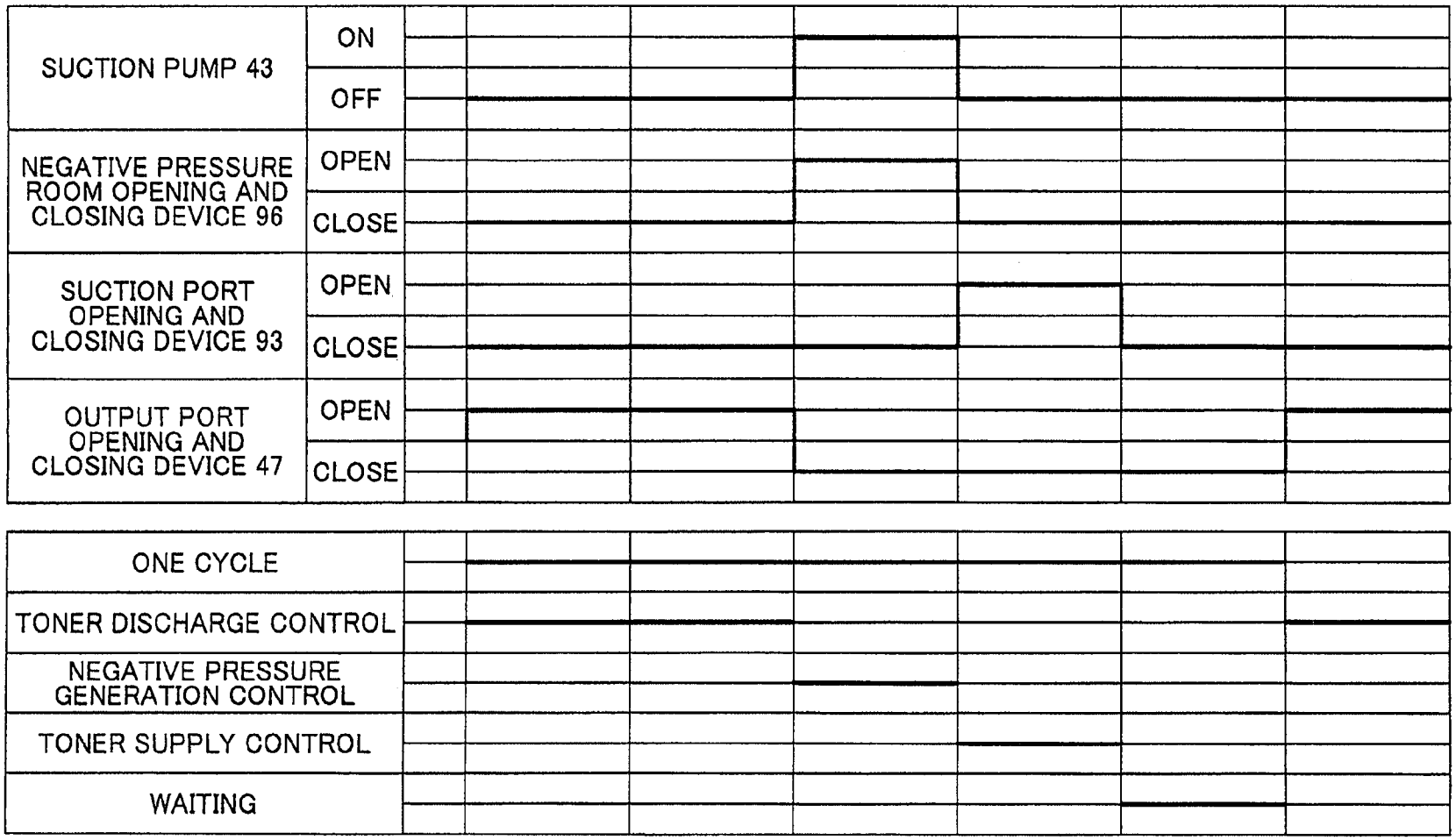
FIG.10A RELATED ART
FIG. 10A is another timing chart under conventional operation control.
Figure 10B:
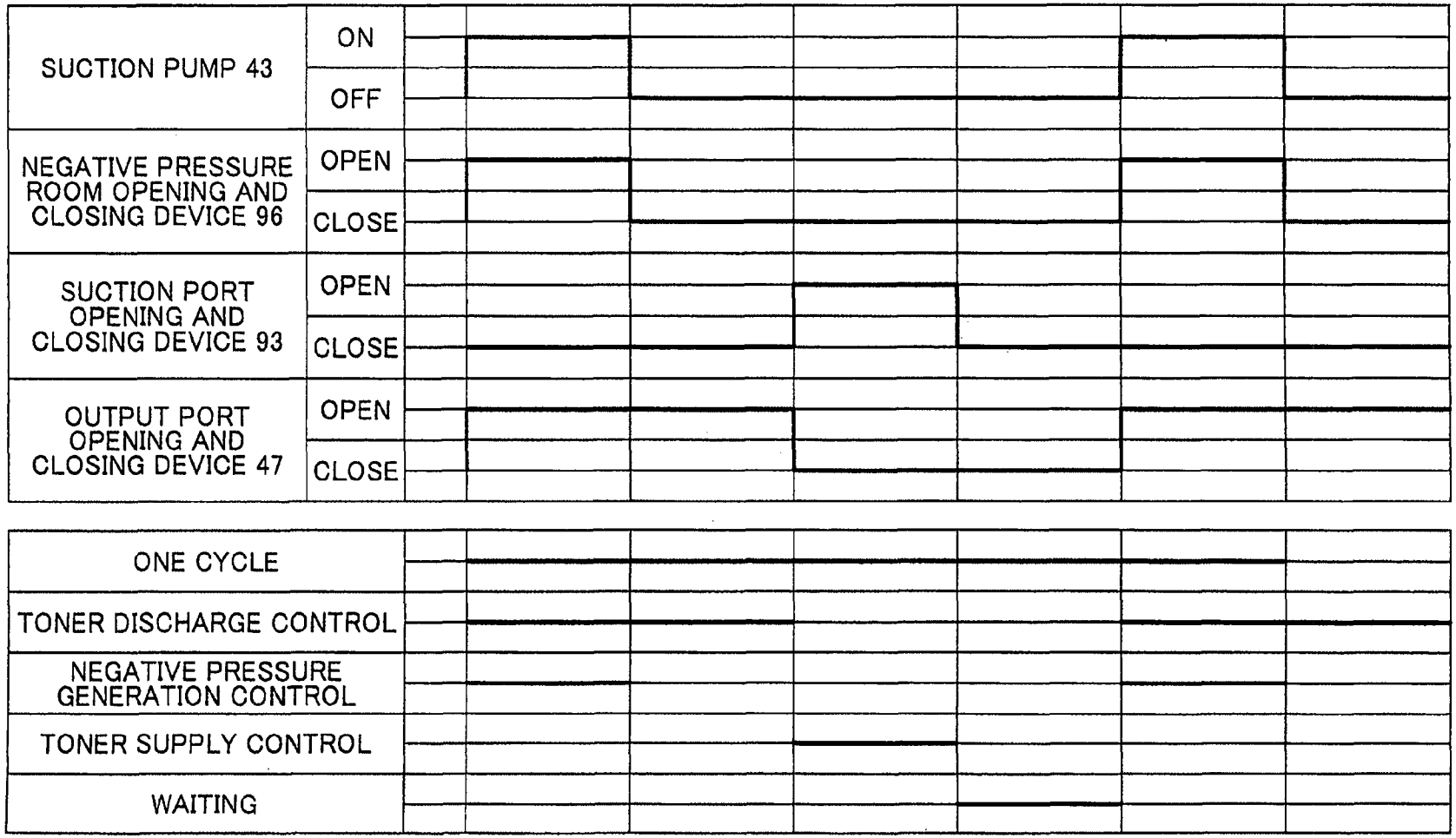
FIG. 10B is another timing chart when toner supply control and negative pressure generation control start at the same time.
Figure 11A:
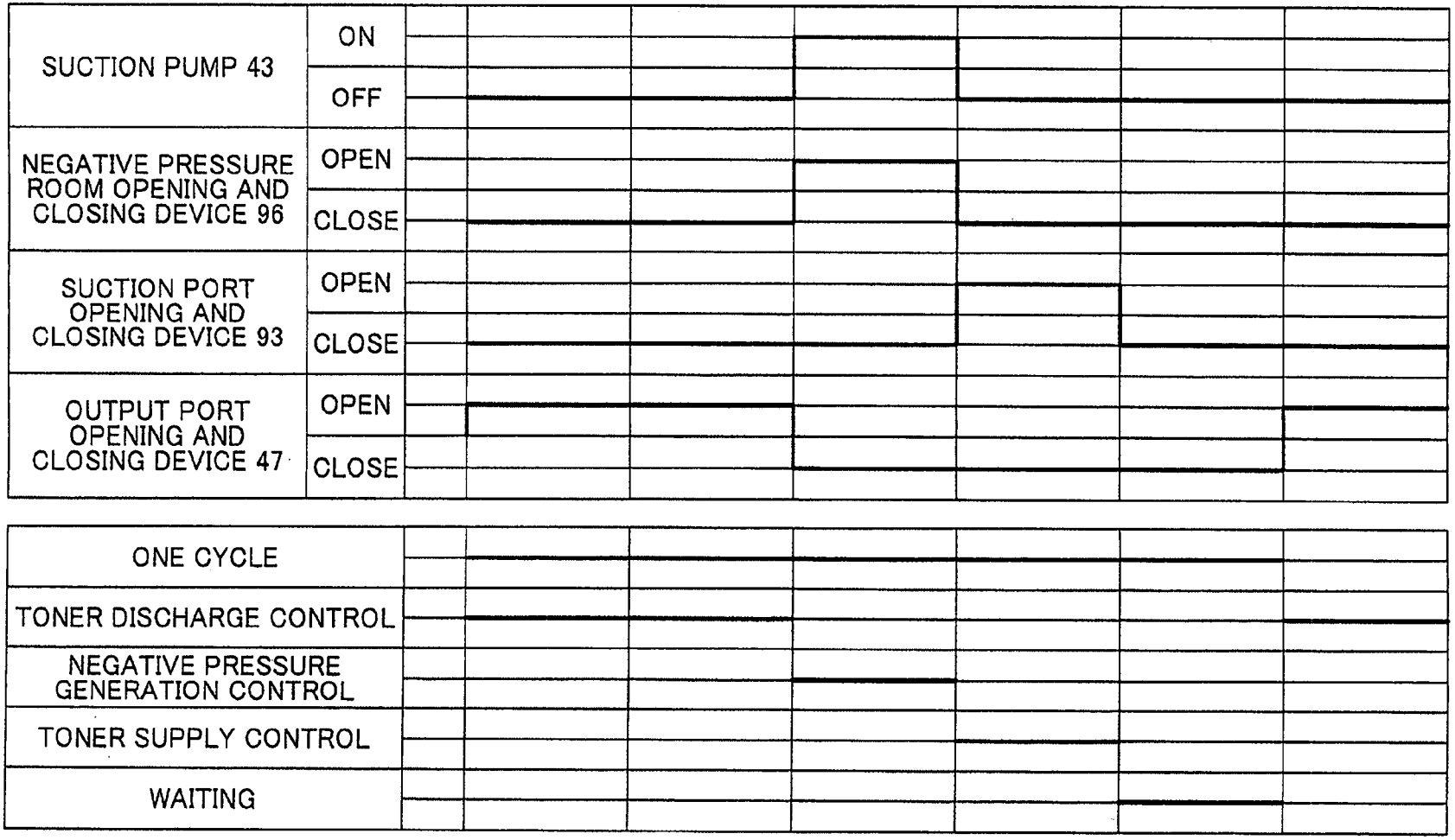
FIG. 11A is another timing chart when the toner supply control is performed when a suction force of a suction pump is also used to increase a negative pressure in the negative pressure room.
Figure 11B:
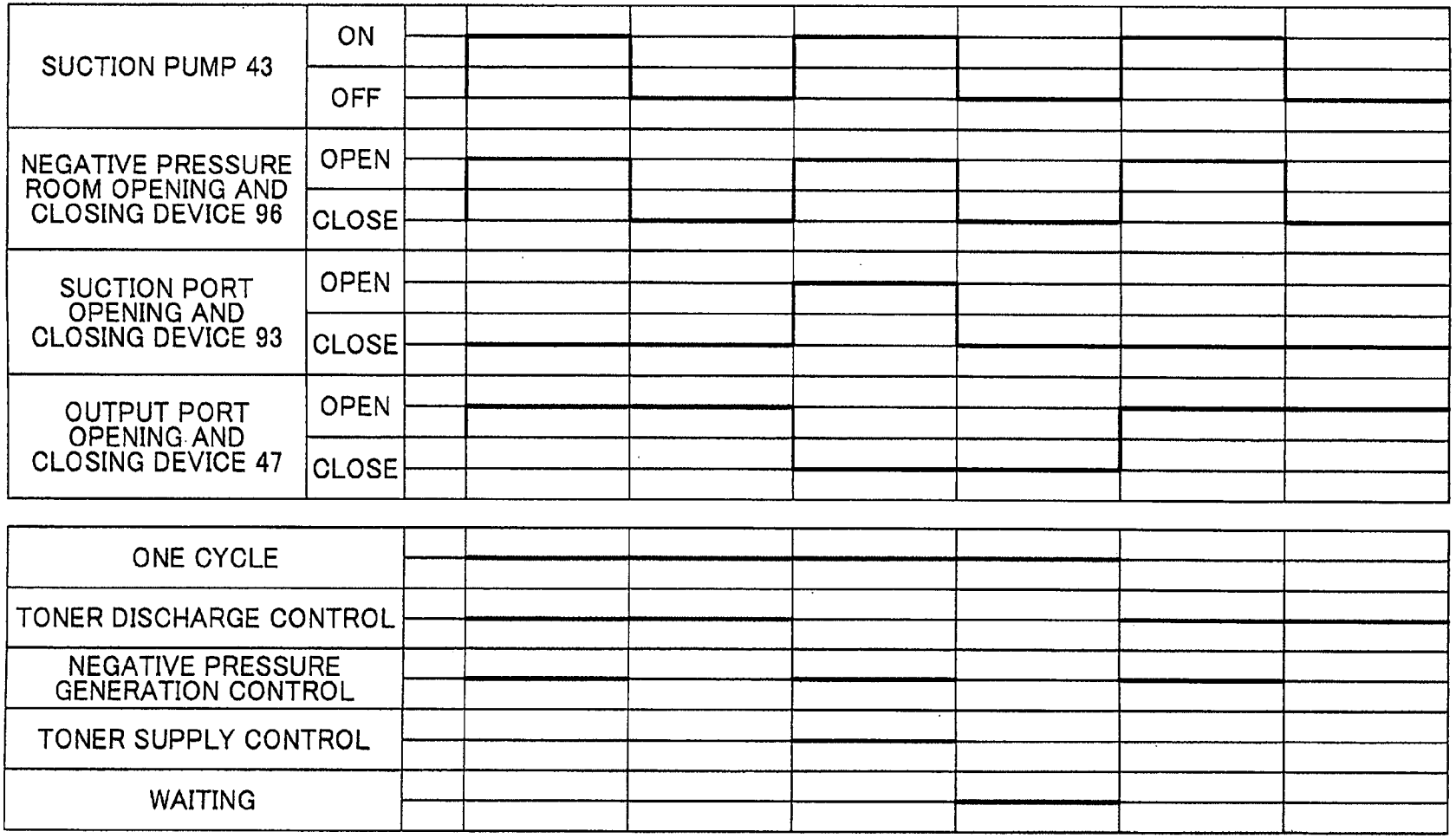
FIG. 11B is another timing chart when the toner supply control and the negative pressure generation control start at the same time and the suction force of the suction pump is also used to increase the negative pressure in the negative pressure room.

Next, with reference to figures, the operations of the control of the related art and the operations of the controls performed by the controller 48 in typical three cases described in the example 4 of the present invention are described. More specifically, those operations are described in detail with reference to the corresponding timing charts illustrating the timings when the opening and closing units open and close and when the pump is driven (ON) and is not driven (OFF). FIG. 10A is a timing chart illustrating a case where conventional control is performed. FIG. 10B is a timing chart illustrating a case where both the toner discharge control and the negative pressure generating control are started at the same time (in the another example of the negative pressure generating control). FIG. 11A is a timing chart illustrating a case where the air suction force generated by the suction pump 43 is additionally used to generate the negative pressure in the feeding tank 41 in the toner supply control (in the another example of the toner supply control). FIG. 11B is a timing chart illustrating a case where both the toner discharge control and the negative pressure generating control are started at the same time and the air suction force generated by the suction pump 43 is additionally used to generate the negative pressure in the feeding tank 41 in the toner supply control (in the another example of the negative pressure generating control combined with the another example of the toner supply control).

In those timing charts, for simplification and explanatory purposes, it is assumed that the conventional toner discharge control and the conventional toner supply control are described in two steps and other controls and waiting are described in one step. Further, it is assumed that the opening and closing units close the corresponding tubes and the suction pump 43 is not started (i.e. OFF) until the toner supply signal instructing the supply of the toner 36 to the developing device 13 is issued (transmitted) to the controller 48.

As illustrated in the timing chart of FIG. 10A, in the conventional control, when the toner supply signal instructing the supply of the toner 36 to the developing device 13 is received, the controller 48 starts the toner discharge control and causes the output port opening and closing device 47 to open the discharge tube 46 (i.e., the output port 50). After two steps, the controller 48 causes the output port opening and closing device 47 to close the discharge tube 46 (i.e., the output port 50) and then starts the negative pressure generating control. In the negative pressure generating control, the controller 48 causes the negative pressure room opening and closing device 96 to open the inside of the negative pressure room communicating tube 100 and drives (turns ON) the suction pump 43. Then, after one step, the controller 48 causes the negative pressure room opening and closing device 96 to close the inside of the negative pressure room communicating tube 100 and stops (turns OFF) the driving of the suction pump 43. Then, the controller 48 starts the toner supply control (transitions to the toner supply control). In the toner supply control, the controller 48 causes the suction-port opening and closing device 93 to open the inside of the suction-port communicating tube 45. Then, after one step, the controller 48 causes the suction-port opening and closing device 93 to close the inside of the suction-port communicating tube 45 and starts waiting (transitions to waiting).

On the other hand, as illustrated in the timing chart of FIG. 10B, in the case where the toner discharge control and the negative pressure generating control are stated at the same time (in the another example of the negative pressure generating control), when the toner supply signal instructing the supply of the toner 36 to the developing device 13 is received, the controller 48 starts the toner discharge control and the negative pressure generating control at the same time. To that end, the controller 48 causes the output port opening and closing device 47 to open the discharge tube 46 (i.e., the output port 50), causes the negative pressure room opening and closing device 96 to open the inside of the negative pressure room communicating tube 100, and drives (turns ON) the suction pump 43. Then, after one step, the controller 48 causes the negative pressure room opening and closing device 96 to close the inside of the negative pressure room communicating tube 100 and stops (turns OFF) the driving of the suction pump 43. After one step, the controller 48 causes the output port opening and closing device 47 to close the discharge tube 46 (i.e., the output port 50), and starts the toner supply control (transitions to the toner supply control). In the toner supply control, the controller 48 causes the suction-port opening and closing device 93 to open the inside of the suction-port communicating tube 45. Then, after one step, the controller 48 causes the suction-port opening and closing device 93 to close the inside of the suction-port communicating tube 45 and starts waiting (transitions to waiting).

As illustrated in the time chart of FIG. 11A, in the case where the air suction force generated by the suction pump 43 is additionally used to generate the negative pressure in the feeding tank 41 in the toner supply control (in the another example of the toner supply control), when the toner supply signal instructing the supply of the toner 36 to the developing device 13 is received, the controller 48 starts the toner discharge control and causes the output port opening and closing device 47 to open the discharge tube 46 (i.e., the output port 50). After two steps, the controller 48 causes the output port opening and closing device 47 to close the discharge tube 46 (i.e., the output port 50), and then starts the negative pressure generating control (transitions to the negative pressure generating control). In the negative pressure generating control, the controller 48 causes the negative pressure room opening and closing device 96 to open the inside of the negative pressure room communicating tube 100 and drives (turns ON) the suction pump 43. Then, after one step, the controller 48 starts the toner supply control (transitions to the toner supply control). In the toner supply control, the controller 48 causes the suction-port opening and closing device 93 to close the inside of the suction-port communicating tube 45, stops (turns OFF) the driving of the suction pump 43, and starts waiting (transitions to waiting).

As illustrated in the time chart of FIG. 11B, in the case where both the toner discharge control and the negative pressure generating control are started at the same time and the air suction force generated by the suction pump 43 is additionally used to generate the negative pressure in the feeding tank 41 in the toner supply control (in the another example of the negative pressure generating control combined with the another example of the toner supply control), when the toner supply signal instructing the supply of the toner 36 to the developing device 13 is received, the controller 48 starts the toner discharge control and the negative pressure generating control at the same time. To that end, the controller 48 causes the output port opening and closing device 47 to open the discharge tube 46 (i.e., the output port 50), causes the negative pressure room opening and closing device 96 to open the inside of the negative pressure room communicating tube 100, and drives (turns ON) the suction pump 43. Then, after one step, the controller 48 causes the negative pressure room opening and closing device 96 to close the inside of the negative pressure room communicating tube 100 and stops (turns OFF) the driving of the suction pump 43. After one step, the controller 48 causes the output port opening and closing device 47 to close the discharge tube 46 (i.e., the output port 50) and starts the toner supply control (transitions to the toner supply control). In the toner supply control, the controller 48 causes the negative pressure room opening and closing device 96 to open the inside of the negative pressure room communicating tube 100, causes the suction-port opening and closing device 93 to open the inside of the suction-port communicating tube 45, and drives (turns ON) the suction pump 43. After one step, the controller 48 causes the negative pressure room opening and closing device 96 to close the inside of the negative pressure room communicating tube 100, causes the suction-port opening and closing device 93 to close the inside of the suction-port communicating tube 45, stops (turns OFF) the driving of the suction pump 43, and starts waiting (transitions to waiting).

EXAMPLE 5

Figure 12:
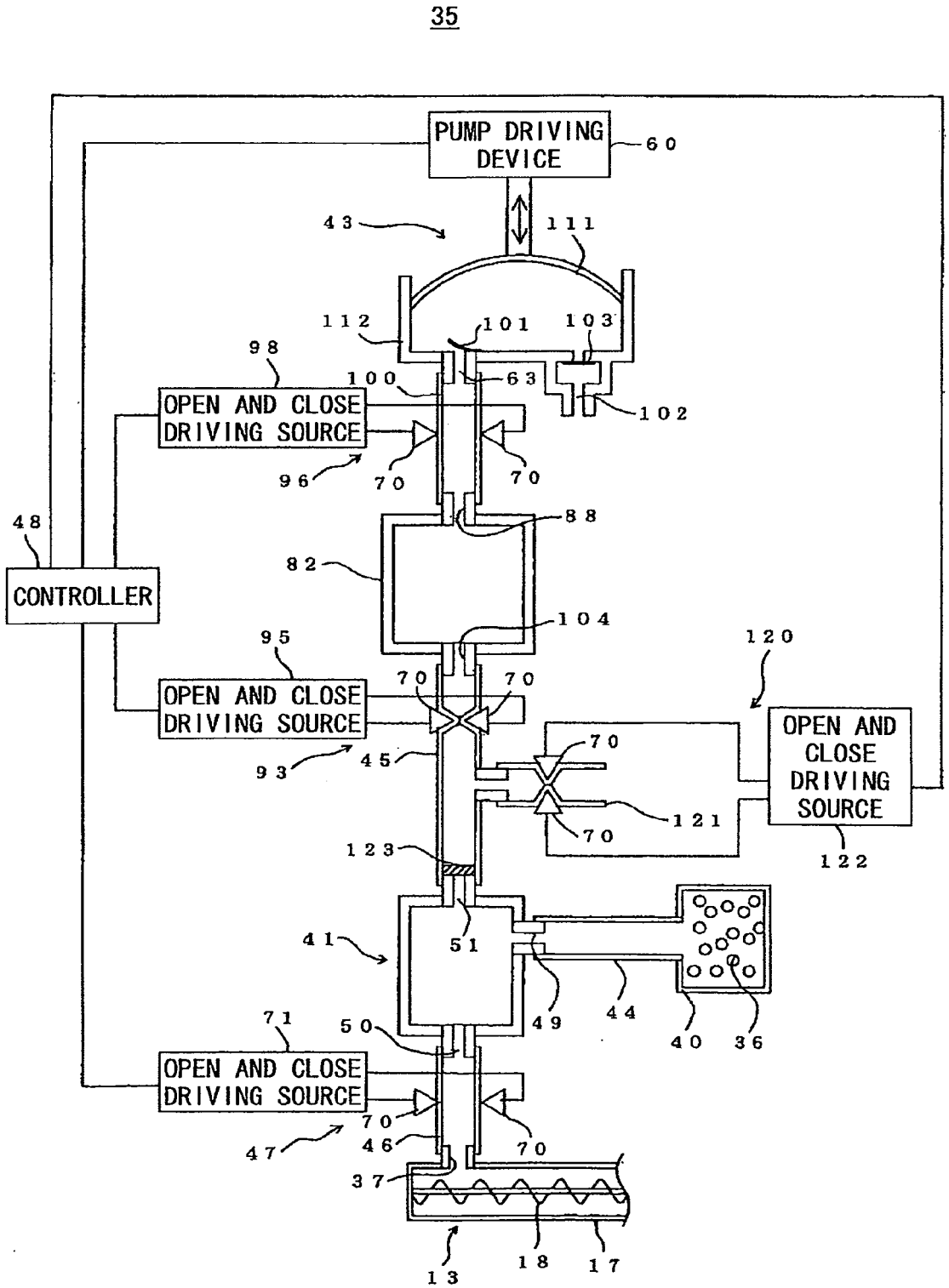
FIG. 12 is a drawing illustrating a configuration of a powder feeding device according to a fifth example of the present invention.
Figure 13:
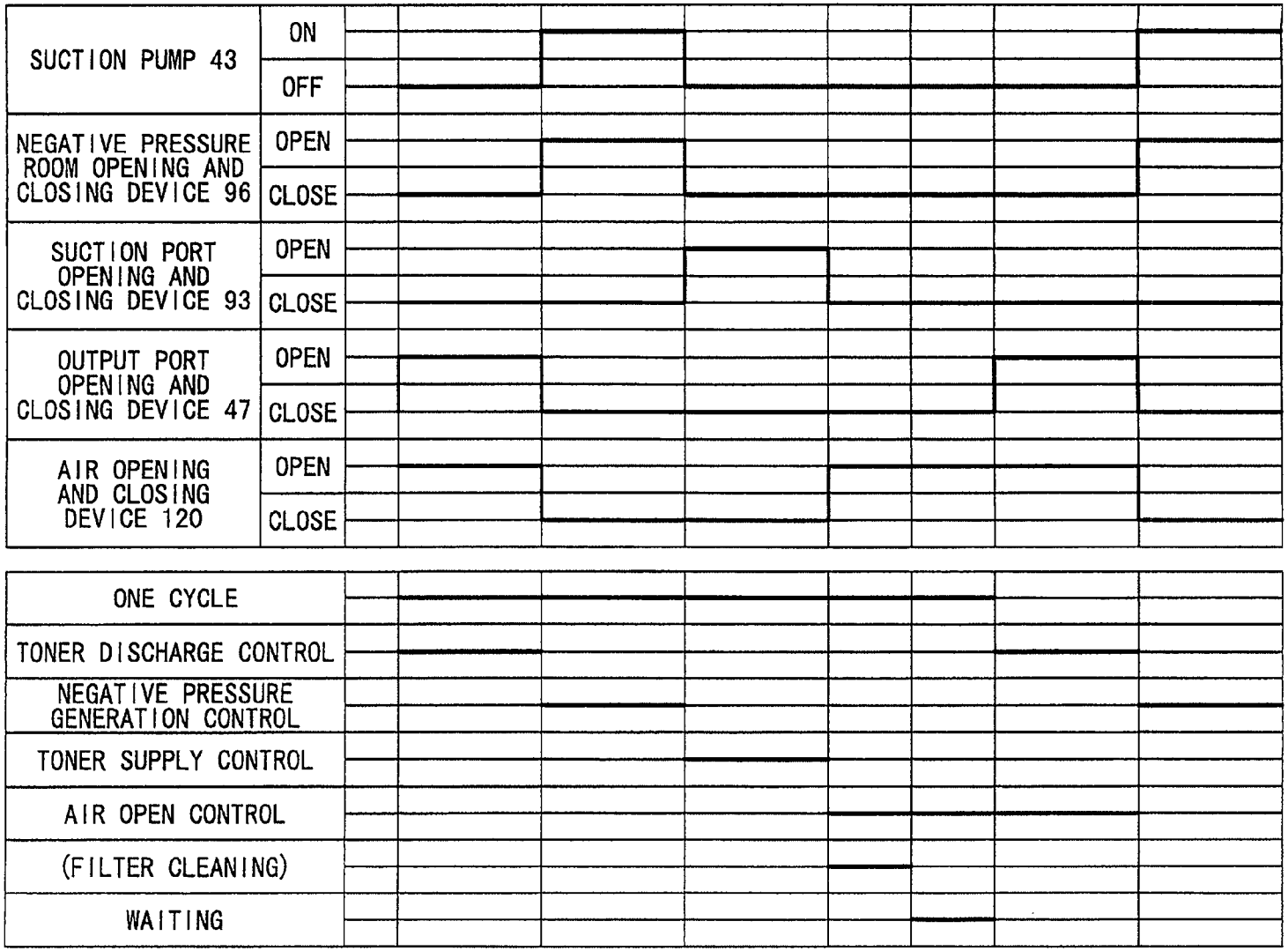
FIG. 13 is a timing chart of the operations according to the fifth example of the present invention.

An example 5 of the powder feeding device 35 in an image forming apparatus according to an embodiment of the present invention is described with reference to FIGS. 12 and 13. As illustrated in FIG. 12, the powder feeding device 35 of this example 5 includes a toner container 40 as a powder container, the feeding tank 41, the suction pump 43 as the gas suctioning device, the negative pressure room 82, the plumbing 44, the suction-port communicating tube 45, the negative pressure room communicating tube 100, the discharge tube 46, the output port opening and closing device 47, the suction-port opening and closing device 93, the negative pressure room opening and closing device 96, and the controller 48. The controller 48 collectively controls the operations of the powder feeding device 35. Further, the powder feeding device 35 of this example 5 includes a filter 123, an air communicating tube 121, and an air opening and closing device 120. The filter 123 is provided in the suction-port communicating tube 45 so as to cover the suction port 51 of the feeding tank 41, the suction port 51 being connected with the suction-port communicating tube 45. The air communicating tube 121 is in communication with the suction-port communicating tube 45 at a position between the filter 123 and the suction-port opening and closing device 93 which opens and closes the inside of the suction-port communicating tube 45.

First, an exemplary configuration of the powder feeding device 35 according to this embodiment of the present invention is described. Herein, elements (devices) except for the controller 48 of the powder feeding device 35 are arranged from the upper to lower ends in the vertical direction and sequentially connected as described below. The suction pump 43 is in communication with the negative pressure room 82 via the negative pressure room communicating tube 100. The negative pressure room 82 is in communication with the feeding tank 41 via the suction-port communicating tube 45. The air communicating tube 121 is fixed to the suction-port communicating tube 45, so that the air communicating tube 121 is in communication with the suction-port communicating tube 45. A side surface of the feeding tank 41 is in communication with the toner container 40 via the plumbing 44. Further, the feeding tank 41 is in communication with a container tank 17 of the developing device 13 via the discharge tube 46. In the following, the configurations of the elements (devices) are described in the order of the arrangement.

As the suction pump 43, any appropriate pump may be used as long as the pump may sufficiently suction necessary air (gas) (hereinafter may be referred to as only "air"). In this example, the diaphragm pump (diaphragm type pump) is used. Namely, the suction pump 43 is the diaphragm pump (diaphragm type pump) and includes the pump container 112, the diaphragm 111, and the pump driving device 60. The pump container 112 includes the bottom part where the pump suction port 63 and the pump discharge port 102 are formed. Further, the suction side valve 101 and the discharge side valve 103 are provided so as to open and close the pump suction port 63 and the pump discharge port 102, respectively. More specifically, the suction side valve 101 is provided on the pump suction port 63 in a manner that one end side of the suction side valve 101 is fixed to the pump container 112 and the suction side valve 101 covers the upper part of the pump suction port 63 of the pump container 112. By having this structure, only when air (gas) (hereinafter may be only referred to as "air") flows into the pump container 112, the other end side of the suction side valve 101 is deformed upward to open the suction side valve 101 (i.e., the pump suction port 63). On the other hand, the discharge side valve 103 is provided inside the widening part that is inside the pump discharge port 102 and that is formed under the bottom part of the pump container 112. Further, the discharge side valve 103 is provided on the pump discharge port 102 in a manner that one end side of the discharge side valve 103 is fixed to the pump container 112 and the discharge side valve 103 covers an upper hole of the pump discharge port 102 of the pump container 112 from underneath. Further, only when air flows from the pump container 112, the other end side of the discharge side valve 103 is deformed downward to open the discharge side valve 103 (i.e., pump discharge port 102). Under the control of the controller 48, the suction pump 43 is driven to suction air through the pump suction port 63 and discharge air through the pump discharge port 102 by causing the diaphragm 111 to perform a back-and-forth movement by the pump driving device 60. Herein, it is assumed that the maximum flow rate and the maximum vacuum degree of the suction pump 43 is 1 to 8 liters/min and −20 to −80 kPa, respectively. Further, the diaphragm pump is generally used in various applications and includes a limited number of parts only as described above. Therefore, the purchasing cost is low and manufacturing cost would also be low. When the diaphragm pump is used, since the there is only a limited sliding part in the diaphragm pump. Therefore, a longer service lifetime may be obtained.

The negative pressure room communicating tube 100 is made of an elastic member such as rubber and is formed in a tube shape. One end of the negative pressure room communicating tube 100 is fixed to the wall around the pump suction port 63 formed on the bottom part of the suction pump 43. The other end of the negative pressure room communicating tube 100 is fixed to the wall around the through hole 88 formed on the upper part of the negative pressure room 82. By fixing in this way, the negative pressure room communicating tube 100 provides communication between the suction pump 43 and the negative pressure room 82. The negative pressure room communicating tube 100 is equipped with the negative pressure room opening and closing device 96 which opens and closes the inside of the negative pressure room communicating tube 100 as the negative pressure room opening and closing unit.

The negative pressure room opening and closing device 96 includes the pair of clamping members 70 provided in a manner that the clamping members 70 can approach and separate from each other, and the open and close driving source 98 as the opening and closing unit. The pair of clamping members 70 are disposed (provided) in a manner that the middle of the negative pressure room communicating tube 100 is sandwiched by the pair of clamping members 70. The negative pressure room opening and closing device 96 (open and close driving source 98) causes the pair of clamping members 70 to approach and separate from each other. When the pair of clamping members 70 approach each other, the pair of clamping members 70 squeeze (clampingly engage) the negative pressure room communicating tube 100 between the pair of clamping members 70 so as to close the inside (block the air flow) of the negative pressure room communicating tube 100. On the other hand, when the pair of clamping members 70 are separated from each other, the pair of clamping members 70 open the inside of the negative pressure room communicating tube 100 (to provide the communication between the suction pump 43 and the negative pressure room 82). By doing this, the open and close driving source 98 opens and closes the inside of the negative pressure room communicating tube 100 (to block and provide communication between the suction pump 43 and the negative pressure room 82). Further, the suction-port opening and closing device 93, the air opening and closing device 120, and the output port opening and closing device 47 have the same configuration as that of the above-described negative pressure room opening and closing device 96. Therefore, the open and close driving source 95 of the suction-port opening and closing device 93 opens and closes the inside of the suction-port communicating tube 45. An open and close driving source 122 opens and closes the inside of the air communicating tube 121. The open and close driving source 71 of the output port opening and closing device 47 opens and closes the inside of the discharge tube 46. Further, the controller 48 controls the opening and closing operations of those opening and closing units (i.e., the negative pressure room opening and closing device 96, the suction-port opening and closing device 93, and the output port opening and closing device 47).

The negative pressure room 82 has the upper part where the through hole 88 is formed. Through the through hole 88 and the negative pressure room communicating tube 100, the negative pressure room 82 is in communication with the suction pump 43. On the other hand, the negative pressure room 82 has the bottom part where the through hole 104 is formed. Through the through hole 104 and the suction-port communicating tube 45, the negative pressure room 82 is in communication with the feeding tank 41. The capacity of the negative pressure room 82 is 20 to 300 cc. When the suction pump 43 is driven and then the negative pressure room communicating tube 100 and the suction-port communicating tube 45 are closed by the respective opening and closing units, the negative pressure is generated in the negative pressure room 82. The negative pressure room 82 is provided so as to hold the generated negative pressure in the negative pressure room 82 until the negative pressure room communicating tube 100 or the suction-port communicating tube 45 is open.

The suction-port communicating tube 45 is made of an elastic member such as rubber and is formed in a tube shape. One end of-the suction-port communicating tube 45 is fixed to the wall around the through hole 104 formed on the bottom part of the negative pressure room 82. The other end of the suction-port communicating tube 45 is fixed to the wall around the suction port 51 formed on the upper part of the feeding tank 41. By fixing in this way, the suction-port communicating tube 45 provides communication between the negative pressure room 82 and the feeding tank 41. The suction-port communicating tube 45 is equipped with the suction-port opening and closing device 93 which opens and closes the inside of the suction-port communicating tube 45 as a suction-port opening and closing unit. Further, the suction-port communicating tube 45 is fixed with (in communication with) the suction-port communicating tube 45 at the position between the suction-port opening and closing device 93 and the filter 123 provided at the suction port 51. As described above, the suction-port opening and closing device 93 has the same configuration as that of the negative pressure room opening and closing device 96. The controller 48 controls the opening and closing operations of the suction-port opening and closing device 93.

The air communicating tube 121 is made of an elastic member such as rubber and is formed in a tube shape. Further, as described above, one end of the air communicating tube 121 is connected to the suction-port communicating tube 45 at the position between the suction-port opening and closing device 93 and the filter 123 provided at the suction port 51. The other end of the air communicating tube 121 is open to air. Further, the air communicating tube 121 is equipped with the air opening and closing device 120 which opens and closes the inside of the air communicating tube 121.

The feeding tank 41 has the upper part where the suction port 51 is formed. Through the suction port 51 and the suction-port communicating tube 45, the feeding tank 41 is in communication with the negative pressure room 82. Further, the feeding tank 41 has a side part where the input port 49 is formed. Through the input port 49 and the plumbing 44, the feeding tank 41 is in communication with the toner container 40. Further, the feeding tank 41 has the bottom part where the output port 50 is formed. Through the output port 50 and the discharge tube 46, the feeding tank 41 is in communication with the container tank 17 of the developing device 13. A negative pressure in the feeding tank 41 is generated based on a pressure difference between the inside of the feeding tank 41 and the inside of the negative pressure room 82. By using the negative pressure generated in the feeding tank 41, the toner 36 contained in the toner container 40 is suctioned into the feeding tank 41. Then, the feeding tank 41 supplies the toner 36 to the container tank 17 of the developing device 13 through the output port 50 of the feeding tank 41. Further, the filter 123 is provided on the upper part of the suction port 51. The filter 123 has mesh having a size less than the diameter of the toner 36, so that the filter 123 prevents toner from passing through the filter 123 and permits air passing through the filter 123. By using the filter 123, the toner 36 is prevented from being absorbed into the suction pump 43. Therefore, it may become possible to eliminate the direct contact between the toner 36 and the suction pump 43. Therefore, it may become possible to prevent the toner 36 from being attached to the suction pump 43. As a result, it may become possible to prevent the failure or trouble of the suction pump 43 due to the toner 36 attached to the suction pump 43. Accordingly, it may become possible to reduce the power to drive the suction pump 43 and obtain a longer service lifetime of the suction pump 43.

The plumbing 44 is made of an elastic member such as rubber and is formed in a tube shape, so as to provide (form) a feed path through which toner 36 flows. One end of the plumbing 44 is fixed to the wall around the input port 49 formed on the side part of the feeding tank 41. The other end of the plumbing 44 is integrally formed with the toner container 40.

The toner container 40 has an internal space which is sealed from the outside air. The internal space of the toner container 40 (hereinafter simplified as toner container 40) contains toner 36. The toner container 40 is in communication with the feeding tank 41 via the plumbing 44 and the input port 49. The toner 36 in the toner container 40 is supplied to the feeding tank 41 by being suctioned along with air in the toner container 40 by using a pressure difference between the negative pressure in the negative pressure room 82 and the pressure in the feeding tank 41. Then, the toner 36 suctioned into the feeding tank 41 is discharged to the container tank 17 of the developing device 13 through the output port 50 of the feeding tank 41.

The discharge tube 46 is made of an elastic member such as rubber and is formed in a tube shape. One end of the discharge tube 46 is fixed to the wall around the output port 50 formed on the bottom part of the feeding tank 41. The other end of the discharge tube 46 is fixed to the wall around the supply hole 37 formed on the upper part of the container tank 17 of the developing device 13. By fixing in this way, the discharge tube 46 provides communication between the feeding tank 41 and the container tank 17 of the developing device 13. The discharge tube 46 is equipped with the output port opening and closing device 47 which opens and closes the inside of the discharge tube 46 as an output port opening and closing unit. As described above, the output port opening and closing device 47 has the same configuration as that of the negative pressure room opening and closing device 96. The controller 48 controls the opening and closing operations of the output port opening and closing device 47.

Herein, there are two container tanks that are in the developing device 13 and that mix and feed the developer. The container tank 17 of the developing device 13 is one of the two container tanks and has the upper part where the supply hole 37 is formed. The supply hole 37 is provided so that the toner is supplied from the feeding tank 41 to the container tank 17 of the developing device 13 through the supply hole 37 and the discharge tube 46. In the container tank 17 of the developing device 13, the mixing screw 18 is provided.

The controller 48 is a computer including a RAM (Random Access Memory), a ROM (Read Only Memory), a CPU (Central Processing Unit) and the like. The controller 48 is electrically connected to the pump driving device 60 of the suction pump 43, the open and close driving source 98 f the negative pressure room opening and closing device 96, the open and close driving source 95 of the suction-port opening and closing device 93, the open and close driving source 71 of the output port opening and closing device 47, and the open and close driving source 122 of the air opening and closing device 120. Further, the controller 48 communicates with a controller (not shown) of the image forming apparatus including the powder feeding device according to an embodiment of the present invention, so that a control signal and the like can be mutually transmitted between the controller 48 and the controller of the image forming apparatus. For example, based on a toner supply signal that is transmitted from the controller of the image forming apparatus and that instructs the supply of the toner 36 to the developing device 13 and based on the detection results by the sensors, the controller 48 controls the operations of the powder feeding device 35 by collectively controlling the elements (devices) of the powder feeding device 35. Further, in this embodiment, a case is described where the controller 48 is included in the powder feeding device 35. However, the present invention is not limited to this configuration. For example, the controller 48 may be integrated (included) in the controller of the image forming apparatus including the powder feeding device 35. Further, the controller 48 may be disposed at any position as long as, for example, the controller 48 can be easily mounted and maintained and the environmental conditions including temperature condition are suitable (satisfied).

Next, the operations of the powder feeding device 35 according to this example of the present invention are described by referring to the controls performed by the controller 48. The control operations performed by the controller 48 includes four control operations, which are negative pressure generating control, toner supply control, air open control, and toner discharge control. The negative pressure generating control refers to a control of generating a negative pressure in the negative pressure room 82. The toner supply control refers to a control of supplying toner 36 from the toner container 40 to the feeding tank 41. The air open control refers to a control of opening the feeding tank 41 to the air and cleaning the filter 123. The toner discharge control refers to a control of discharging the toner 36 from the feeding tank 41 to the container tank 17 of the developing device 13. In the powder feeding device 35, a series of those operations is repeatedly performed. Further, in actual operating control, when the control is to be changed from one to another, there may be a case where waiting (wait control) is performed between two controls. In the following descriptions, it is assumed that toner 36 has been already supplied into the feeding tank 41 and that the toner supply signal instructing the supply of the toner 36 to the developing device 13 is already issued (received by the controller 48). Namely, the following controls are based on the above assumptions.

Toner Discharge Control

In the toner discharge control, in order to discharge the toner 36 from the feeding tank 41 to the container tank 17 of the developing device 13 in the powder feeding device 35, the controller 48 performs the following control. As illustrated in the timing chart of FIG. 13, the controller 48 causes the output port opening and closing device 47 to open the inside of the discharge tube 46 to discharge (supply) the toner 36 from the output port 50 of the feeding tank 41 to the container tank 17 of the developing device 13 through the opened discharge tube 46. When determining that the toner 36 supplied from the toner container 40 into the feeding tank 41 is fully discharged from the output port 50 or that a toner density in the developing device 13 reaches a predetermined value (density), the controller 48 causes the output port opening and closing device 47 to close the inside of the discharge tube 46.

Negative Pressure Generating Control

In the negative pressure generating control, in order to generate a predetermined negative pressure state in the negative pressure room 82 in the powder feeding device 35, the controller 48 performs the following control. As illustrated in the timing chart of FIG. 13, the controller 48 causes the suction-port opening and closing device 93 to close the inside of the suction-port communicating tube 45 and causes the negative pressure room opening and closing device 96 to open the inside of the negative pressure room communicating tube 100. Under this state, the controller 48 drives the suction pump 43. By driving the suction pump 43, air in the negative pressure room 82 is suctioned to generate a negative pressure in the negative pressure room 82. When the negative pressure state in the negative pressure room 82 becomes a predetermined negative pressure state, for example, when the pressure in the negative pressure room 82 becomes in a range from −20 kPa to −60 kPa, the controller 48 stops driving the suction pump 43 and causes the negative pressure room opening and closing device 96 to close the inside of the negative pressure room communicating tube 100. Further, whether the negative pressure state in the negative pressure room 82 becomes a predetermined negative pressure state may be determined by measuring the pressure in the negative pressure room 82 or by previously obtaining a time period necessary for becoming the predetermined negative pressure state and determining whether the obtained time period has been elapsed.

As described above, a negative pressure in the negative pressure room 82 is generated while the inside of the suction-port communicating tube 45 is closed. Therefore, air only in the negative pressure room 82 is suctioned without suctioning the toner 36. As a result, it may become possible to increase the negative pressure in the negative pressure room 82 in a shorter time period. Further, when the pressure in the negative pressure room 82 becomes the predetermined negative pressure state, the controller 48 may perform control to stop driving the suction pump 43, close the inside of the suction-port communicating tube 45, and close the inside of the negative pressure room communicating tube 100. As a result, it may become possible to prevent the inflow and outflow of air of the negative pressure room 82.

Toner Supply Control

In the toner supply control, in order to supply the toner 36 from the toner container 40 into the feeding tank 41, the controller 48 performs the following control. As illustrated in the timing chart of FIG. 13, while causing the output port opening and closing device 47 to close the inside of the discharge tube 46 and causing the air opening and closing device 120 to close the air communicating tube 121, the controller 48 causes the suction-port opening and closing device 93 to open the inside of the suction-port communicating tube 45. By controlling in this way, air in the feeding tank 41 is suctioned and 1 to 18 g of toner 36 is suctioned from the toner container 40 into the feeding tank 41. In this case, the pressure in the feeding tank 41 is from −1 kPa to 50 kPa. Then, when determining that a predetermined amount of toner 36 is supplied into the feeding tank 41, the controller 48 causes the suction-port opening and closing device 93 to close the inside of the suction-port communicating tube 45. In this case, whether the predetermined amount of toner 36 is supplied into the feeding tank 41 may be determined by detecting the toner amount, or by a predetermined time period has elapsed, the predetermined time period having been determined by an experiment or the like. Otherwise, whether the predetermined amount of toner 36 is supplied into the feeding tank 41 may be determined by measuring the pressure in the negative pressure room 82 after the inside of the suction-port communicating tube 45 is open and then determining whether the pressure difference between the measured pressure and the pressure having been measured before the inside of the suction-port communicating tube 45 is open is greater than the pressure difference previously obtained by conducting experiments or the like. Further, whether the predetermined amount of toner 36 is supplied into the feeding tank 41 may be determined by measuring the pressure in the feeding-tank 41 after the inside of the suction-port communicating tube 45 is open and then determining whether the pressure reaches a predetermined negative pressure which has been determined based on an experiment or the like in advance.

As described above, by generating the negative pressure in the feeding tank 41 by using the pressure difference between the pressure in the feeding tank 41 and the negative pressure in the negative pressure room 82, it may become possible to suction the toner 36 along with air in the toner container 40 into the feeding tank 41. By suctioning the toner 36 along with air from the toner container 40 into the feeding tank 41 by generating the negative pressure in the feeding tank 41, it becomes possible to feed the toner 36. In other words, in order to suction the toner 36 into the feeding tank 41, the controller 48 performs control to generate the negative pressure. Further, the suction pump 43 to generate the negative pressure in the feeding tank 41 is disposed outside the feeding tank 41. Because of this structure, it may become possible to prevent the heat transfer from the suction pump 43 to the feeding tank 41. Further, the toner 36 is suctioned into the feeding tank 41 by means of the negative pressure. Because of this feature, it may become possible to suction the toner 36 into the feeding tank 41 without grinding toner 36. As a result, it becomes possible to minimize (reduce) the heat stress on toner 36 and feeding toner 36.

Further, while the inside of the discharge tube 46 is closed by the output port opening and closing device 47, the inside of the suction-port communicating tube 45 is open, so as to generate the negative pressure in the feeding tank 41 by using the negative pressure in the negative pressure room 82. Therefore, it may become possible to increase the negative pressure in the feeding tank 41 in a shorter time period. Therefore, when compared with a case where the suction pump 43 is used to directly suction air in the feeding tank 41, it may become possible to increase a flow rate of the suctioned air and suction a large amount of toner 36 into the feeding tank 41 in a shorter time period. As a result, the powder feeding device 35 according to this example of the present invention may more appropriately be applied to an image forming apparatus having a higher printing speed that requires a larger amount of toner consumption amount per unit time.

Air Open Control

In the air open control, while causing the suction-port opening and closing device 93 to close the inside of the suction-port communicating tube 45, the controller 48 causes the air opening and closing device 120 to open the air communicating tube 121. By controlling in this way, based on the pressure difference between the atmosphere and the pressure in the feeding tank 41, it may become possible to supply (generate) sufficient air flow in the direction from the air open side of the air communicating tube 121 to the suction port 51 of the feeding tank 41 to clean the filter 123. Further, by supplying the sufficient air flow to the suction port 51 to clean the filter 123, it may become possible to remove the toner 36 adhered to the filter 123. As a result, with a minimum element that can be manufactured in low cost, it may become possible to obtain a longer service lifetime of the filter 123. Further, when the toner 36 adhered to the filter 123 is removed, the controller 48 changes (transitions) to the wait control or the toner discharge control. Herein, whether the toner 36 adhered to the filter 123 can be removed may be determined by whether a predetermined time period which has-been determined in an experiment or the like has elapsed. Further, whether the toner 36 adhered to the filter 123 can be removed may be determined by measuring the pressure after the inside of the air communicating tube 121 is closed and then determining whether a pressure difference between the measured pressure after the inside of the air communicating tube 121 is closed and the pressure having been measured before the inside of the air communicating tube 121 is open exceeds the pressure difference determined by an experiment or the like. Further, whether the toner 36 adhered to the filter 123 can be removed may be determined by measuring the pressure in the feeding tank 41 and then determining whether the measured pressure becomes the atmospheric pressure.

Figure 14:
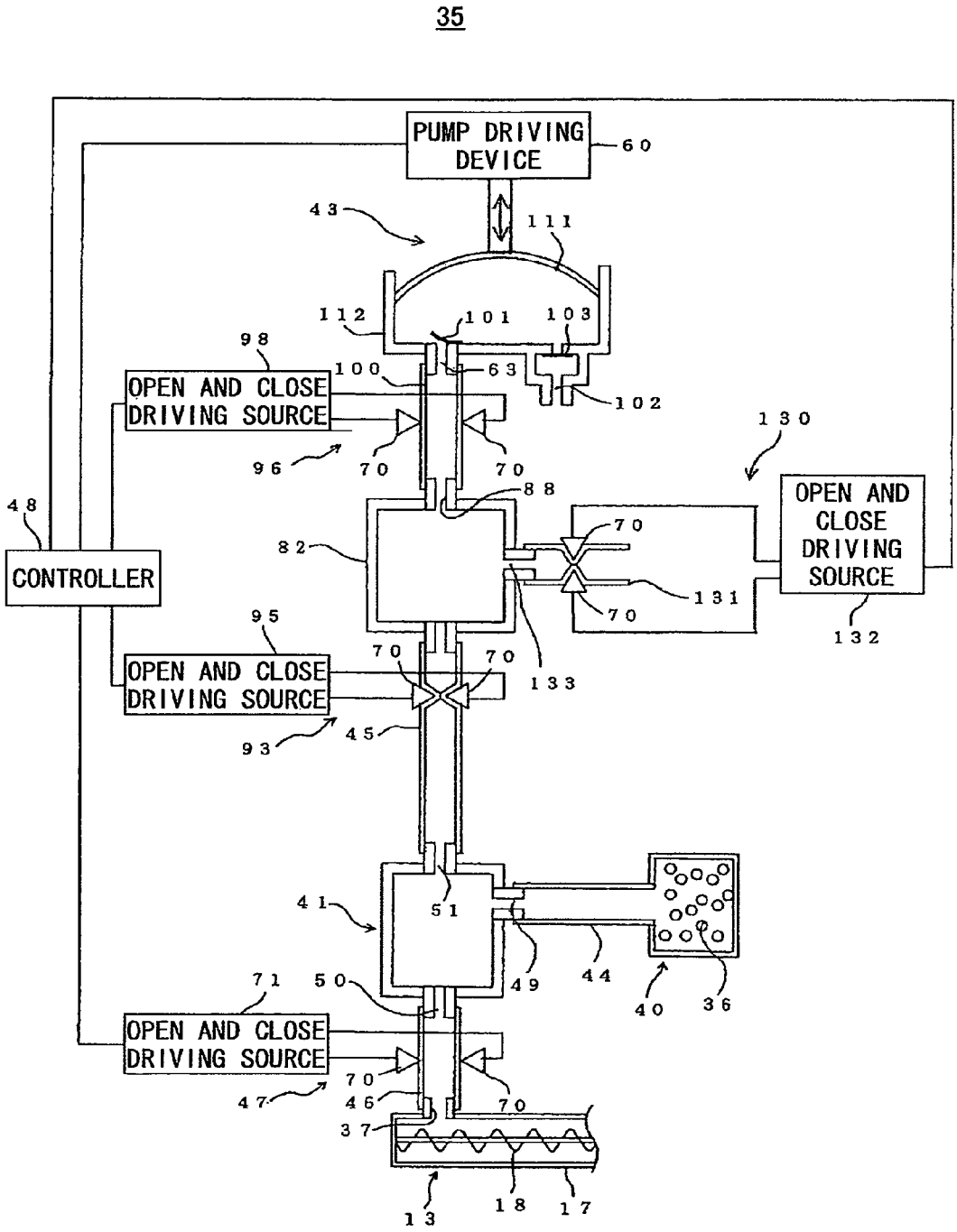
FIG. 14 is a drawing illustrating a configuration of a powder feeding device according to a sixth example of the present invention.

Further, as illustrated in the time chart of FIG. 14, even after the toner 36 adhered to the filter 123 is removed, a state where the inside of the air communicating tube 121 is open by the air opening and closing device 120 may be maintained, and upon the completion of the toner discharge control the inside of the air communicating tube 121 may be closed by the air opening and closing device 120. By controlling in this way, it may become possible to have the air flow when toner 36 is discharged to the outside air through the air communicating tube 121. As a result, it may become possible to more smoothly discharge the toner 36. However, when there may be a possibility of scattering toner 36 to the outside depending on the shape of the feeding tank 41, the position where the air communicating tube 121 is connected (fixed) or the like, it is preferable to close the inside of the air communicating tube 121 by the air opening and closing device 120 when determining that the toner 36 adhered to the filter 123 is removed.

Waiting (Wait Control)

Further, after determining that the toner 36 adhered to the filter 123 is removed, it may become necessary to supply toner 36 into the developing device 13. In such a case, it becomes necessary to wait to start the toner discharge control (to transit to the toner discharge control). During the waiting (in the wait control), the controller 48 closes the inside of the suction-port communicating tube 45 and the inside of the discharge tube 46.

However, in the powder feeding device 35 according to this embodiment of the present invention, it is not always necessary to wait until the toner discharge control is started (the control is transitioned to the toner discharge control). For example, there may be a case where a toner density in the developing device 13 may not become a predetermined density by performing a single cycle of the discharge of the toner 36. In such a case, after the toner supply control is finished, the toner discharge control may be started (the control is transitioned to the toner discharge control) without waiting (without performing the wait control), so that a series of controls are repeated to continuously supply toner 36 to the developing device 13.

EXAMPLE 6

An example 6 of the powder feeding device 35 in an image forming apparatus according to an embodiment of the present invention is described with reference to FIG. 14. As illustrated in FIG. 14, the powder feeding device 35 of this example 6 includes the toner container 40 as the powder container, the feeding tank 41, the suction pump 43 as the gas suctioning device, the negative pressure room 82, the plumbing 44, the suction-port communicating tube 45, the negative-pressure room communicating tube 100, the discharge tube 46, the output port opening and closing device 47, the suction-port opening and closing device 93, the negative pressure room opening and closing device 96, a negative pressure room air communicating tube 131, a negative pressure room air opening and closing device 130 and the controller 48. Further, a negative pressure room air open port 113 is formed on a side surface of the negative pressure room 82. Further, one end of the negative pressure room air communicating tube 131 is connected to the negative pressure room air open port 133. The other end of the negative pressure room air communicating tube 131 is open to air. Further, the negative pressure room air opening and closing device 130 opens and closes the inside of the negative pressure room air communicating tube 131. The negative pressure room air opening and closing device 130 includes an open and close driving source 132 that opens and closes the inside of the negative pressure room air communicating tube 131 by using a pair of clamping members 70. The controller 48 collectively controls the operations of the powder feeding device 35.

First, an exemplary configuration of the powder feeding device 35 according to this embodiment of the present invention is described. Herein, elements (devices) except for the controller 48 of the powder feeding device 35 are arranged from the upper to lower ends in the vertical direction and sequentially connected as described below. The suction pump 43 is in communication with the negative pressure room 82 via the negative pressure room communicating tube 100. The negative pressure room 82 is in communication with the feeding tank 41 via the suction-port communicating tube 45. The negative pressure room air communicating tube 131 is connected to the side surface (the negative pressure room air open port 133) of the negative pressure room 82. A side surface of the feeding tank 41 is in communication with the toner container 40 via the plumbing 44. Further, the feeding tank 41 is in communication with a container tank 17 of the developing device 13 via the discharge tube 46. In the following, the configurations of the elements (devices) are described in the order of the arrangement.

As the suction pump 43, any appropriate pump may be used as long as the pump may sufficiently suction necessary air (gas) (hereinafter may be referred to as only "air"). In this example, the diaphragm pump (diaphragm type pump) is used. Namely, the suction pump 43 is the diaphragm pump (diaphragm type pump) and includes the pump container 112, the diaphragm 111, and the pump driving device 60. The pump container 112 includes a bottom part where a pump suction port 63 and a pump discharge port 102 are formed. Further, a suction side valve 101 and a discharge side valve 103 are provided so as to open and close the pump suction port 63 and the pump discharge port 102, respectively. More specifically, the suction side valve 101 is provided on the pump suction port 63 in a manner that one end side of the suction side valve 101 is fixed to the pump container 112 and the suction side valve 101 covers the upper part of the pump suction port 63 of the pump container 112. By having this structure, only when air (gas) (hereinafter may be only referred to as "air") flows into the pump container 112, the other end side of the suction side valve 101 is deformed upward to open the suction side valve 101 (i.e., the pump suction port 63). On the other hand, the discharge side valve 103 is provided inside a widening part that is inside the pump discharge port 102 and that is formed under the bottom part of the pump container 112. Further, the discharge side valve 103 is provided on the pump discharge port 102 in a manner that one end side of the discharge side valve 103 is fixed to the pump container 112 and the discharge side valve 103 covers an upper hole of the pump discharge port 102 of the pump container 112 from underneath. Further, only when air flows from the pump container 112, the other end side of the discharge side valve 103 is deformed downward to open the discharge side valve 103 (i.e., pump discharge port 102). Under the control of the controller 48, the suction pump 43 is driven to suction air through the pump suction port 63 and discharge air through the pump discharge port 102 by causing the diaphragm 111 to perform a back-and-forth movement by the pump driving device 60. Herein, it is assumed that the maximum flow rate and the maximum vacuum degree of the suction pump 43 is 1 to 8 liters/min and −20 to −80 kPa, respectively. Further, the diaphragm pump is generally used in various applications and includes a limited number of parts only as described above. Therefore, the purchasing cost is low and manufacturing cost would also be low.

The negative pressure room communicating tube 100 is made of an elastic member such as rubber and is formed in a tube shape. One end of the negative pressure room communicating tube 100 is fixed to the wall around the pump suction port 63 formed on the bottom part of the suction pump 43. The other end of the negative pressure room communicating tube 100 is fixed to the wall around the through hole 88 formed on the upper part of the negative pressure room 82. By fixing in this way, the negative pressure room communicating tube 100 provides communication between the suction pump 43 and the negative pressure room 82. The negative pressure room communicating tube 100 is equipped with the negative pressure room opening and closing device 96 which opens and closes the inside of the negative pressure room communicating tube 100 as a negative pressure room opening and closing unit.

The negative pressure room opening and closing device 96 includes a pair of clamping members 70 provided in a manner that the clamping members 70 can approach and separate from each other, and an open and close driving source 98 as an opening and closing unit. The pair of clamping members 70 are disposed (provided) in a manner that the middle of the negative pressure room communicating tube 100 is sandwiched by the pair of clamping members 70. The negative pressure room opening and closing device 96 (open and close driving source 98) causes the pair of clamping members 70 to approach and separate from each other. When the pair of clamping members 70 approach each other, the pair of clamping members 70 squeeze (clampingly engage) the negative pressure room communicating tube 100 between the pair of clamping members 70 so as to close the inside (block the air flow) of the negative pressure room communicating tube 100. On the other hand, when the pair of clamping members 70 are separated from each other, the pair of clamping members 70 open the inside of the negative pressure room communicating tube 100 (to provide the communication between the suction pump 43 and the negative pressure room 82). By doing this, the open and close driving source 98 opens and closes the inside of the negative pressure room communicating tube 100 (to block and provide communication between the suction pump 43 and the negative pressure room 82). Further, the negative pressure room air opening and closing device 130, the suction-port opening and closing device 93 and the output port opening and closing device 47 have the same configuration as that of the above-described negative pressure room opening and closing device 96. Therefore, the open and close driving source 132 opens and closes the inside of the negative pressure room air communicating tube 131. The open and close driving source 95 of the suction-port opening and closing device 93 opens and closes the inside of the suction-port communicating tube 45. The open and close driving source 71 of the output port opening and closing device 47 opens and closes the inside of the discharge tube 46. Further, the controller 48 controls the opening and closing operations of those opening and closing units (i.e., the negative pressure room opening and closing device 96, the suction-port opening and closing device 93, the negative pressure room air opening and closing device 130, and the output port opening and closing device 47).

The negative pressure room 82 has the upper part where the through hole 88 is formed. Through the through hole 88 and the negative pressure room communicating tube 100, the negative pressure room 82 is in communication with the suction pump 43. On the other hand, the negative pressure room 82 has the bottom part where a through hole 104 is formed. Through the through hole 104 and the suction-port communicating tube 45, the negative pressure room 82 is in communication with the feeding tank 41. The capacity of the negative pressure room 82 is 20 to 300 cc. As described above, the negative pressure room air communicating tube 131 is connected to the side surface of the negative pressure room 82. More specifically, one end of the negative pressure room air communicating tube 131 is connected to the negative pressure room air open port 133 formed on the side surface of the negative pressure room 82. The other end of the negative pressure room air communicating tube 131 is open to air. When the suction pump 43 is driven and then the negative pressure room communicating tube 100, the suction-port communicating tube 45, and the negative pressure room air communicating tube 131 are closed by the respective opening and closing units, a negative pressure is generated in the negative pressure room 82. The negative pressure room 82 is provided so as to hold the generated negative pressure in the negative pressure room 82 until the negative pressure room communicating tube 100, the suction-port communicating tube 45, or the negative pressure room air communicating tube 131 is open again.

The negative pressure room air communicating tube 131 is made of an elastic member such as rubber and is formed in a tube shape. One end of the negative pressure room air communicating tube 131 is fixed to the wall around the negative pressure room air open port 133. The other end of the negative pressure room air communicating tube 131 is open to air. The negative pressure room air communicating tube 131 is equipped with the negative pressure room air opening and closing device 130 which opens and closes the inside of the negative pressure room air communicating tube 131 as a negative pressure room air opening and closing unit. The negative pressure room air opening and closing device 13 is configured similar to the negative pressure room opening and closing device 96. The controller 48 controls (causes) the open and close driving source 132 of the negative pressure room air opening and closing device 130 to open and close the inside of the negative pressure room air communicating tube 131.

The suction-port communicating tube 45 is made of an elastic member such as rubber and is formed in a tube shape. One end of the suction-port communicating tube 45 is fixed to the wall around the through hole 104 formed on the bottom part of the negative pressure room 82. The other end of the suction-port communicating tube 45 is fixed to the wall around the suction port 51 formed on the upper part of the feeding tank 41. By fixing in this way, the suction-port communicating tube 45 provides communication between the negative pressure room 82 and the feeding tank 41. The suction-port communicating tube 45 is equipped with the suction-port opening and closing device 93 which opens and closes the inside of the suction-port communicating tube 45 as a suction-port opening and closing unit. As described above, the suction-port opening and closing device 93 has the same configuration as that of the negative pressure room opening and closing device 96. The controller 48 controls the opening and closing operations of the suction-port opening and closing device 93.

The feeding tank 41 has the upper part where the suction port 51 is formed. Through the suction port 51 and the suction-port communicating tube 45, the feeding tank 41 is in communication with the negative pressure room 82. Further, the feeding tank 41 has a side part where the input port 49 is formed. Through the input port 49 and the plumbing 44, the feeding tank 41 is in communication with the toner container 40. Further, the feeding tank 41 has the bottom part where the output port 50 is formed. Through the output port 50 and the discharge tube 46, the feeding tank 41 is in communication with the container tank 17 of the developing device 13. A negative pressure in the feeding tank 41 is generated based on a pressure difference between the inside of the feeding tank 41 and the inside of the negative pressure room 82. By using the negative pressure generated in the feeding tank 41, the toner 36 contained in the toner container 40 is suctioned into the feeding tank 41. Then, the feeding tank 41 supplies the toner 36 to the container tank 17 of the developing device 13 through the output port 50 of the feeding tank 41.

The plumbing 44 is made of an elastic member such as rubber and is formed in a tube shape, so as to provide (form) a feed path through which toner 36 flows. One end of the plumbing 44 is fixed to the wall around the input port 49 formed on the side part of the feeding tank 41. The other end of the plumbing 44 is integrally formed with the toner container 40.

The toner container 40 has an internal space which is sealed from the outside air. The internal space of the toner container 40 (hereinafter simplified as toner container 40) contains toner 36. The toner container 40 is in communication with the feeding tank 41 via the plumbing 44 and the input port 49. The toner 36 in the toner container 40 is supplied to the feeding tank 41 by being suctioned along with air in the toner container 40 by using a pressure difference between the negative pressure in the negative pressure room 82 and the pressure in the feeding tank 41. Then, the toner 36 suctioned into the feeding tank 41 is discharged to the container tank 17 of the developing device 13 through the output port 50 of the feeding tank 41.

The discharge tube 46 is made of an elastic member such as rubber and is formed in a tube shape. One end of the discharge tube 46 is fixed to the wall around the output port 50 formed on the bottom part of the feeding tank 41. The other end of the discharge tube 46 is fixed to the wall around the supply hole 37 formed on the upper part of the container tank 17 of the developing device 13. By fixing in this way, the discharge tube 46 provides communication between the feeding tank 41 and the container tank 17 of the developing device 13. The discharge tube 46 is equipped with the output port opening and closing device 47 which opens and closes the inside of the discharge tube 46 as an output port opening and closing unit. As described above, the output port opening and closing device 47 has the same configuration as that of the negative pressure room opening and closing device 96. The controller 48 controls the opening and closing operations of the output port opening and closing device 47.

Herein, there are two container tanks that is in the developing device 13 and that mixes and feed the developer. The container tank 17 of the developing device 13 is one of the two container tanks and has the upper part where the supply hole 37 is formed. The supply hole 37 is provided so that the toner is supplied from the feeding tank 41 to the container tank 17 of the developing device 13 through the supply hole 37 and the discharge tube 46. In the container tank 17 of the developing device 13, the mixing screw 18 is provided.

The controller 48 is a computer including a RAM (Random Access Memory), a ROM (Read Only Memory), a CPU (Central Processing Unit) and the like. The controller 48 is electrically connected to the pump driving device 60 of the suction pump 43, the open and close driving source 98 of the negative pressure room opening and closing device 96, the open and close driving source 95 of the suction-port opening and closing device 93, the open and close driving source 71 of the output port opening and closing device 47, and the open and close driving source 132 of the negative pressure room air opening and closing device 130. Further, the controller 48 communicates with a controller (not shown) of the image forming apparatus including the powder feeding device according to an embodiment of the present invention, so that a control signal and the like can be mutually transmitted between the controller 48 and the controller of the image forming apparatus. For example, based on a toner supply signal that is transmitted from the controller of the image forming apparatus and that instructs the supply of the toner 36 to the developing device 13 and based on the detection results by the sensors, the controller 48 controls the operations of the powder feeding device 35 by collectively controlling the elements (devices) of the powder feeding device 35. Further, in this embodiment, a case is described where the controller 48 is included in the powder feeding device 35. However, the present invention is not limited to this configuration. For example, the controller 48 may be integrated (included) in the controller of the image forming apparatus including the powder feeding device 35. Further, the controller 48 may be disposed at any position as long as, for example, the controller 48 can be easily mounted and maintained and the environmental conditions including temperature condition are suitable (satisfied).

Next, the operations of the powder feeding device 35 according to this example of the present invention are described by referring to the controls performed by the controller 48. The control operations performed by the controller 48 includes three control operations, which are negative pressure generating control, toner supply control, and toner discharge control. The negative pressure generating control refers to a control of generating a negative pressure in the negative pressure room 82. The toner supply control refers to a control of supplying toner 36 from the toner container 40 to the feeding tank 41. The toner discharge control refers to a control of discharging the toner 36 from the feeding tank 41 to the container tank 17 of the developing device 13. In the powder feeding device 35, a series of those operations is repeatedly performed. Further, in actual operating control, when the control is to be changed from one to another, there may be a case where waiting (wait control) is performed between two controls. In the following descriptions, it is assumed that toner 36 has been already supplied into the feeding tank 41 and that the toner supply signal instructing the supply of the toner 36 to the developing device 13 is already issued (received by the controller 48). Namely, the following controls are based on the above assumptions.

Toner Discharge Control

In the toner discharge control, in order to discharge the toner 36 from the feeding tank 41 to the container tank 17 of the developing device 13 in the powder feeding device 35, the controller 48 performs the following control. As illustrated in the timing chart of FIG. 15, the controller 48 causes the output port opening and closing device 47 to open the inside of the discharge tube 46 to discharge (supply) the toner 36 from the output port 50 of the feeding tank 41 to the container tank 17 of the developing device 13 through the opened discharge tube 46. When determining that the toner 36 supplied from the toner container 40 into the feeding tank 41 is fully discharged from the output port 50 or that a toner density in the developing device 13 reaches a predetermined value (density), the controller 48 causes the output port opening and closing device 47 to close the inside of the discharge tube 46.

Negative Pressure Generating Control

Figure 15:
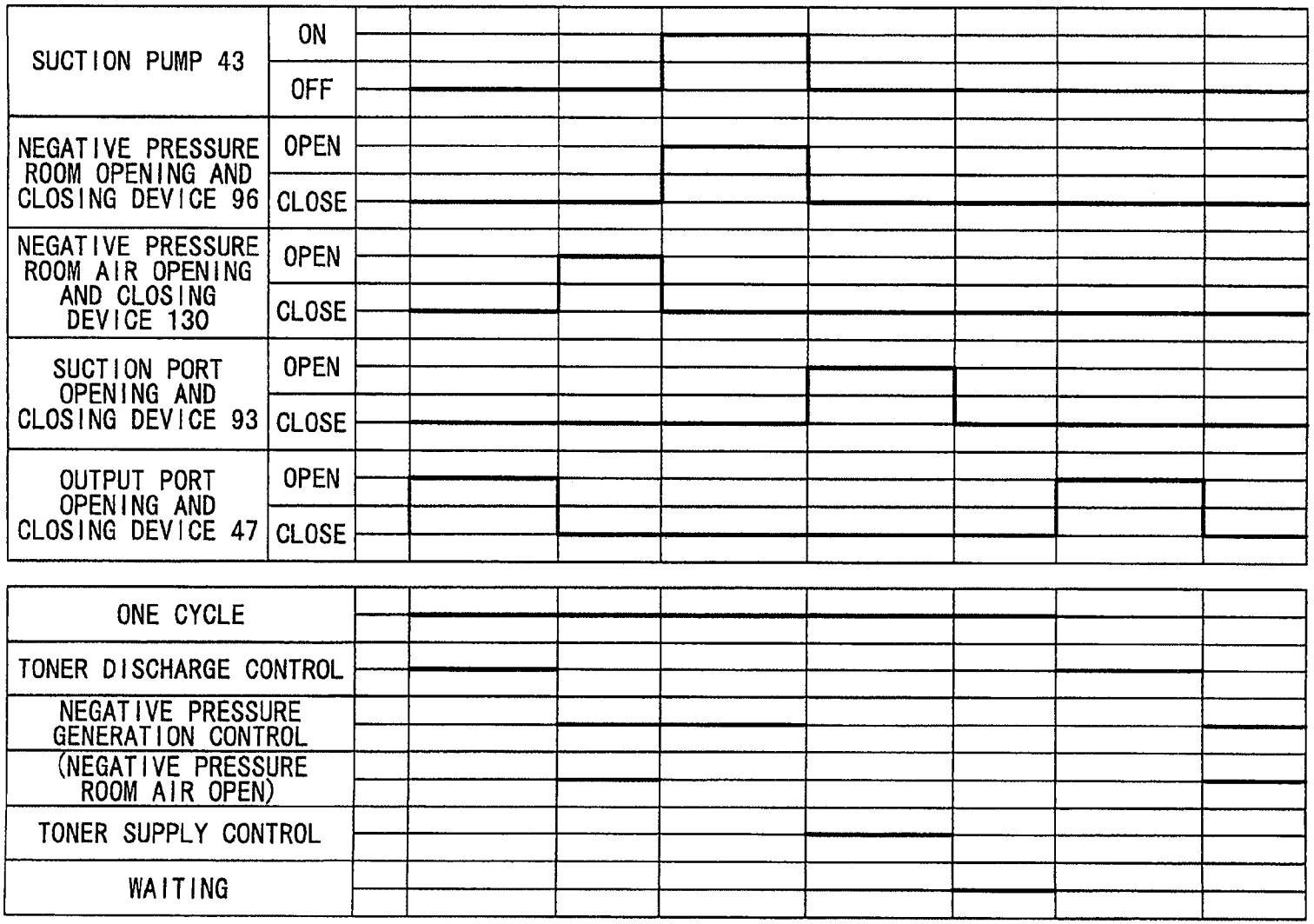
FIG. 15 is a timing chart of the operations according to the sixth example of the present invention.
Figure 16:
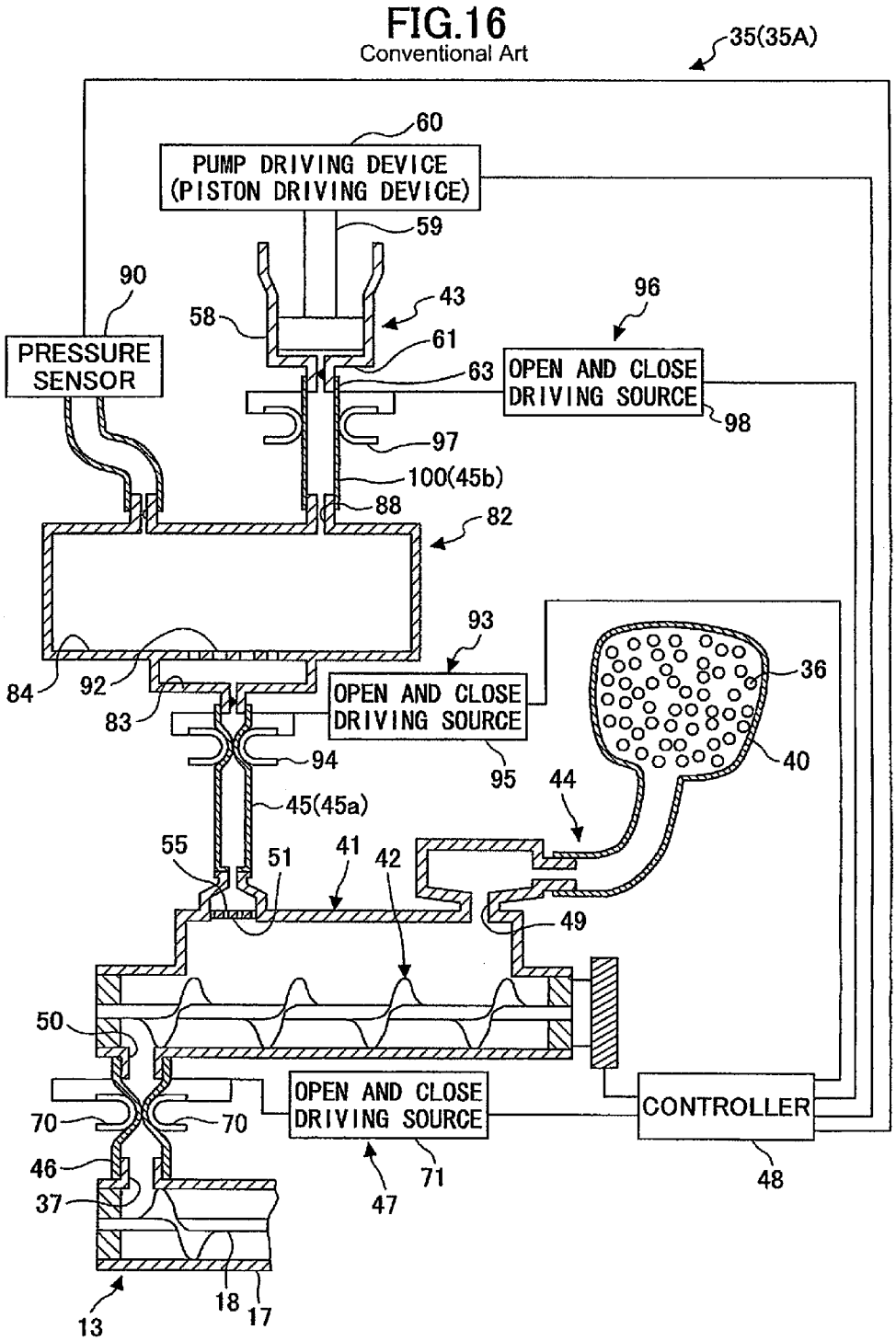
FIG.16 Conventional Art
FIG. 16 is a drawing illustrating an example of the powder feeding device in related art.

In the negative pressure generating control, in order to generate a predetermined negative pressure state in the negative pressure room 82 in the powder feeding device 35, the controller 48 performs the following control. As illustrated in FIG. 15, the controller 48 causes the open and close driving source 132 of the negative pressure room air opening and closing device 130 to open the inside of the negative pressure room air communicating tube 131 to open the negative pressure room 82 to the atmosphere. After the pressure of the negative pressure room 82 is equal to the atmosphere, the inside of the negative pressure room air communicating tube 131 is closed. Then, after the inside of the negative pressure room air communicating tube 131 is closed, the controller 48 causes the suction-port opening and closing device 93 to close the inside of the suction-port communicating tube 45 and causes the negative pressure room opening and closing device 96 to open the inside of the negative pressure room communicating tube 100. Under this state, the controller 48 drives the suction pump 43. By driving the suction pump 43, air in the negative pressure room 82 is suctioned to generate a negative pressure in the negative pressure room 82. When the negative pressure state in the negative pressure room 82 becomes a predetermined negative pressure state, for example, when the pressure in the negative pressure room 82 becomes in a range from −20 kPa to −60 kPa, the controller 48 stops driving the suction pump 43 and causes the negative pressure room opening and closing device 96 to close the inside of the negative pressure room communicating tube 100. Further, whether the negative pressure state in the negative pressure room 82 becomes a predetermined negative pressure state may be determined by measuring the pressure in the negative pressure room 82 or by previously obtaining a time period necessary for becoming the predetermined negative pressure state and determining whether the obtained time period has been elapsed.

The reason whey the pressure of the negative pressure room 82 is open to the atmosphere before the suction pump 43 is driven (started) is described below. Conventionally, after toner 36 is suctioned into the feeding tank 41, the inside of the suction-port communicating tube 45 providing communication between the feeding tank 41 and the negative pressure room 82 is closed. However, at this timing, the pressure of the negative pressure room 82 is still lower than the atmospheric pressure. On the other hand, generally, a starting torque of the suction pump 43 is greater than a driving torque of the suction pump 43 after the suction pump 43 is driven (started). Further, when the pressure of the negative pressure room 82 is sufficiently lowered (again) after the toner 36 is suctioned into the feeding tank 41 and is discharged from the feeding tank 41, the suction pump 43 is started while the pressure of the negative pressure room 82 is still lower than the atmospheric pressure and the inside of the suction-port communicating tube 45 providing communication between the feeding tank 41 and the negative pressure room 82 is open. In this case, since the suction pump 43 is started to suction air from the negative pressure room 82 having the pressure lower than the atmospheric pressure, the starting torque may be further increased. As a result, it may become necessary to use a larger suction pump 43 having higher starting torque.

As described above, according to this example of the present invention, before starting the suction pump 43 to suction air in the negative pressure room 82, the pressure in the negative pressure room 82 is equal to atmospheric pressure. By doing this, it may become possible to prevent the increase of the starting torque of the suction pump 43. Therefore, it may become possible to use a smaller pump having lower starting torque. Further, it may not be necessary to continuously drive the suction pump 43 in order to prevent the problem caused by the starting torque of the suction pump 43. Therefore, it may become possible to avoid the problem that service lifetime of the suction pump 43 is reduced due to longer driving time period of the suction pump 43. As a result, it may become possible to reduce the cost of the suction pump 43 and extend the service lifetime of the powder feeding device 35. Further, the negative pressure is generated in the negative pressure room 82 when the inside of the suction-port communicating tube 45 and the inside of the negative pressure room air communicating tube 131 are closed. Therefore, it may become possible to suction only air in the negative pressure room 82 without suctioning the toner 36, and it may become possible to increase the negative pressure in the negative pressure room 82 in a shorter time period. Further, when the negative pressure is equal to the predetermined negative pressure state, the driving of the suction pump 43 may be stopped and the inside of the inside of the suction-port communicating tube 45, the inside of the negative pressure room air communicating tube 131, and the inside of the negative pressure room communicating tube 100 may be closed, so that the inflow and outflow of air of the negative pressure room 82 may be prevented until any of the insides is open.

Toner Supply Control

In the toner supply control, in order to supply the toner 36 from the toner container 40 into the feeding tank 41, the controller 48 performs the following control. As illustrated in FIG. 15, while causing the output port opening and closing device 47 to close the inside of the discharge tube 46, the controller 48 causes the suction-port opening and closing device 93 to open the inside of the suction-port communicating tube 45. By controlling in this way, the air in the negative pressure room 82 is suctioned and 1 g to 18 g of toner 36 is suctioned along with air from the toner container 40 into the feeding tank 41. In this case, the pressure in the feeding tank 41 is in a range from −1 kPa to 50 kPa. Then, when determining that a predetermined amount of toner 36 is supplied into the feeding tank 41, the controller 48 causes the suction-port opening and closing device 93 to close the inside of the suction-port communicating tube 45. In this case, whether the predetermined amount of toner 36 is supplied into the feeding tank 41 may be determined by detecting the toner amount, or by a predetermined time period has elapsed, the predetermined time period having been determined by an experiment or the like. Otherwise, whether the predetermined amount of toner 36 is supplied into the feeding tank 41 may be determined by measuring the pressure in the negative pressure room 82 after the inside of the suction-port communicating tube 45 is open and then determining whether the pressure difference between the measured pressure and the pressure having been measured before the inside of the suction-port communicating tube 45 is open is greater than the pressure difference previously obtained by conducting experiments or the like. Otherwise, whether the predetermined amount of toner 36 is supplied into the feeding tank 41 may be determined by measuring the pressure in the feeding tank 41 after the inside of the suction-port communicating tube 45 is open and then determining whether the measure pressure is equal to or greater than a predetermined negative pressure obtained by an experiment or the like in advance.

As described above, by generating the negative pressure in the feeding tank 41 by using the pressure difference between the pressure in the feeding tank 41 and the negative pressure in the negative pressure room 82, it may become possible to suction the toner 36 along with air in the toner container 40 into the feeding tank 41. By suctioning the toner 36 along with air from the toner container 40 into the feeding tank 41 by generating the negative pressure in the feeding tank 41, it becomes possible to feed the toner 36. In other words, in order to suction the toner 36 into the feeding tank 41, the controller 48 performs control to generate the negative pressure. Further, the suction pump 43 to generate the negative pressure in the feeding tank 41 is disposed outside the feeding tank 41. Because of this structure, it may become possible to prevent the heat transfer from the suction pump 43 to the feeding tank 41. Further, the toner 36 is suctioned into the feeding tank 41 by means of the negative pressure. Because of this feature, it may become possible to suction the toner 36 into the feeding tank 41 without grinding toner 36. As a result, it becomes possible to minimize (reduce) the heat stress on toner 36 and feeding toner 36.

Further, while the inside of the discharge tube 46 is closed by the output port opening and closing device 47, the inside of the suction-port communicating tube 45 is open, so as to generate the negative pressure in the feeding tank 41 by using the negative pressure in the negative pressure room 82. Therefore, it may become possible to increase the negative pressure in the feeding tank 41 in a shorter time period. Therefore, when compared with a case where the suction pump 43 directly suctions the air in the feeding tank 41, it may become possible to increase the flow rate of suctioning the air and, accordingly, suction a larger amount of toner 36 into the feeding tank 41 in a shorter time period. Further, when compared with a case where the suction pump 43 directly suctions the air in the feeding tank 41, it may become possible to increase a feed amount of toner 36 per unit time and be applicable to an image forming apparatus having a larger toner consumption amount per unit time and having a faster printing speed.

Waiting (Wait Control)

Further, after a predetermined amount of toner 36 is supplied (suctioned) into the feeding tank 41 and the toner supply control is finished, for example, it may become necessary to supply toner 36 into the developing device 13. In such a case, it becomes necessary to wait to start the toner discharge control (to transit to the toner discharge control). During the waiting (in the wait control), for example, the controller 48 closes the inside of the suction-port communicating tube 45, and the inside of the discharge tube 46.

However, in the powder feeding device 35 according to this embodiment of the present invention, it is not always necessary to wait until the toner discharge control is started (the control is transitioned to the toner discharge control). For example, there may be a case where a toner density in the developing device 13 may not become a predetermined density by performing a single cycle of the discharge of the toner 36. In such a case, after the toner supply control is finished, the toner discharge control may be started (the control is transitioned to the toner discharge control) without waiting (without performing the wait control), so that a series of controls are repeated to continuously supply toner 36 to the developing device 13.

EXAMPLE 7

An example 7 of the powder feeding device 35 in an image forming apparatus according to this embodiment of the present invention is described with reference to FIG. 9. A configuration in this example 7 is the same as that of any of examples 1 to 6 except that the type of the suction pump 43 in this example is different. Specifically, the only difference is that, while the diaphragm pump is used in example 1 to 6, a vane pump is used in this example 7. Other elements (configuration) in this example are similar to any of examples 1 to 6. Therefore, the descriptions of the same operations and effects as those in examples 1 to 6 due to the same elements (configuration) may be omitted. FIG. 9 illustrates a configuration of a vane pump 43 in the powder feeding device 35 according to this example of the present invention.

As illustrated in FIG. 9, the vane pump 43 in the powder feeding device 35 in this example includes a pump container 112, an impeller 114, and vanes 113. Further, a pump suction port 63 and a pump discharge port 102 are formed on the pump container 112. The pump container 112 has a substantially tube shape. The diameter of the inner periphery surface of the substantially tube shape of the pump container 112 is formed to be greater than the diameter of the outer periphery of the impeller 114. Further, the impeller 114 is provided in the pump container 112 in a manner that the upper summit of the inner periphery of the pump container 112 in the vertical direction is in contact with the upper summit of the outer periphery of the impeller 114 in the vertical direction. Further, the pump suction port 63 and the pump discharge port 102 have a cylindrical shape and are formed in a manner that the inner surface of the cylindrical shape extends in the horizontal direction from the inner peripheral surface of the pump container 112 to the outside of the pump container 112. Further, when the inner peripheral surface of the pump container 112 is regarded as a clock face, the pump suction port 63 is formed to be extended from substantially at a 10 o'clock position of the pump container 112 to the outside of the pump container 112 and the pump discharge port 102 is formed to be extended from substantially at a 2 o'clock position of the pump container 112 to the outside of the pump container 112. Further, the pump suction port 63 is in communication with the negative pressure room 82 via the negative pressure room communicating tube 100. Further, when example 3 is applied to this example, the pump discharge port 102 is in communication with the feeding tank 41 via the air supply communicating tube 107.

Further, seven vanes 113 are slidably provided so that the vanes 113 slide along the respective grooves formed in the impeller 114. When the impeller 114 is rotated by a pump driving device (not shown), the vanes 113 protrude outward to the inner peripheral surface of the pump container 112 by the centrifugal force. As a result of the protrusion of the vanes 113, a capacity between the vanes changes. Due to the change, it becomes possible to suction air through the pump suction port 63 and discharge air through the pump discharge port 102. Instead of using the diaphragm type pump described in example 1, by using the vane type pump having the configuration described above as the suction pump 43, the operations and effects similar to those in example 1 described above may be obtained. Further, the maximum flow rate and the maximum vacuum degree of the suction pump 43 is 1 to 8 l/min and −20 to −80 kPa, respectively. The vane type pump is a pump generally used in various applications. Further, as described above, the number of parts of the vane type pump is limited. Therefore, the cost to purchase the vane type pump is low, and the manufacturing cost of the vane type pump is also low. Further, the vanes 113 may be easily wear. However, even when the vanes 113 are worn, the vanes 113 protrude outward to the inner peripheral surface of the pump container 112 by the centrifugal force. Due to the structure, the service lifetime may be long.

As described above, in the powder feeding device 35 in this example, by suctioning air in the feeding tank 41, the toner 36 is suctioned from the toner container 40 to the feeding tank 41. Namely, to suction the toner 36 into the feeding tank 41, a negative pressure is generated in the feeding tank 41. Further, the suction pump 43 to generate the negative pressure in the feeding tank 41 is disposed outside the feeding tank 41. Because of this structure, it may become possible to prevent the heat transfer from the suction pump 43 to the feeding tank 41. Further, the toner 36 is suctioned into the feeding tank 41 by means of the negative pressure. Because of this feature, it may become possible to suction the toner 36 into the feeding tank 41 without grinding toner 36. As a result, it becomes possible to minimize the heat stress on toner 36 and feeding toner 36.

Further, when the toner 36 having been suctioned from the toner container 40 to the feeding tank 41 is discharged from the output port 50 of the feeding tank 41, the negative pressure is generated in the negative pressure room 82 at the same time. Since the discharge of the toner 36 from the output port 50 and the generation of the negative pressure in the negative pressure room 82 are performed at the same time, when compared with a case where the discharge of the toner 36 from the output port 50 and the generation of the negative pressure in the negative pressure room 82 are not performed at the same time, it may become possible to reduce a time period to perform a series of the operations necessary to feed the toner 36. Further, in a process of generating a predetermined negative pressure state in the negative pressure room 82, negative pressure is generated in the negative pressure room 82 while the inside of the suction-port communicating tube 45 is closed. Therefore, it may become possible to suction only air in the negative pressure room 82 without suctioning the toner 36. As a result, it may become possible to increase the negative pressure in the negative pressure room 82 in a shorter time period. Further, while the inside of the discharge tube 46 is closed by the output port opening and closing device 47, the inside of the suction-port communicating tube 45 is open and the negative pressure is generated in the feeding tank 41 using the negative pressure in the negative pressure room 82. Therefore, it may become possible to increase the negative pressure of the feeding tank 41 in a shorter time period. Therefore, it may become possible to suction more toner 36 into the feeding tank 41 in a shorter time period and reduce the time period for suctioning the toner 36 into the feeding tank 41 and the time period to prepare the suctioning the toner 36. As a result, it may become possible to increase a supply amount of toner 36 to the developing device 13 per unit time. In addition to increasing the negative pressure in the negative pressure room 82 as described above, it may become possible to reduce a time period necessary to perform a series of operations of the powder feeding device 35 including the operation of generating the negative pressure in the negative pressure room 82, the operation of suctioning the toner 36 into the feeding tank 41, and the operation of discharging the toner 36 in the feeding tank 41. Further, by increasing the negative pressure in the negative pressure room 82 and reducing the time period necessary to perform the series of operations of the powder feeding device 35, it may become possible to increase the supply amount of toner 36 to the developing device 13 per unit time without adding new parts and without increasing the manufacturing cost.

Accordingly, it may become possible to provide a powder feeding device applicable to an image forming apparatus having a faster printing speed, with less heat stress on toner, and with low manufacturing cost.

Further, in the powder feeding device 35 according to an example of the present invention, when powder (toner) is supplied from the powder container (toner container) 40 to the feeding tank 41, it is possible to use the air suction force generated by the suction pump 43 as well as the pressure difference to generate the negative pressure in the feeding tank 41, the pressure difference being between the negative pressure in the negative pressure room 82 and the pressure in the feeding tank 41. By additionally using the air suction force generated by the suction pump 43, when compared with the case where the negative pressure is generated by using only the pressure difference between the negative pressure in the negative pressure room 82 and the pressure in the feeding tank 41, it may become possible to reduce the reduction of the negative pressure value in the feeding tank 41, and suction more toner 36. As described above, by increasing the supply amount of toner 36 within the series of the operations, it may become possible to increase the supply amount of toner 36 to the developing device 13 per unit time without adding new parts and without increasing the manufacturing cost.

Further in the powder feeding device 35 according to an example of the present invention, when the toner 36 having been suctioned from the toner container 40 to the feeding tank 41 is discharged from the output port 50 of the feeding tank 41, the feeding screw 42 in the feeding tank 41 is rotated. Since the toner 36 in the feeding tank 41 is fed from the input port 49 to the output port 50 by rotating the feeding screw 42, it may become possible to always feed a constant amount of toner 36 to the output port 50. Therefore, it may become possible to prevent jamming of toner 36 at the output port 50, stabilize the discharge speed of the toner 36, and reduce a time period necessary to fully discharge the toner 36 in the feeding tank 41. Therefore, it may become possible to increase a supply amount of toner 36 to the developing device 13 per unit time.

Further, in the powder feeding device 35 according to an example of the present invention, when the toner 36 having been suctioned from the toner container 40 to the feeding tank 41 is discharged from the output port 50 of the feeding tank 41, the suction pump 43 is driven to supply air into the feeding tank 41. By supplying air into the feeding tank 41, it may become possible to increase the pressure in the feeding tank 41 and increase the speed of discharging the toner 36 from the output port 50. By doing this, it may become possible to reduce a time period required to (fully) discharge the toner 36 in the feeding tank 41. As a result, it may become possible to increase a supply amount of toner 36 to the developing device 13 per unit time.

Further, in the powder feeding device 35 according to an example of the present invention, the diaphragm type pump is used as the suction pump 43. Therefore, it may become possible to manufacture the powder feeding device 35 at low cost.

Further, in the powder feeding device 35 according to an example of the present invention, the vane type pump is used as the suction pump 43. Therefore, it may become possible to manufacture the powder feeding device 35 at low cost.

Further, in an image forming apparatus according to an embodiment of the present invention, by including the powder feeding device 35 as described above, it may become possible to obtain the same operations and effects as those in the powder feeding device 35.

Further, when a predetermined negative pressure state in the negative pressure room 82 is generated, while the inside of the suction-port communicating tube 45 is closed, the negative pressure is generated in the negative pressure room 82. Therefore, it may become possible to suction only air in the negative pressure room 82 without suctioning the toner 36. As a result, it may become possible to increase the negative pressure in the negative pressure room 82 in a shorter time period.

Further, according to an embodiment of the present invention, unlike the configuration disclosed in Patent Document 1, the filter 123 may be cleaned by using the suction pump 43 providing air flow in one direction. Therefore, by using the diaphragm pump or the vane pump having a lower cost and having a longer service lifetime, it may become possible to not only reduce the cost of the suction pump 43 but also extend the service lifetime of the suction pump 43 and the filter 123.

Further, in the powder feeding device according to an embodiment of the present invention, the controller 48 is used. However, alternatively, a mechanical mechanism may be used to perform the series of operations performed by the controller 48 as described above. Accordingly, when the mechanical mechanism is used, the same operations and effects as those obtained when the controller 48 is used may be obtained. Specifically, even the mechanical mechanism is used, it may become possible to lower the starting torque of the suction pump 43, extend the service lifetime of the suction pump 43 and the filter 123, lower the heat stress on the toner 36, and suction a larger amount of toner 36 in a shorter time period.

Further, according to an embodiment of the present invention, due to the filter 123 provided at the suction port 51, it may become possible to prevent the toner 36 from entering into the suction pump 43. Therefore, it may become possible to prevent the direct contact between the toner 36 and the suction pump 43. Therefore, it may become possible to prevent a failure and a trouble of the suction pump 43 caused by the adhesion of the toner 36 to the suction pump 43 and lower the driving torque of the suction pump 43 and enhance the service lifetime of the suction pump 43. Further, after the toner 36 is suctioned from the toner container 40 to the feeding tank 41, while the inside of the suction port communicating tube 45 is closed, the inside of the air communicating tube 121 is open. By doing this, it may become possible to supply enough flow rate of the air to the filter 123 provided at the suction port 51 to clean the filter. Therefore, it may become possible to extend the service lifetime of the filter 123 using the minimum elements having a lower manufacturing cost.

Further, according to an embodiment of the present invention, as the suction pump 43, the diaphragm pump having a low cost and having a longer service lifetime is used. Therefore, it may become possible to lower the manufacturing cost of the suction pump 43 and extend the service lifetime of the suction pump 43 and the filter 123. As a result, it may become possible to further lower the cost of the powder feeding device 35 and extend the service lifetime of the powder feeding device 35.

Further, according to an embodiment of the present invention, as the suction pump 43, the vane pump having a low cost and having a longer service lifetime is used. Therefore, it may become possible to lower the manufacturing cost of the suction pump 43 and extend the service lifetime of the suction pump 43 and the filter 123. As a result, it may become possible to further lower the cost of the powder feeding device 35 and extend the service lifetime of the powder feeding device 35.

Further, in the image forming apparatus according to an embodiment of the present invention, by including the powder feeding device 35 having the configuration described above, the same operations and effects as those in the powder feeding device 35 may be obtained.

According to an embodiment of the present invention, after the pressure of the negative pressure room 82 is sufficiently reduced, it may become possible to open the inside of the suction port communicating tube 45 providing communication between the negative pressure room 82 and the feeding tank 41 and suction the air in the feeding tank 41. Therefore, when compared with a case where the suction pump directly suction the air in the feeding tank 41, it may become possible to increase the flow rate of the suctioned air and suction a larger amount of toner 36 into the feeding tank 41 in a shorter time period. Therefore, when compared with the case where the suction pump directly suctions the air in the feeding tank 41, it may become possible to increase the feeding amount of the toner 36 per unit time. Accordingly, it may become possible to apply the powder feeding device 35 to an image forming apparatus having a faster printing speed and having a larger toner consumption amount per unit time as well.

Further, before the suction pump 43 is started to suction the air in the negative pressure room 82, the inside of the negative pressure room is open to the atmosphere. Therefore, it may become possible to prevent the increase of the starting torque of the suction pump 43. Accordingly, it may become possible to use a smaller suction pump 43 having a lower starting torque. Further, it may be not necessary to continuously drive the suction pump 13 to avoid a problem caused by the starting torque of the suction pump 43. Accordingly, it may become possible to avoid the risk of reducing the service lifetime of the suction pump 43 due to the longer driving time period of the suction pump 43. As a result, it may become possible to lower the cost of the suction pump 43 and the extend the service lifetime of the suction pump 43.

According to an embodiment of the present invention, a powder feeding device includes a powder container containing powder; a feeding tank including an input port through which the powder is supplied from the powder container, an output port through which the powder is discharged to outside, and a suction port through which air in the feeding tank is suctioned; a negative pressure room in communication with the feeding tank via a suction port communicating tube connected to the suction port; an air suction device in communication with the negative pressure room via a negative pressure room communication tube connected to an negative pressure room suction port formed on the negative pressure room; a suction port opening and closing unit opening and closing an inside of the suction port communicating tube; a negative pressure room opening and closing unit opening and closing an inside of the negative pressure room communication tube; an output port opening and closing unit opening and closing the output port; and a controller performing a negative pressure generation control, a powder supply control, and a powder discharge control.

Further, in the negative pressure generation control, after causing the suction port opening and closing unit to close the inside of the inside of the suction port communicating tube and causing the negative pressure room opening and closing unit to open the inside of the negative pressure room communication tube, the controller drives the air suction device so as to suction air in the negative pressure room, and after that, when a pressure in the negative pressure room is equal to a predetermined negative pressure state, the controller stops the air suction device and causes the negative pressure room opening and closing unit to close the inside of the negative pressure room communication tube.

Further, in the powder supply control, after causing the output port opening and closing unit to close the output port and causing the suction port opening and closing unit to open the inside of the suction port communicating tube, the controller causes the suction port opening and closing unit to open the inside of the suction port communicating tube so as to supply the powder from the powder container to the feeding tank, and after that, when determining that a predetermined amount of powder is supplied to the feeding tank, the controller causes the suction port opening and closing unit to close the inside of the suction port communicating tube.

Further, in the powder discharge control, the controller causes the output port opening and closing unit to open the output port so as to discharge the powder from the output port, the powder having been supplied into the feeding tank.

Further the controller simultaneously start the negative pressure generation control and the powder discharge control.

According to this embodiment of the present invention, by suctioning the air in the feeding tank, the powder is suctioned from the powder container to the feeding tank. Namely, to suction the powder into the feeding tank, a negative pressure is generated in the feeding tank. Further, the air suction device to generate the negative pressure in the feeding tank is provided outside the feeding tank. Therefore, the transfer of the heat generated in the air suction device to the powder may be prevented. Further, since the negative pressure is used to suction the powder into the feeding tank, the powder may be suctioned into the feeding tank without grinding the powder. Therefore, it may become possible to minimize (reduce) the heat stress on the powder and feeding the powder.

Further, the negative pressure generation control and the powder discharge control are started at the same time. Therefore, when compared with a conventional case the negative pressure generation control and the powder discharge control are separately performed, a series of operation time periods related to the powder feed may be reduced. Further, while the inside of the suction port communicating tube is closed, the negative pressure is generated in the negative pressure room. Therefore, it may become possible to suction only air in the negative pressure room without suctioning the powder. As a result, it may become possible to increase the negative pressure in the negative pressure room in a shorter time period. Further, in the powder supply control, while the inside of the output port is closed by the output port opening and closing unit, the inside of the suction port communicating tube is opened by the suction port opening and closing unit and the negative pressure is generated in the feeding tank by using the negative pressure in the negative pressure room. Therefore, it may become possible to increase the negative pressure in the feeding tank in a shorter time period. Therefore, it may become possible to suction more powder into the feeding tank in a shorter time period. By reducing the time period to suction the powder into the feeding tank and reducing the time period of preparing the suctioning of the powder, it may become possible to increase the supply amount of power to the developing device per unit time.

As described above, similar to a known invention, more specifically similar to, for example, Patent Document 1, the powder feeding device according to an embodiment of the present invention may feed the powder while minimizing the heat stress on the powder and increase the negative pressure in the feeding tank in a short time period. In addition, in the powder feeding device according to the embodiment of the present invention, the negative pressure generation control and the powder discharge control are started at the same time. Because of this feature, it may become possible to reduce the time period necessary to perform a series of operations of the powder feeding tank, the operations including the generation of the negative pressure in the negative pressure room, the suctioning of the powder into the feeding tank, and discharging of the powder from the feeding tank. Therefore, when compared with conventional and known techniques, it may become possible to reduce the time period necessary to perform the series of operation. As a result, it may become possible to increase the supply amount of the powder to the developing device and the like per unit time without adding new parts and without increasing the manufacturing cost.

According to this embodiment of the present invention, a negative pressure in the feeding tank is used to feed the powder. Therefore, it may become possible to minimize the heat stress on the powder. Further, the negative pressure in the negative pressure room is increased, and the time period necessary to perform the series of operations of the powder feeding device is reduced. Therefore, it may become possible to increase the supply amount of the powder to the developing device per unit time without adding new parts and without increasing the manufacturing cost. Therefore, it may become possible to provide a powder feeding device applying less heat stress on the powder as a feeding target, having less manufacturing cost, and having a longer service lifetime and an image forming apparatus that includes the powder feeding device and applicable to an image forming apparatus having a faster printing speed.

According to another embodiment of the present invention, in the powder supply control, after causing the, output port opening and closing unit to close the output port, causing the suction port opening and closing unit to open the inside of the suction port communicating tube, and further causing the negative pressure room opening and closing unit to open the inside of the negative pressure room communication tube, the controller may start the air suction device to suction the air in the negative pressure room and supply the powder from the powder container to the feeding tank, and after that, when determining that a predetermined amount of powder is supplied to the feeding tank, the controller may cause the suction port opening and closing unit to close the inside of the suction port communicating tube, stop the air suction device, and cause the negative pressure room opening and closing unit to close the inside of the negative pressure room communication tube.

According to another embodiment of the present invention, the powder feeding may further include a rotational feeding unit that includes a feeding member in the feeding tank, the feeding member being configured to feed the powder in the feeding tank from the input port to the output port when the feeding member rotates around an axle of the feeding member.

Further, in the powder discharge control, the controller may cause the rotational feeding unit to rotate the feeding member.

According to another embodiment of the present invention, the powder feeding may further include an air supply unit supplying air into the feeding tank via an air supply port communicating tube connected to an air supply port formed on the feeding tank; and an air supply port opening and closing unit opening and closing the air supply port communicating tube.

Further, in the powder discharge control, after causing the output port opening and closing unit to open the output port and causing the air supply port opening and closing unit to open the air supply port communicating tube, the controller may cause the air supply unit to supply air into the feeding tank.

Further, in the powder supply control, after causing the output port opening and closing unit to close the output port, causing the negative pressure room opening and closing unit to close the inside of the negative pressure room communication tube, and causing the air supply port opening and closing unit to close the air supply port communicating tube, the controller may cause the suction port opening and closing unit to open the inside of the suction port communicating tube.

According to another embodiment of the present invention, the air suction device may correspond to a suction side of a diaphragm pump and the air supply unit may correspond to the diaphragm pump including a discharge side of the diaphragm pump.

According to an embodiment of the present invention, the air suction device may correspond to a suction side of a vane pump and the air supply unit may correspond to the vane pump including a discharge side of the vane pump.

According to an embodiment of the present invention, in the powder supply control, after causing the output port opening and closing unit to close the output port and causing the suction port opening and closing unit to open the inside of the suction port communicating tube, the controller may simultaneously cause the negative pressure room opening and closing unit to open the inside of the negative pressure room communication tube and start the air suction device to suction the air in the negative pressure room and supply the powder from the powder container to the feeding tank, and after that, when determining that the predetermined amount of powder is supplied to the feeding tank, the controller may cause the suction port opening and closing unit to close the inside of the suction port communicating tube, stop the air suction device, and cause the negative pressure room opening and closing unit to close the inside of the negative pressure room communication tube.

According to this embodiment of the present invention, while the inside of the suction port communicating tube is closed, the negative pressure is generated. Therefore, it may become possible to suction only air in the negative pressure room without suctioning the powder and increase the negative pressure in the negative pressure room in a shorter time period. Further, in the powder supply control, it may become possible to use the air suction force generated by the air suction device in addition to the pressure difference between the pressure in the feed tank and the pressure in the negative pressure room. By additionally using the air suction force generated by the air suction device, when compared with the case where only the pressure difference between the pressure in the feed tank and the pressure in the negative pressure room is used, it may become possible to reduce the lowering of the suction amount due to the reduction of the negative pressure in the feeding tank.

According to an embodiment of the present invention, the powder feeding may further include a filter fixed to the suction port and preventing the powder from being passing through the filter and permitting air passing through the filter; an air communicating tube having one end connected to a part of the suction port communicating tube so as to be in communication with the suction port communicating tube and having another end open to the atmosphere, the part being disposed between the filter and the suction port opening and closing unit; and an air opening and closing unit opening and closing an inside of the air communicating tube.

Further, after causing the suction port opening and closing unit to close the inside of the suction port communicating tube and causing the negative pressure room opening and closing unit to open the inside of the negative pressure room communication tube, the controller may start the air suction device to suction air in the negative pressure room.

Further, after the air in the negative pressure room is suctioned, the controller may cause the negative pressure room opening and closing unit to close the inside of the negative pressure room communication tube.

Further, after causing the negative pressure room opening and closing unit to close the inside of the negative pressure room communication tube, the controller may cause the output port opening and closing unit to close the output port and cause the air opening and closing unit to close the inside of the air communicating tube. Then, the controller may cause the suction port opening and closing unit to open the inside of the suction port communicating tube to suction the powder from the powder container to the feeding tank.

Further, after the powder is suctioned from the powder container to the feeding tank, the controller may cause the suction port opening and closing unit to close the inside of the suction port communicating tube and then cause the air opening and closing unit to open the inside of the air communicating tube.

Further, after causing the air opening and closing unit to open the inside of the air communicating tube, the controller may cause the output port opening and closing unit to open the output port.

According to this embodiment of the present invention, after sufficiently lowering the pressure in the negative pressure room by suctioning the air in the negative pressure room, it may become possible to open the inside of the suction port communicating tube providing a communication between the negative pressure room and the feeding tank and suction the air in the feeding tank. Therefore, when compared with a case where the air suction device directly suctions the air in the feeding tank, it may become possible to increase the flow rate of suctioning the air and suction a larger amount of the powder into the feeding tank in a shorter time period. Further, when compared with a case where the air suction device directly suctions the air in the feeding tank, it may become possible to increase the feeding amount of the powder per unit time. As a result, the powder feeding device according of an embodiment of the present invention may be applied to an image forming apparatus having a faster printing speed and having a larger toner consumption amount per unit time.

Further, due to the filter provided at the suction port, it may become possible to prevent the powder from entering into the air suction device. Therefore, it may become possible to prevent the direct contact between the powder and the air suction device. Therefore, it may become possible to prevent a failure and a trouble of the air suction device caused by the adhesion of the powder to the air suction device and lower the driving torque of the air suction device and enhance the service lifetime of the air suction device. Further, after the powder is suctioned from the power container to the feeding tank, while the inside of the suction port communicating tube is closed, the air communicating tube is open. By doing this, it may become possible to supply high enough flow rate of the air to the filter provided at the suction port to clean the filter.

According to this embodiment of the present invention, by using the negative pressure in the feeding tank to feed the powder, it may become possible to minimize (reduce) the heat stress on the powder. In addition, it may become possible to increase the supply amount of the powder to the developing device and the like per unit time. As a result, it may become possible to apply the powder feeding tank to an image forming apparatus having a faster printing speed and having a larger toner consumption amount per unit time. Further, the filter is provided at the suction port and the filter may be cleaned. Therefore, it may become possible to lower the driving torque of the air suction device and enhance the service lifetime of the air suction device and the filter. As a result, it may become possible to provide a powder feeding device having less heat stress on the powder as a feeding target, having less manufacturing cost, and having a longer service lifetime and an image forming apparatus that includes the powder feeding device and applicable to an image forming apparatus having a faster printing speed.

According to another embodiment of the present invention, the powder feeding device may further include a negative pressure room air communicating tube having one end connected to a negative pressure room air open port formed on the negative pressure room and having another end open to air; and a negative pressure room air opening and closing device opening and closing an inside of the negative pressure room air communicating tube.

Further, the controller may cause the negative pressure room air opening and closing device to open the inside of the negative pressure room air communicating tube so that a pressure in the negative pressure room is equal to atmospheric pressure.

Further, after causing the negative pressure room air opening and closing device to open the inside of the negative pressure room air communicating tube, the controller may cause the suction port opening and closing unit to close the inside of the suction port communicating tube, cause the negative pressure room opening and closing unit to open the inside of the negative pressure room communication tube, cause the negative pressure room air opening and closing device to close the inside of the negative pressure room air communicating tube, and start the air suction device to suction air in the negative pressure room.

Further, after the air in the negative pressure room is suctioned, the controller may cause the negative pressure room opening and closing unit to close the inside of the negative pressure room communication tube and stop the air suction device.

Further after causing the negative pressure room opening and closing unit to close the inside of the negative pressure room communication tube and stopping the air suction device, the controller may cause the output port opening and closing unit to close the output port and then cause the suction port opening and closing unit to open the inside of the suction port communicating tube to suction the powder from the powder container to the feeding tank.

Further, after the powder is suctioned from the powder container to the feeding tank, the controller may cause the output port opening and closing unit to open the output port.

According to this embodiment of the present invention, in order to suction the air in the negative pressure room by the air suction device, before the suction port communicating tube is open and the air suction device is started, the negative pressure room air communicating tube is opened by the negative pressure room air opening and closing device to open the inside of the negative pressure room to the (outside) air and then the negative pressure room air communicating tube is closed. The air suction device is started after the inside of the negative pressure room is open to the (outside) air. As a result, it may become possible to prevent the increase of the starting torque of the air suction device. By preventing the increase, of the starting torque of the air suction device, it may become possible to use a smaller air suction device having a lower starting torque. Further, it may be possible to avoid the continuous operation of the air suction device in order to avoid a problem caused by the lower starting torque of the air suction device. As a result, it may become possible to avoid the increase of the operating time of the air suction device and reduction of the service lifetime of the air suction device. Therefore, when compared with conventional and known inventions, it may become possible to further decrease the cost of the air suction device and extend the service lifetime of the air suction device.

According to this embodiment of the present invention, by using the negative pressure in the feeding tank to feed the powder, it may become possible to minimize (reduce) the heat stress on the powder. In addition, it may become possible to increase the supply amount of the powder to the developing device and the like per unit time. As a result, it may become possible to apply to an image forming apparatus having a faster printing speed and having a larger toner consumption amount per unit time. Further, in order to suction the air in the negative pressure room by the air suction device, before the suction port communicating tube is open and the air suction device is started, the negative pressure room air communicating tube is open by the negative pressure room air opening and closing device to open the inside of the negative pressure room to the (outside) air. Therefore, even a smaller air suction device may be used. Therefore, it may become possible to reduce the cost and extend the service lifetime of the air suction device. As a result, it may become possible to provide a powder feeding device applying less heat stress on the powder as a feeding target, having less manufacturing cost, and having a longer service lifetime and an image forming apparatus that includes the powder feeding device and applicable to an image forming apparatus having a faster printing speed.

According to an embodiment of the present invention, the air suction device may be a diaphragm pump.

According to an embodiment of the present invention, the air suction device may be a vane pump.

According to an another embodiment of the present invention, an image forming apparatus includes an image carrier carrying an electrostatic latent image; a developing device developing the electrostatic latent image on the image carrier and forming a corresponding toner image; and the powder feeding device described above as a unit to supply toner to the developing device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder feeding device comprising:

a powder container configured to contain powder;

a feeding tank including an input port through which the powder is supplied from the powder container, an output port through which the powder is discharged to outside, and a suction port through which air in the feeding tank is suctioned;

a negative pressure room configured to be in communication with the feeding tank via a suction port communicating tube connected to the suction port;

an air suction device configured to be in communication with the negative pressure room via a negative pressure room communication tube connected to a negative pressure room suction port formed on the negative pressure room;

a suction port opening and closing unit configured to open and close an inside of the suction port communicating tube;

a negative pressure room opening and closing unit configured to open and close an inside of the negative pressure room communication tube;

an output port opening and closing unit configured to open and close the output port; and a controller configured to perform a negative pressure generation control, a powder supply control, and a powder discharge control;

wherein, in the negative pressure generation control, after causing the suction port opening and closing unit to close the inside of the suction port communicating tube and causing the negative pressure room opening and closing unit to open the inside of the negative pressure room communication tube, the controller is configured to drive the air suction device so as to suction air in the negative pressure room, and after that, when a pressure in the negative pressure room is equal to a negative pressure state, the controller is configured to stop the air suction device and cause the negative pressure room opening and closing unit to close the inside of the negative pressure room communication tube, wherein, in the powder supply control, after causing the output port opening and closing unit to close the output port and causing the suction port opening and closing unit to open the inside of the suction port communicating tube, the controller is configured to cause the suction port opening and closing unit to open the inside of the suction port communicating tube so as to supply the powder from the powder container to the feeding tank, and after that, when determining that an amount of powder is supplied to the feeding tank, the controller is configured to cause the suction port opening and closing unit to close the inside of the suction port communicating tube, wherein, in the powder discharge control, the controller is configured to cause the output port opening and closing unit to open the output port so as to discharge the powder from the output port, the powder having been supplied into the feeding tank, and wherein the controller is configured to simultaneously start the negative pressure generation control and the powder discharge control.

2. The powder feeding device according to claim 1, wherein, in the powder supply control, after causing the output port opening and closing unit to close the output port, causing the suction port opening and closing unit to open the inside of the suction port communicating tube, and further causing the negative pressure room opening and closing unit to open the inside of the negative pressure room communication tube, the controller is configured to start the air suction device to suction the air in the negative pressure room and supply the powder from the powder container to the feeding tank, and after that, when determining that the amount of powder is supplied to the feeding tank, the controller is configured to cause the suction port opening and closing unit to close the inside of the suction port communicating tube, stop the air suction device, and cause the negative pressure room opening and closing unit to close the inside of the negative pressure room communication tube.

3. The powder feeding device according to claim 1, further comprising:

a rotational feeding unit that includes a feeding member in the feeding tank, the feeding member being configured to feed the powder in the feeding tank from the input port to the output port when the feeding member rotates around an axle of the feeding member, wherein, in the powder discharge control, the controller is configured to cause the rotational feeding unit to rotate the feeding member.

4. The powder feeding device according to claim 1, further comprising:

an air supply unit configured to supply air into the feeding tank via an air supply port communicating tube connected to an air supply port formed on the feeding tank; and an air supply port opening and closing unit configured to open and close the air supply port communicating tube;

wherein, in the powder discharge control, after causing the output port opening and closing unit to open the output port and causing the air supply port opening and closing unit to open the air supply port communicating tube, the controller is configured to cause the air supply unit to supply air into the feeding tank, and wherein, in the powder supply control, after causing the output port opening and closing unit to close the output port, causing the negative pressure room opening and closing unit to close the inside of the negative pressure room communication tube, and causing the air supply port opening and closing unit to close the air supply port communicating tube, the controller is configured to cause the suction port opening and closing unit to open the inside of the suction port communicating tube.

5. The powder feeding device according to claim 4, wherein the air suction device corresponds to a suction side of a diaphragm pump and the air supply unit corresponds to the diaphragm pump including a discharge side of the diaphragm pump.

6. The powder feeding device according to claim 4, wherein the air suction device corresponds to a suction side of a vane pump and the air supply unit corresponds to the vane pump including a discharge side of the vane pump.

7. The powder feeding device according to claim 1, wherein, in the powder supply control, after causing the output port opening and closing unit to close the output port and causing the suction port opening and closing unit to open the inside of the suction port communicating tube, the controller is configured to simultaneously cause the negative pressure room opening and closing unit to open the inside of the negative pressure room communication tube and start the air suction device to suction the air in the negative pressure room and supply the powder from the powder container to the feeding tank, and after that, when determining that the amount of powder is supplied to the feeding tank, the controller is configured to cause the suction port opening and closing unit to close the inside of the suction port communicating tube, stop the air suction device, and cause the negative pressure room opening and closing unit to close the inside of the negative pressure room communication tube.

8. The powder feeding device according to claim 1, further comprising:

a filter fixed to the suction port and configured to prevent the powder from being passing through the filter and permit air passing through the filter;

an air communicating tube having one end connected to a part of the suction port communicating tube so as to be in communication with the suction port communicating tube and having another end open to air, the part being disposed between the filter and the suction port opening and closing unit; and an air opening and closing unit configured to open and close an inside of the air communicating tube;

wherein after causing the suction port opening and closing unit to close the inside of the suction port communicating tube and causing the negative pressure room opening and closing unit to open the inside of the negative pressure room communication tube, the controller is configured to start the air suction device to suction air in the negative pressure room, wherein after the air in the negative pressure room is suctioned, the controller is configured to cause the negative pressure room opening and closing unit to close the inside of the negative pressure room communication tube, wherein after causing the negative pressure room opening and closing unit to close the inside of the negative pressure room communication tube, the controller is configured to cause the output port opening and closing unit to close the output port and cause the air opening and closing unit to close the inside of the air communicating tube, then, the controller is configured to cause the suction port opening and closing unit to open the inside of the suction port communicating tube to suction the powder from the powder container to the feeding tank, wherein after the powder is suctioned from the powder container to the feeding tank, the controller is configured to cause the suction port opening and closing unit to close the inside of the suction port communicating tube and then cause the air opening and closing unit to open the inside of the air communicating tube, and wherein after causing the air opening and closing unit to open the inside of the air communicating tube, the controller is configured to cause the output port opening and closing unit to open the output port.

9. The powder feeding device according to claim 1, further comprising:

a negative pressure room air communicating tube having one end connected to a negative pressure room air open port formed on the negative pressure room and having another end open to air; and a negative pressure room air opening and closing device configured to open and close an inside of the negative pressure room air communicating tube;

wherein the controller is configured to cause the negative pressure room air opening and closing device to open the inside of the negative pressure room air communicating tube so that a pressure in the negative pressure room is equal to atmospheric pressure, wherein after causing the negative pressure room air opening and closing device to open the inside of the negative pressure room air communicating tube, the controller is configured to cause the suction port opening and closing unit to close the inside of the suction port communicating tube, cause the negative pressure room opening and closing unit to open the inside of the negative pressure room communication tube, cause the negative pressure room air opening and closing device to close the inside of the negative pressure room air communicating tube, and start the air suction device to suction air in the negative pressure room, wherein after the air in the negative pressure room is suctioned, the controller is configured to cause the negative pressure room opening and closing unit to close the inside of the negative pressure room communication tube and stop the air suction device, wherein after causing the negative pressure room opening and closing unit to close the inside of the negative pressure room communication tube and stopping the air suction device, the controller is configured to cause the output port opening and closing unit to close the output port and then cause the suction port opening and closing unit to open the inside of the suction port communicating tube to suction the powder from the powder container to the feeding tank, and wherein after the powder is suctioned from the powder container to the feeding tank, the controller is configured to cause the output port opening and closing unit to open the output port.

10. The powder feeding device according to claim 7, wherein the air suction device is a diaphragm pump.

11. The powder feeding device according to claim 7, wherein the air suction device is a vane pump.

12. An image forming apparatus comprising:

an image carrier configured to carry an electrostatic latent image;

a developing device configured to develop the electrostatic latent image on the image carrier and form a corresponding toner image; and a powder feeding device according to claim 1 as a unit to supply toner to the developing device.

* * * * *